US006475095B1

(12) United States Patent
Henry

(10) Patent No.: US 6,475,095 B1
(45) Date of Patent: Nov. 5, 2002

(54) AMUSEMENT PARK WATER LOCK SYSTEM AND METHOD OF USE

(75) Inventor: Jeffery W. Henry, New Braunfels, TX (US)

(73) Assignee: NBGS International, Inc., New Braunfels, TX (US)

( * ) Notice: Subject to any disclaimer, the term of this patent is extended or adjusted under 35 U.S.C. 154(b) by 0 days.

(21) Appl. No.: 09/369,754

(22) Filed: Aug. 6, 1999

(51) Int. Cl.[7] ..... A63B 21/18
(52) U.S. Cl. ..... 472/117; 472/128; 405/79
(58) Field of Search ..... 472/117, 128; 104/69, 70; 405/79, 80, 87, 100, 104

(56) References Cited

U.S. PATENT DOCUMENTS 3,473,334 A * 10/1969 Dexter ..... 405/83
4,954,014 A 9/1990 Sauerbier et al.
5,011,134 A 4/1991 Langford
5,020,465 A 6/1991 Langford
5,213,547 A 5/1993 Lochtefeld
5,230,662 A 7/1993 Langford
5,236,280 A 8/1993 Lochtefeld
RE34,407 E * 10/1993 Frenzi ..... 472/117
5,271,692 A 12/1993 Lochtefeld
5,421,782 A 6/1995 Lochtefeld
5,453,054 A 9/1995 Langford
5,494,729 A 2/1996 Henry et al.
5,503,597 A 4/1996 Lochtefeld et al.
5,704,294 A * 1/1998 Van Winkle et al. ..... 104/73
5,766,082 A 6/1998 Lochtefeld et al.
5,779,553 A 7/1998 Langford

* cited by examiner

*Primary Examiner*—Kien T. Nguyen
(74) *Attorney, Agent, or Firm*—Eric B. Meyertons

(57) ABSTRACT

A water lock system is described which is configured to convey participants from a first body of water to a second body of water. The water lock system preferably includes a chamber disposed between the first and second bodies of water. A first movable member is preferably formed proximate the first body of water. A second movable member is preferably formed proximate the second body of water. Participants may enter the chamber from the first body of water via the first movable member. The water level in the chamber may be altered transferring the participants from the first body of water to the second body of water. The second movable member is preferably opened and the participants may be transferred to the second body of water.

243 Claims, 32 Drawing Sheets

AMUSEMENT PARK WATER LOCK SYSTEM AND METHOD OF USE

BACKGROUND OF THE INVENTION

1. Field of the Invention

The present disclosure generally relates to water amusement attractions and rides. More particularly, the disclosure generally relates to a system and method for transporting participants from a low elevation body of water to a higher elevation body of water using a lock system.

2. Description of the Relevant Art

The 80's decade has witnessed phenomenal growth in the participatory family water recreation facility, i.e., the waterpark, and in water oriented ride attractions in the traditional themed amusement parks. The current genre of water ride attractions, e.g., waterslides, river rapid rides, and log flumes, require participants to walk or be mechanically lifted to a high point, wherein, gravity enables water, rider (s), and riding vehicle (if appropriate) to slide down a chute or incline to a lower elevation splash pool, whereafter the cycle repeats. Gravity or gravity induced rider momentum is the prime driving force that powers the participant down and through these traditional water ride attractions.

For water rides that involve the use of a flotation device (e.g., an inner tube or floating board) the walk back to the start of a ride may be particularly arduous since the rider must carry the flotation device to the start of the ride. Additionally, many of the more popular waterpark rides may require a substantial waiting period, due to the large number of participants at the park. This waiting period is typically incorporated into the walk from the bottom of the ride back to the top. A series of corrals are typically used to form a meandering line of participants that extends from the starting point of the ride toward the exit point of the ride. The participants waiting in line to reach the starting point may become hot and impatient depending on the length of the wait.

It is therefore desirable to create a system for bringing participants of a water ride from a lower receiving pool back to the start of the ride without requiring the riders to leave the water. This would relieve the riders from the burden of carrying their floatation devices up to the start of a water ride. It would also allow the riders to stay in the water, thus keeping the riders cool while they are transported to the start of the ride.

SUMMARY OF THE INVENTION

A water lock system may be used to allow participants to remain in water while being transported from a first body of water to a second body of water, the bodies of water being at different elevation levels. In one embodiment, the first body of water may be a body of water having an elevation below the second body of water. In an embodiment, the water lock system includes a chamber for holding water coupled to the first body of water and the second body of water. A chamber is herein defined as an at least partially enclosed space. The chamber includes at least one outer wall, or a series of outer walls which together define the outer perimeter of the chamber. The chamber may also be at least partially defined by natural features such as the side of a hill or mountain. The walls may be substantially watertight. The outer wall of the chamber, in one embodiment, extends below an upper surface of the first body of water and above the upper surface of the second body of water. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the first body of water and the chamber when the first movable member is open during use. A second movable member may be formed in the wall of the chamber. The second movable member may be positioned to allow participants and water to move between the second body of water and the chamber when the second movable member is open during use. The second movable member may be formed in the wall at an elevation that differs from that of the first movable member.

In one embodiment, the first and second movable members may be configured to swing away from the chamber wall when moving from a closed position to an open position during use. In another embodiment, the first and second movable members may be configured to move vertically into a portion of the wall when moving from a closed position to an open position. In another embodiment, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In one embodiment, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber.

The lock system may also include a substantially vertical first ladder coupled to the wall of the bottom member and a substantially vertical second ladder coupled to a wall of the chamber. The first and second ladders, in one embodiment, are positioned such that the ladders remain substantially aligned as the bottom member moves vertically within the chamber. The second ladder may extend to the top of the outer wall of the chamber. The ladders may allow participants to exit from the chamber if the lock system is not working properly.

In one embodiment, water may be transferred into and out of the water lock system via the movable members formed within the chamber wall. Opening of the movable members may allow water to flow into the chamber from the upper body of water or out of the chamber into the lower body of water.

In another embodiment, a first conduit may be coupled to the chamber for conducting water to the chamber during use.

A first water control system may be positioned along the first conduit. The first water control system may be configured to control the flow of water through the first conduit during use. In one embodiment, the water control system may include a valve. The valve may be used to control the flow of water from a water source into the chamber. In one embodiment, the water source may be the first or second bodies of water. In another embodiment, the water control system includes a valve and a pump. The valve may be configured to inhibit flow of water through the conduit during use. The pump may be configured to pump water through the conduit during use.

In one embodiment, the first conduit may be coupled to the second body of water. In this embodiment, the first conduit may be configured to transfer water between the second body of water and the chamber during use. In another embodiment, the first conduit may be coupled to the first body of water. In this embodiment the first conduit may be configured to transfer water between the first body of water and the chamber during use. The first water control system may include a pump for pumping water from the first body of water to the chamber.

The lock system may also include a second conduit and a second water control system. The second conduit may be preferably coupled to the chamber for conducting water out of the chamber during use. The second water control system may be positioned along the second conduit to control flow of water through the second conduit during use.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system.

In one embodiment, the participants may be floating in water during the entire transfer from the lower body of water to the upper body of water. The participants may be swimming in the water or floating upon a flotation device. Preferably, the participants are floating on an inner tube, a flotation board, raft, or other flotation devices used by riders on water rides.

In another embodiment, the lock system may include multiple movable members formed within the outer wall of the chamber. These movable members may lead to multiple bodies of water coupled to the chamber. The additional movable members may be formed at the same elevational level or at different elevations.

While described as having only a single chamber coupled to two bodies of water, it should be understood that multiple chambers may be interlocked to couple two or more bodies of water. By using multiple chambers, a series of smaller chambers may be built rather than a single large chamber. In some situations it may be easier to build a series of chambers rather than a single chamber. For example, use of a series of smaller chambers may better match the slope of an existing hill.

The participants may be transferred from the first body of water to the second body of water by entering the chamber and altering the level of water within the chamber. The first movable member, coupled to the first body of water is opened to allow the participants to move into the chamber. The participants may propel themselves or be propelled by a current moving from the lower body of water toward the chamber. The current may be generated using water jets positioned along the inner surface of the chamber. Alternatively, a current may be generated by altering the level of water in the first body of water. For example, by raising the level of water in the first body of water a flow of water from the first body of water into the chamber may occur.

After the participants have entered the chamber, the first movable member is closed and the level of water in the chamber is altered. The level may be raised or lowered, depending on the elevation level of the second body of water with respect to the first body of water. If the second body of water is higher than the first body of water, the water level is raised. If the first body of water is at a higher elevation than the second body of water, the water level is lowered. As the water level in the chamber is altered, the participants are moved to a level commensurate with the upper surface of the second body of water. While the water level is altered within the chamber, the participants remain floating proximate the surface of the water. A bottom member preferably moves with the upper surface of the water in the chamber to reduce the risk of participants drowning. The water level in the chamber, in one embodiment, is altered until the water level in the chamber is substantially equal the water level of the second body of water. The second movable member may now be opened, allowing the participants to move from the chamber to the second body of water. In one embodiment, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the body of water. When the movable member is open, the formed current may be used to propel the participants from the chamber to a body of water. Thus, the participants may be transferred from a first body of water to a second body of water without having to leave the water. The participants are thus relieved of having to walk up a hill. The participants may also be relieved from carrying any flotation devices necessary for the waterpark rides.

The water lock system may be incorporated into a waterpark or amusement park to allow participants to move easily from lower bodies of water to upper bodies of water. In one embodiment, the water lock system may be positioned adjacent to one or more water rides. The water rides carry the participants from upper bodies of water to lower bodies of water. These upper and lower bodies of water may be coupled to the centrally disposed water lock system to carry the participants from the lower bodies of water to the upper bodies of water. In this manner, the participants may be able to remain in water during their use of multiple water rides.

BRIEF DESCRIPTION OF THE DRAWINGS

Other objects and advantages of the invention will become apparent upon reading the following detailed description and upon reference to the accompanying drawings in which.

Figure 1:
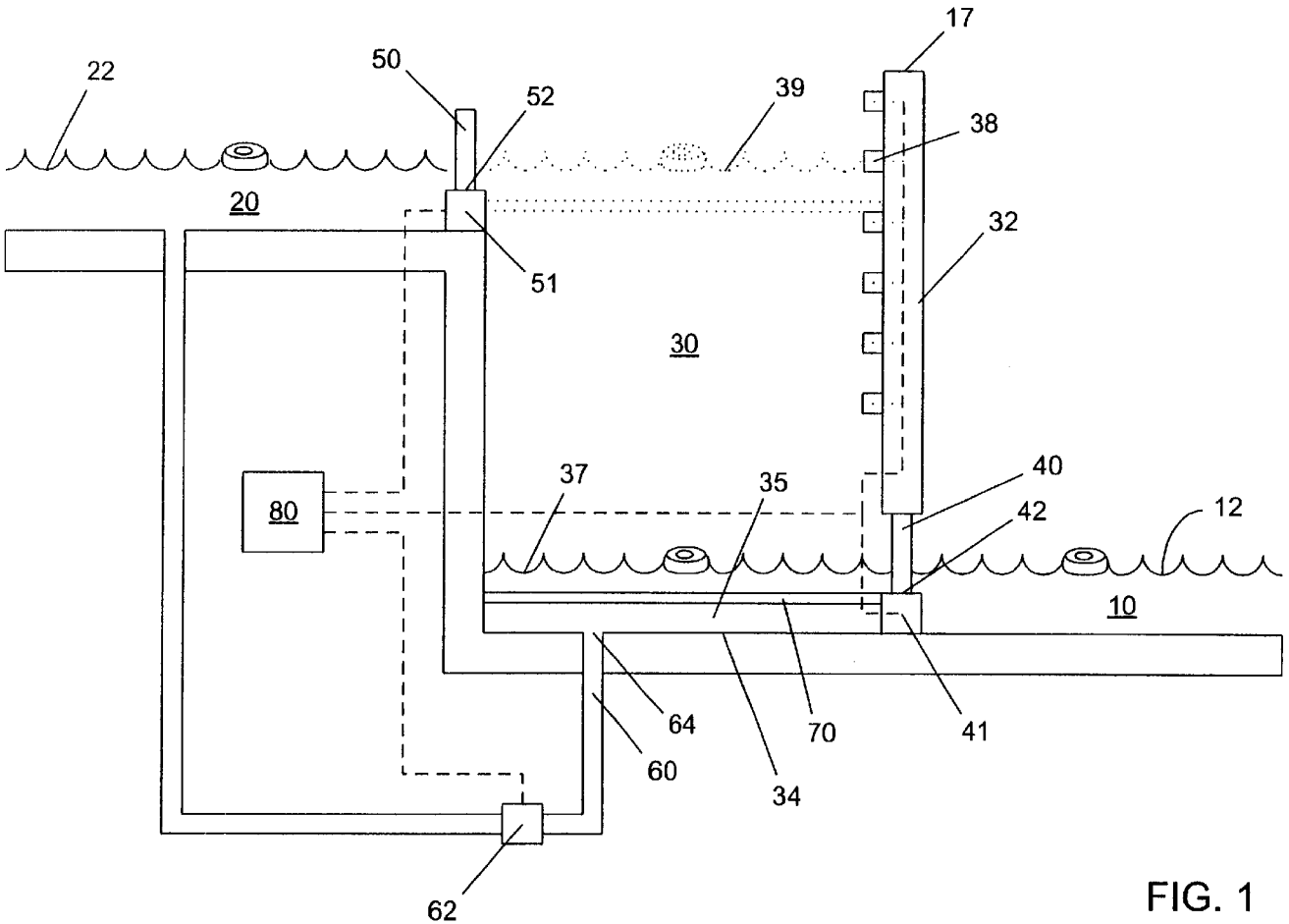
FIG. 1. depicts a cross-sectional side view of a water lock system with one chamber and a conduit coupling the upper body of water to the chamber.
Figure 2:
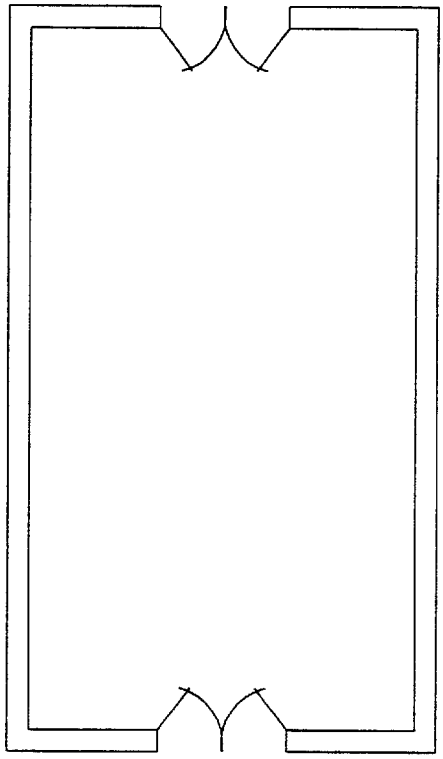
FIG. 2 depicts an overhead view of a rectangular lock system.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE INVENTION

FIG. 1 depicts a water lock system for conveying a person or a group of people (i.e., the participants) from a lower body of water 10 to an upper body of water 20. It should be understood that while a system and method of transferring the participants from the lower body of water to the upper body of water is herein described, the lock system may also be used to transfer participants from an upper body to a lower body, by reversing the operation of the lock system. The upper and lower bodies of water may be receiving pools (i.e., pools positioned at the end of a water ride), entry pools (i.e., pools positioned to at the entrance of a water ride), another chamber of a water lock system, or a natural body of water (e.g., a lake, river, reservoir, pond, etc.). The water lock system, in one embodiment, includes at least one chamber 30 coupled to the upper and lower bodies of water. First movable member 40 and second movable member 50 may be formed in an outer wall 32 of the chamber. First movable member 40 may be coupled to lower body of water 10 such that the participants may enter chamber 30 from the lower body of water while the water 35 in the chamber is at level 37 substantially equal to upper surface 12 of the lower body of water. After the participants have entered chamber 30, the level of water within the chamber may be raised to a height 39 substantially equal to upper surface 22 of upper body of water 20. Second movable member 50 may be coupled to upper body of water 20 such that the participants may move from chamber 30 to the upper body of water after the level of water in the chamber is raised to the appropriate height.

Outer wall 32 of chamber 30 may be coupled to both lower body of water 10 and upper body of water 20. Outer wall 32 may extend from a point below upper surface 12 of lower body of water 10 to a point above upper surface 22 of upper body of water 20. Outer wall 32 may be formed in a number of different shapes, as depicted in FIGS. 2–5. Outer wall 32 of the chamber may, when see from an overhead view, be in a rectangular shape (FIG. 2), a U-shape (FIG. 3), a circle (FIG. 4), an L-shape (FIG. 5), as well as a number of other shapes not depicted, including, but not limited to, a square, a star, other regular polygons (e.g., a pentagon, hexagon, octagon, etc.), a trapezoid, an ellipse, a Y-shape, a T-shape, or a figure eight.

Returning to FIG. 1, first movable member 40 may be in contact with lower body of water 10. First movable member 40 may extend from a position below upper surface 12 of lower body of water 10 to a point above upper surface 12. First movable member 40 may extend from a position below the upper surface of lower body of water 10 to the top 17 of outer wall 32. First movable member 40 may be formed in a portion of outer wall 32 which is substantially shorter then the vertical length of the wall. In one embodiment, first movable member 40 extends to a depth below upper surface 12 such that participants may easily enter the chamber without contacting the lower surface 42 of the first movable member. If participants are to be able to walk into the chamber, first movable member 40 may extend to the bottom 34 of chamber 30. Thus, participants may enter the chamber without tripping over a portion of outer wall 32. In one embodiment, the participants will enter the chamber while floating at or proximate the upper surface 12 of the water. The lower surface 42 of first movable member 40 may be positioned at a depth of between about 1 foot to about 10 feet below upper surface 12 of lower body of water 10, more preferably at a depth of between about 2 feet to about 6 feet from upper surface 12, and more preferably still at a depth of between about 3 feet to about 4 feet from upper surface 12. As the participants float from lower body of water 10 into chamber 30, they may pass over lower surface 42 of first movable member 40 with little or no contact with the lower surface of the movable member.

Second movable member 50 may be in contact with upper body of water 20. Second movable member 50 may extend from a position below upper surface 22 of upper body of water 20 to a point above upper surface 22. Second movable member 50 may extend from a position above upper surface 22 of lower body of water 20 to the bottom 34 of chamber 30. Second movable member 50 may be formed in a portion of outer wall 32 which is substantially shorter then the vertical length of the wall. Second movable member 50 may be formed at a position in outer wall 32 such that participants may move from chamber 30 to upper body of water 20, when water 35 within the chamber is at the appropriate level. In one embodiment, second movable member 50 extends to a depth below upper surface 22 of upper body of water 20 to allow participants to enter the upper body of water without contacting lower surface 52 of the second movable member. The participants may enter the upper body of water while floating at or proximate the upper surface 39 of the water within the chamber 30. The lower surface 52 of second movable member 50 may be positioned at a depth of between about 1 foot to about 10 feet from upper surface 22 of upper body of water 20, more preferably at a depth of between about 2 feet to about 6 feet from upper surface 22, and more preferably still at a depth of between about 3 feet to about 4 feet from upper surface 22. As the participants float from chamber 30 to upper body of water 20, they may pass over lower surface 52 of second movable member 50 with little or no contact.

In one embodiment, water may be transferred into and out of chamber 30 via movable members 40 and 50 formed within outer wall 32. Opening of the movable members 40 and 50 may allow water to flow into chamber 30 from the upper body of water 20 or out of the chamber into lower body of water 10. Control of the movable members 40 and 50 may allow chamber 30 to be filled and lowered as needed.

In another embodiment, a conduit 60 may be coupled to chamber 30. Conduit 60 may be configured to introduce water from a water source into chamber 30. A water control system 62 may be positioned along conduit 60 to control flow of water through the conduit. Water control system 62 may be a valve which is configured to control the flow of water from a pressurized water source to chamber 30 during use. Water control system 62 may also include a pump, as described later, for increasing the flow rate of water flowing through conduit 60.

In one embodiment, conduit 60 may be coupled to upper body of water 20. Conduit 60 may be configured to allow water from upper body of water 20 to be transferred to chamber 30. Water control system 62 may be used to control the transfer of water from upper body of water 20 to chamber 30. In one embodiment, conduit 60 is positioned such that an outlet 64 of the conduit enters chamber 30 at a position below upper body of water 20. In this manner, upper body of water 20 may act as a pressurized water source for the supplying water to chamber 30. In this embodiment, the water control system 62 may be a simple two way valve. To fill chamber 30, the valve may be adjusted to an open position, allowing water from upper body of water 20 to enter the chamber. When a desired amount of water has entered chamber 30, the valve may be closed to inhibit further passage of water from upper body of water 20 to the chamber.

A bottom member 70 may be positioned within chamber 30. Bottom member 70 may be configured to float at a position below upper surface 37 of water 35 in chamber 30. As chamber 30 is filled with water, bottom member 70 will rise toward the top of the chamber. In one embodiment, bottom member 70 remains at a substantially constant distance from upper surface 37 of water 35 as the water rises within chamber 30. Bottom member 70 may remain at a distance of less than about 6 feet from upper surface 37 of water 35, preferably at a distance of less than about 4 feet from upper surface 37, and more preferably at a distance of less than about 3 feet from upper surface 37.

During operation, chamber 30 is filled with water to elevate the participants to a level commensurate with the level of water in upper body of water 20. As the level of water 35 in chamber 30 increases, some participants may become apprehensive or upset once the level of water passes a depth which is over the participants' heads. This may especially be true for younger or less experienced swimmers. To assuage the fears of these participants, bottom member 70 may be positioned at a depth below the surface of the water such that most or all of the participants may easily stand upon the bottom member as the water begins to rise. In this manner, the participants will be lifted by the incoming water, while feeling confident that if they should tire or fall off a flotation device they may rest upon bottom member 70. Bottom member 70 may also reduce the risk of participants drowning. If a participant becomes fatigued or separated from their flotation device, the position of bottom member 70 will ensure that the participant will always be able to stand with their head above or near upper surface 37 of water 35 if desired.

An automatic control system 80 may be coupled to the water lock system. The controller 80 may be a computer, programmable logic controller, or any of other known controller systems known in the art. The controller may be coupled to water control system 62, first movable member 40, and second movable member 50. The controller may control the operation of the first and second movable members and the operation of the water control system. A first movable member operating mechanism 41 may be coupled to first movable member 40 to allow automatic opening and closing of the first movable member. The controller may send signals to first movable member operating mechanism 41 to open first movable member 40, while maintaining second movable member 50 and water control system 62 in closed positions. After the participants have entered the chamber, the controller may signal first movable member operating mechanism 41 to close first movable member 40 and signal water control system 62 to allow water to enter chamber 30. The controller may be configured to allow the water to flow into chamber 30 for a predetermined amount of time. Alternatively, sensors 38 for determining the level of the water 35 within chamber 30 may be positioned on an inner surface of outer wall 32. In one embodiment, sensors 38 are positioned at various heights along outer wall 32. When water 35 within chamber 30 reaches sensors 38, the sensors may produce a signal to automatic controller 80 which indicate the current height of the water within the chamber. A second movable member operating mechanism 51 may be coupled to second movable member 50 to allow automatic opening and closing of the second movable member. After the water has reached the desired level, automatic controller 80 may be configured to signal water control system 62 to stop the flow of water to chamber 30 and second movable member operating mechanism 51 to open second movable member 50 allowing the participants to move to upper body of water 20.

Figure 6:
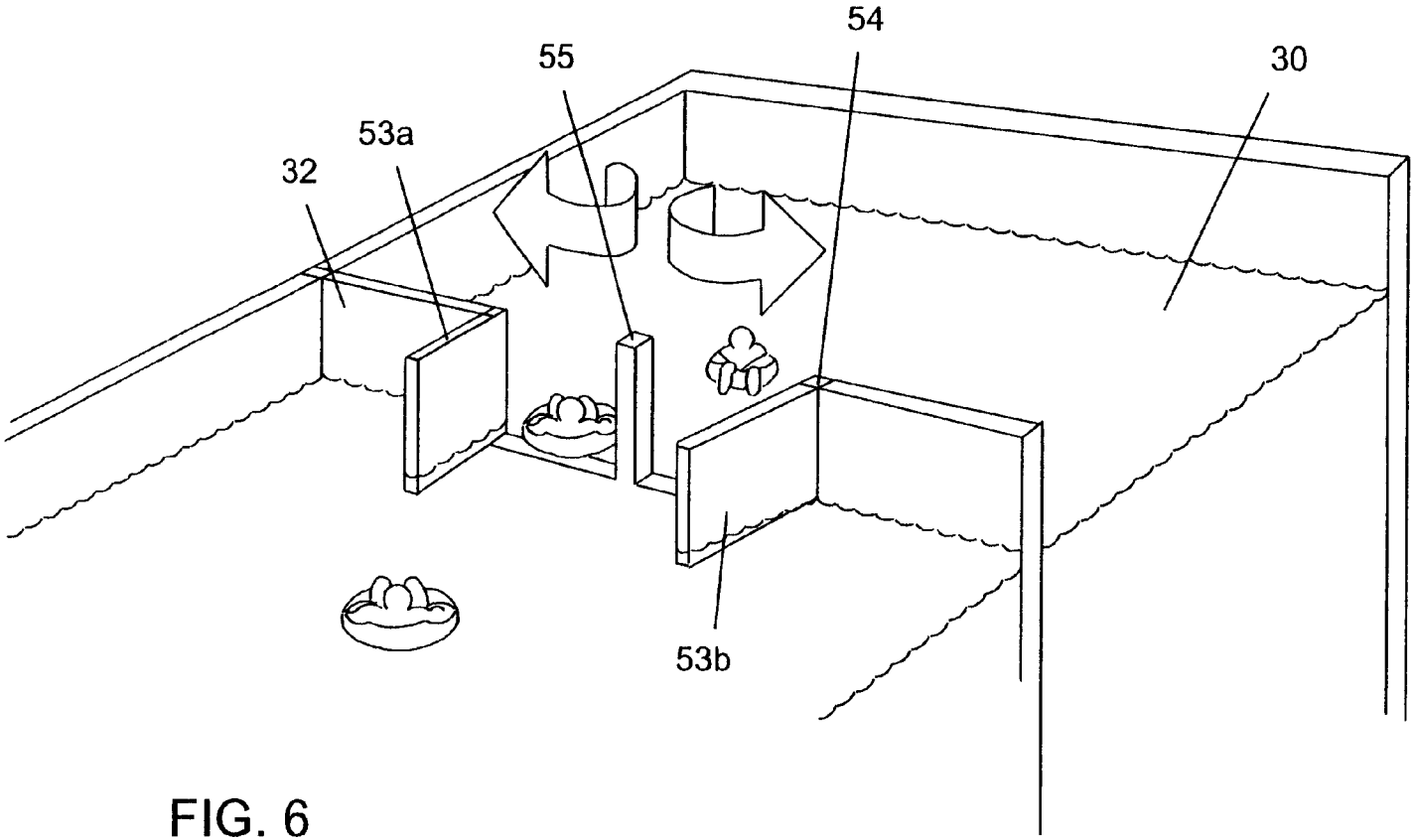
FIG. 6 depicts a perspective view of a lock system which includes swinging door movable member.

First movable member 40 and/or second movable member 50 may be a swinging door, as depicted in FIG. 6. The movable members may include a single door, or, preferably a pair of doors 53a and 53b. The doors may be coupled to outer wall 32 by a hinge 54. Hinge 54 allows the doors to swing away from outer wall 32 when moving from a closed to an open position. An "open position" is a position which allows water and/or participants to be transferred through the movable member. A "closed position" is a position which inhibits passage of water and/or participants through the movable member. The doors 53*a/b* may swing into chamber 30 or away from chamber 30. If two doors are used a divider 55 may be positioned between the two doors 53*a/b*. Divider 55 may serve as a support to help maintain doors 53*a/b* in a closed position. A hydraulic movable member operating system 51 (see FIG. 1) may be coupled to doors 53*a/b* to facilitate opening and closing of the doors during use. Doors 53*a/b* may have a length which is substantially equal to the vertical length of outer walls 32. Doors 53*a/b* may have a vertical length of between about 3 to about 6 feet, preferably a vertical length of between about 3 feet to about 4 feet.

Figure 7:
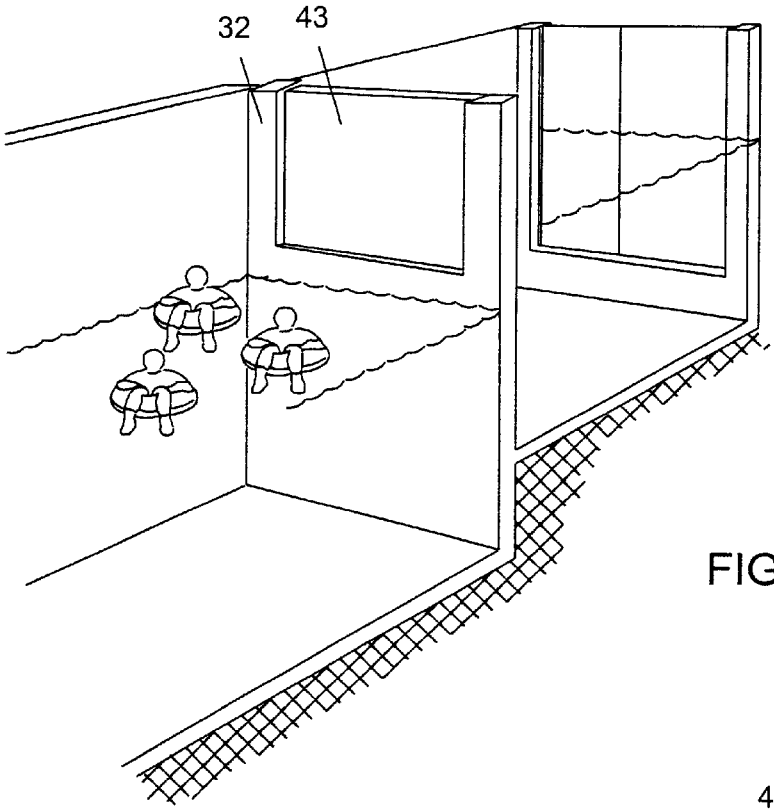
FIG. 7 depicts a perspective view of a lock system which includes a vertically movable member with the movable member in a closed position.
Figure 8:
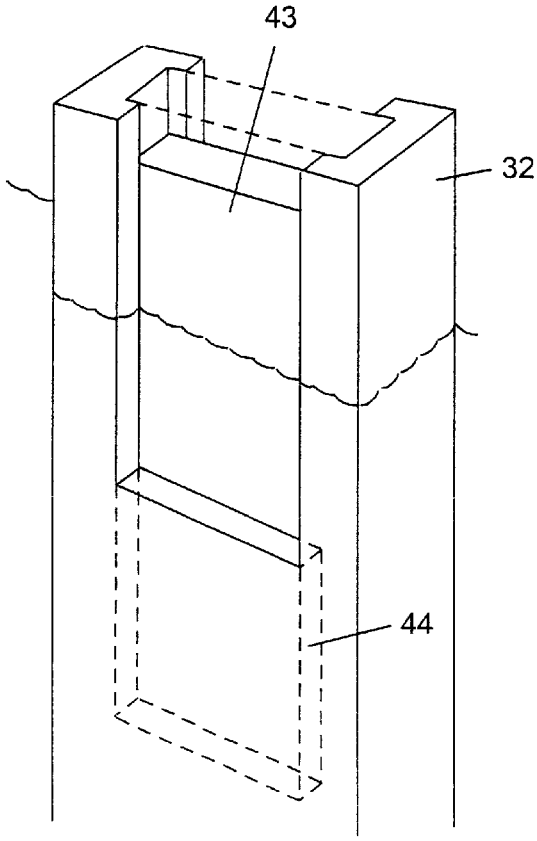
FIG. 8 depicts a perspective view of a vertically movable member moving to an open position.
Figure 9:
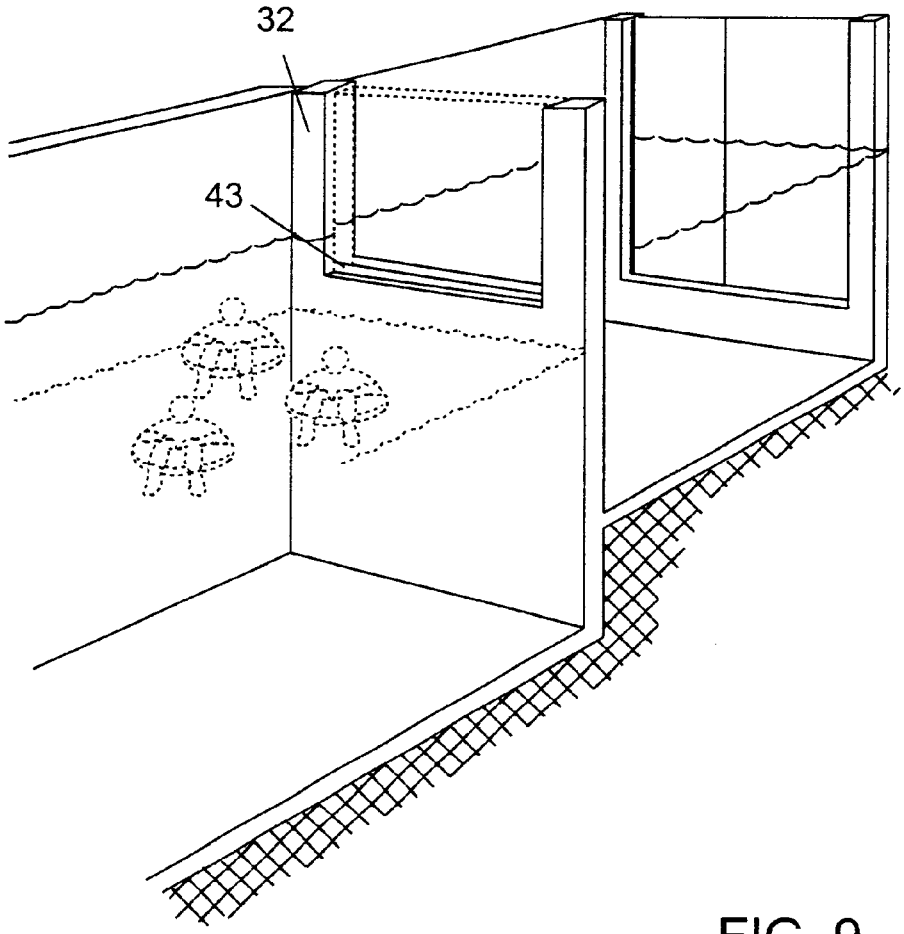
FIG. 9 depicts a perspective view of a lock system which includes a vertically movable member with the movable member in an open position.

In another embodiment, depicted in FIGS. 7–9, first movable member 40 and/or second movable member 50 may be a door 43 configured to move vertically into a portion of outer wall 32. As depicted in FIG. 8, when door 43 moves from a closed position (See FIG. 7) to an open position (see FIG. 9) the door may be moved into a cavity 44 formed in outer wall 32. In FIG. 8, door 43 is configured to move down into cavity 44 when moving into an open position. A hydraulic movable member operating system 41 (see FIG. 1), or similar devices, may be positioned within outer wall 32 to move the door up or down. The door preferably has a vertical length of between about 3 feet to about 6 feet, more preferably a vertical length of between about 3 feet to about 5 feet.

When a movable member, is positioned near an upper body of water, the movable member may be lowered into the wall (as depicted in FIGS. 7–9). When a movable member is positioned near a lower body of water the door of the movable member may be formed in the middle of the wall, or near the bottom of the wall. In this case, the movable member may be moved from a closed position to an open position by moving the movable member in an upward or downward direction.

Figure 10:
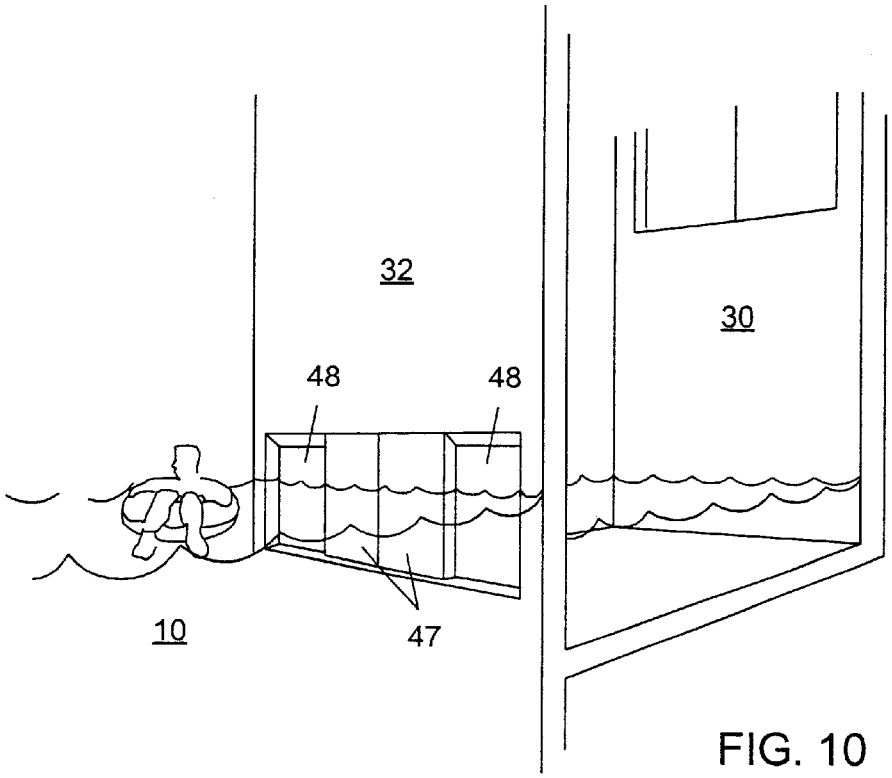
FIG. 10 depicts a perspective view of a lock system which includes a horizontally movable member with the movable member in a closed position.
Figure 11:
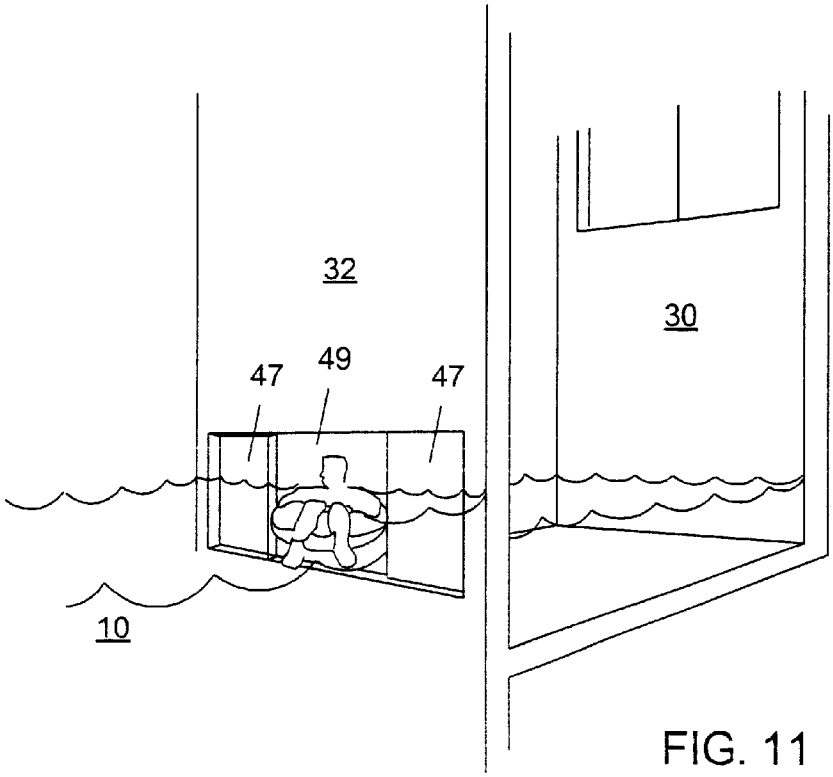
FIG. 11 depicts a perspective view of a lock system which includes a horizontally movable member with the movable member in an open position.

In another embodiment, depicted in FIGS. 10–11, the movable members may be a single door, or, as depicted, a pair of doors 47, configured to move horizontally into a cavity 48 formed in outer wall 32. When doors 47 move from a closed position (depicted in FIG. 10) to an open position (depicted in FIG. 11) the doors may be moved into cavity 48. As depicted in FIG. 11, the doors may be configured to move away from a central portion of the movable member along outer wall 32, when moving into an open position. A hydraulic system, or similar system, may be positioned within cavity 48 or upon outer wall 32 to move the door. The door may have a vertical length of between about 3 feet to about 6 feet, more preferably a vertical length of between about 3 feet to about 5 feet.

Referring to FIG. 11, the horizontally movable doors 47 are depicted near the lower body of water. Doors 47 are depicted in an open position. While in this position, the doors may reside in cavity 48, leaving opening 49 through which the participants may pass from lower body of water 10 to chamber 30 or from chamber 30 to lower body of water 10. When the participants are to be moved to an upper body of water, doors 47 may be moved into a closed position, as depicted in FIG. 10 and the chamber may be filled with water.

The movable members may be any combination of sliding or swinging doors. For example, all of the movable members may be vertically sliding doors. Alternatively, the lower movable member may be horizontally sliding doors while the upper movable member may be vertically sliding doors. An advantage to using sliding doors or small hinged doors is that the amount of power necessary to move such doors may be minimized. In a typical lock system, such as those used to move ships, the entire wall of the lock system is typically used as the movable member. Thus, a hydraulic system which is capable of opening a massive movable member may be required. Such systems tend to be relatively slow and may require large amounts of power to operate. For the purposes of moving people, the doors only need to be large enough to comfortably move a person from one body of water to the next. Thus, much smaller doors may be used. A further advantage of sliding doors is that the movement of the doors (either horizontally or vertically) is not significantly inhibited by water resistance. The sliding doors may also be safer than swinging doors, since a swinging door may swing into a participant during the opening or closing of the movable member.

Figure 12:
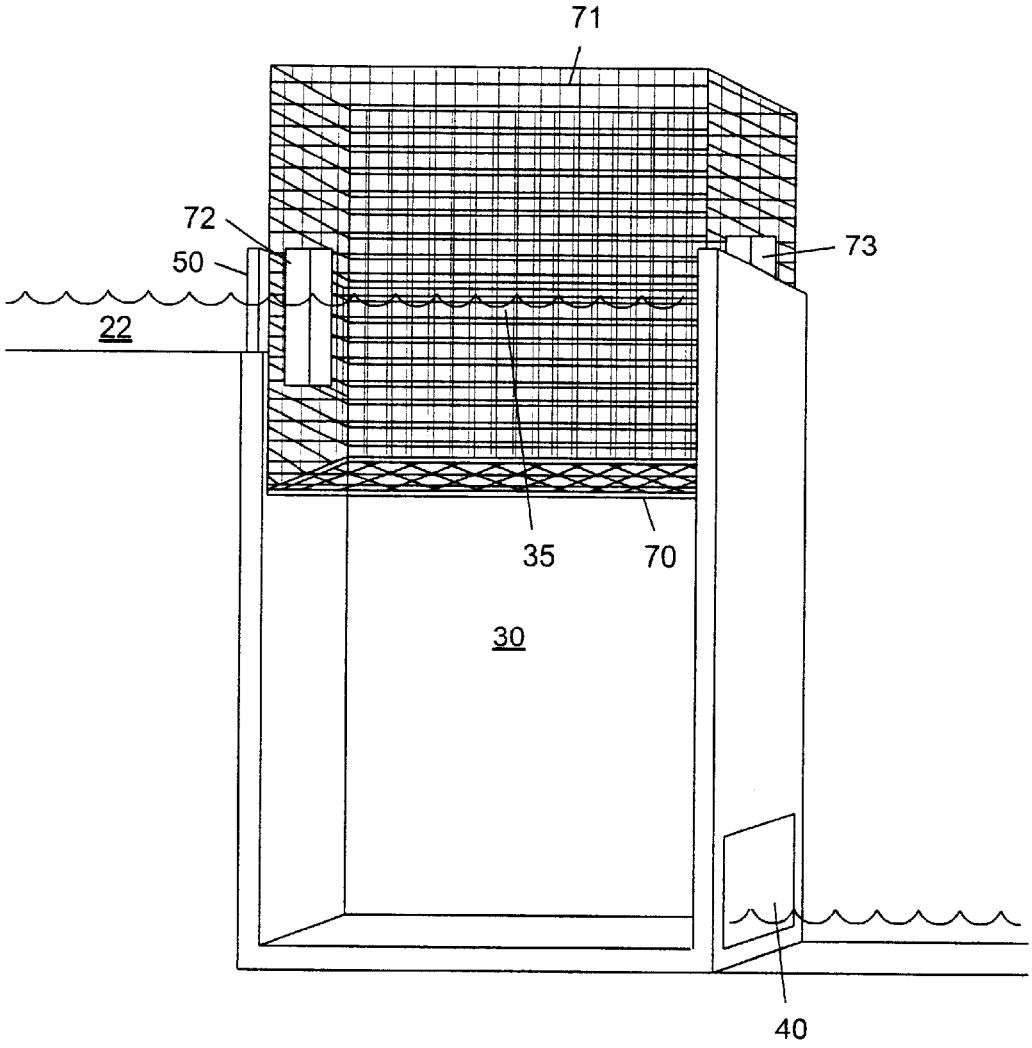
FIG. 12 depicts a perspective view of a lock system which includes a bottom member.

Turning to FIG. 12, a substantially water permeable bottom member 70 is depicted. By making bottom member 70 water permeable, water may flow through the bottom member with little resistance, thus allowing the bottom member to easily move through the water in chamber 30. In one embodiment, a number of openings are formed in bottom member 70 to allow water to pass through the bottom member. The openings may be in any shape, including, but not limited to a square, circular, rectangular, regular polygon, star, or an oval. In one embodiment, the openings have a shape and size that allows water to freely move through the openings, while inhibiting the participants from moving through the openings.

In one embodiment, bottom member 70 is composed of a grid of elongated members as depicted in FIG. 12. The spacing of the elongated members is such that participants, as well as the arms, legs, hands, feet, heads, etc. of the participants, are inhibited from passing through any of the openings formed by the grid.

Bottom member 70, in one embodiment, includes a wall 71 formed along the perimeter of the bottom member. Wall 71 may extend from the bottom member toward the top of chamber 30. Wall 71 may extend above the surface of the water 35 in the chamber during use. The wall may be configured to extend to a height such that the participants are inhibited from moving to a position below bottom member 70. In this configuration, bottom member 70 may act as a "basket" which ensures that the participants remain at or near the upper surface of the water 35 in chamber 30 at all times. Wall 71 may extend above the surface of the water by a distance of between about 2 to about 6 feet, preferably by a distance of between about 2½ to about 5 feet, and more preferably by a distance of between about 3 to 4 feet.

Movable members 72 and 73 may be formed in wall 71 of bottom member 70. Movable members 72 and 73 may be formed at a location in wall 71 such that they correspond with the position of the first movable member 40 and the second movable member 50 formed in outer wall 32 of the chamber, when the bottom member is at a level proximate one of the first or second movable members. For example, as depicted in FIG. 12, movable member 72 of the bottom member is positioned in wall 71 of the bottom member at a level approximately equal to the second movable member 50, when water 35 in chamber 30 is substantially equal to the water level in upper body of water 20. This may allow participants to easily exit through wall 71, via movable member 72 and through second movable member 50 when moving from chamber 30 to upper body of water 20. In a similar manner, movable member 73 may be positioned at a level approximately equal to first movable member 40, when water 35 in the chamber is lowered. Movable members 72/73 may extend over the entire vertical length of wall 71 of the bottom member. In one embodiment, movable members 72/73 extend from about 1 to 3 feet below the surface of the water to 1 to 3 feet above the surface of the water, preferably from about 1½ to about 2 feet above and below the upper surface of the water.

Figure 13:
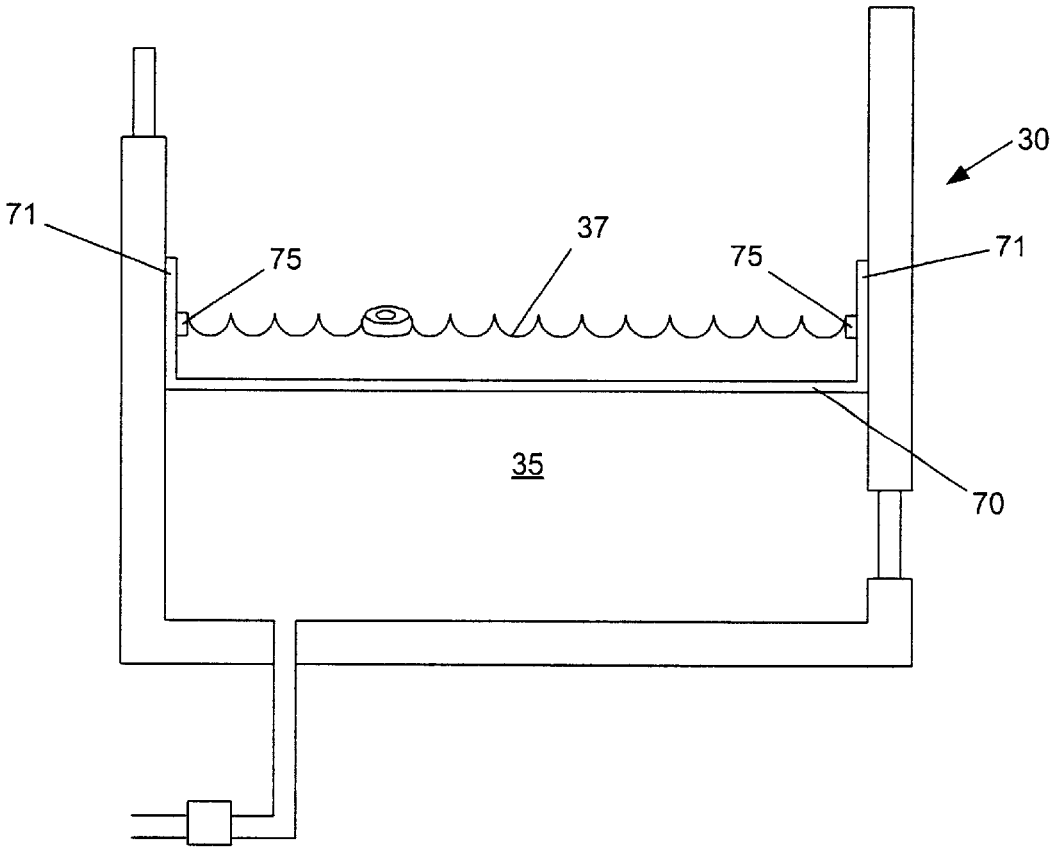
FIG. 13 depicts a cross sectional side view of a bottom member disposed within a chamber of a lock system.

Bottom member 70 may be configured to remain at a substantially constant distance from the upper surface 37 of the water in chamber 30 as the water level is adjusted within the chamber. In one embodiment, depicted in FIG. 13, flotation members 75 may be placed on wall 71 to provide buoyancy to bottom member 70. By placing floatation members 75 at a location between the bottom member 70 and the top of wall 71 the level at which the bottom member remains below the surface may be maintained. For example, by placing flotation members 75 at a position approximately three feet from the bottom of wall 71, bottom member 70 may be maintained at a position of at least about 3 feet below the surface of the water. In one embodiment, flotation members 75 are placed on wall 71 at a position such that the bottom member remains about 3 feet below the upper surface of the water and such that wall 71 extends about 3 feet above the surface of the water.

Figure 14:
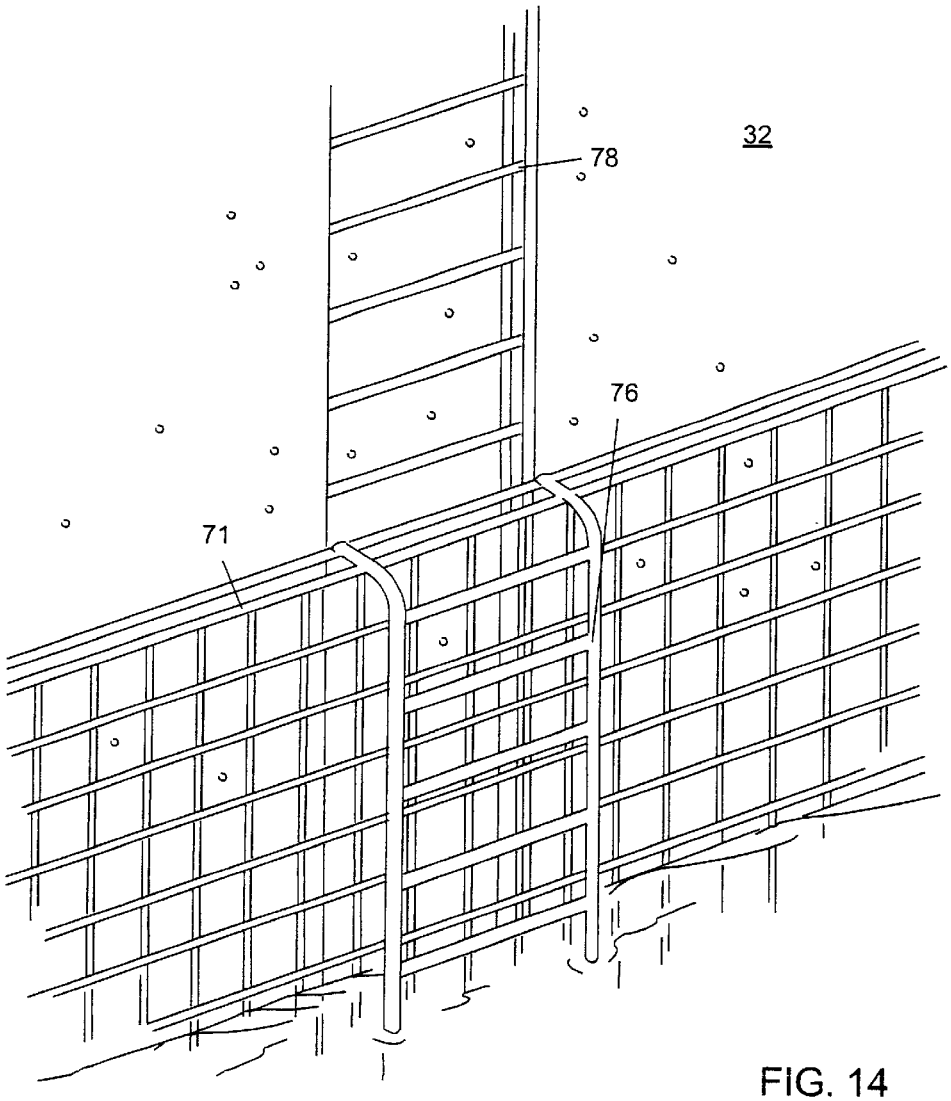
FIG. 14 depicts a perspective view of a ladder coupled to the wall and the bottom member.

Turning to FIG. 14, bottom member 70 may also include a ladder 76 extending along a vertical portion of wall 71 of the bottom member. Ladder 76 may extend from the bottom member (not shown) to the top of wall 71. A complimentary ladder 78 may be formed on an inner surface of the outer wall 32 of the chamber. The complementary ladder 78 may extend the entire vertical height of the chamber and is substantially aligned with the ladder 76 of the bottom member. As the bottom member is raised or lowered ladder 76 and ladder 78 may remain substantially aligned such that at any give time participants may exit the chamber by climbing up the ladders 76 and 78. In the event that the chamber cannot be properly filled, the ladders 76 and 78 may allow the participants to exit the chamber. Thus, the ladder system may act help to prevent participants from becoming trapped within the chamber in the event of a breakdown of the lock system.

Figure 15:
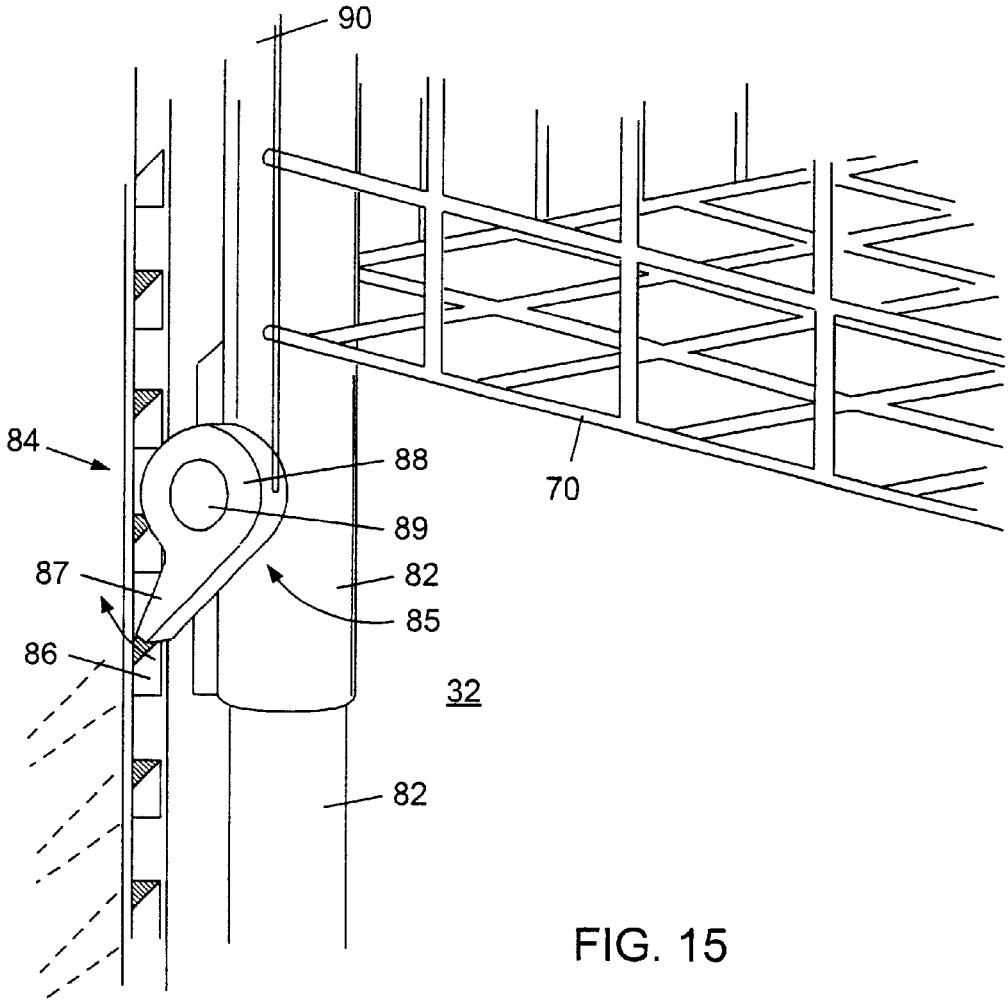
FIG. 15 depicts a perspective view of a ratcheted locking mechanism.

In an embodiment, bottom member 70 is preferably coupled to outer wall 32 by at least one guide rail 80 formed on the inner surface of the outer wall, as depicted in FIG. 15. An engaging member 82 may couple bottom member 70 to guide rail 80. Engaging member 82 may substantially surround a portion of guide rail 80 such that the engaging member is free to move vertically along the guide rail, but is substantially inhibited from becoming detached from the guide rail. The coupling of bottom member 70 to guide rail 80 may reduce the bobbing movement of the bottom member while the bottom member is floating within the chamber. The engaging member 82 may also include a motor configured to move the bottom member vertically within the chamber. The use of a motor to move the bottom member, allows the bottom member to be moved without floating the bottom member.

A ratcheted locking system 84 may also be incorporated onto bottom member 70. Ratchet locking system 84 includes a locking member 85 which is configured to fit into grooves 86 formed in the inner surface of outer wall 32. Locking member 85 may include a protrusion 87 extending from the main body 88 configured to fit into grooves 85. The main body 88 may include a ratchet system 89 which forces protrusion 85 against outer wall 32. A ratchet system may allow locking member 85 to rotate relatively freely in one direction, while allowing only a constrained rotation in the opposite direction. As depicted in FIG. 15, the locking member may be configured such that rotation in a clockwise direction is constrained. As bottom member 70 moves along up the wall the protrusion may be forced into one of the grooves 86 when aligned with a groove. As the bottom member 70 is forced up by the rising water, protrusion 87 may slide out of one groove 86 and into another groove. Protrusion 87 may extend from main body 88 of locking member 85 at an angle to facilitate removal of the protrusion from a groove 86 as bottom member 70 moves upward.

When the bottom member 70 moves in a downward direction, locking system 85 may inhibit the downward movement of the bottom member. As bottom member 70 moves downward, protrusion 87 may extend into one of grooves 86. The locking member 85, as described above, may only rotate for a limited distance in a clockwise direction. Thus, once protrusion 87 is extended into a groove 86, the protrusion may lock bottom member 70 at that position, preventing further movement of the bottom member in a downward direction. The bottom member may be unlocked by raising the bottom member or via a release mechanism which is incorporated into the ratchet system 89.

After a group of participants have moved to an upper body of water, the water level of the chamber, along with bottom member 70 may be lowered to pick up additional participants. To lower the bottom member, a release system may be incorporated into the ratchet system 89. The release system may be configured to allow the locking system 85 to be moved into a position such that protrusion 87 no longer makes contact with the grooves 86. This may allow the bottom member to be moved in a downward direction. In one embodiment, a flexible member 90 (e.g., a chain, rope, wire, etc.) may be attached to locking member 85. To allow bottom member 70 to be lowered, flexible member 90 may be pulled such that the protrusion 87 is moved away from grooves 86 (i.e., the locking member is rotated in a counterclockwise direction, as depicted in FIG. 15). Flexible member 90 may be manually or automatically operated.

Figure 16:
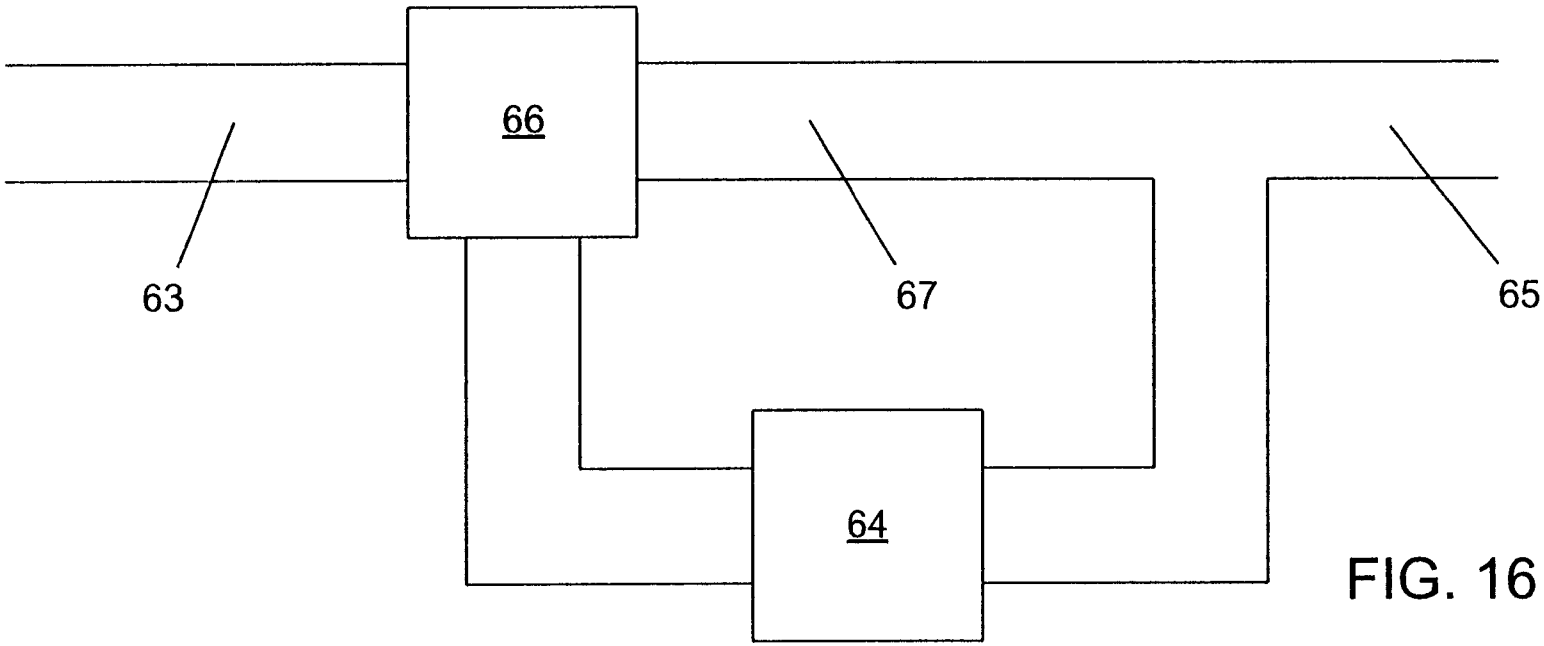
FIG. 16 depicts a cross sectional side view of a water control system.

A number of configurations may be used to control the input of water to the chamber, and the output of water from the chamber. Referring back to FIG. 1, a conduit 60 may be coupled to upper body of water 20 such that water from the upper body of water may be transferred into chamber 30. The water may be removed by opening the first movable member 20 (either partially or fully) to remove the water from the chamber. Alternatively, water control system 62 may include a pump for pumping the water back to upper body of water 20. As depicted in FIG. 16, a water control system may include a pump 64 and a diverter valve 66. Conduit 63 may be coupled to the upper body of water, while conduit 65 may be coupled to the chamber. Diverter valve 66 may be a three way valve which allows water to pass through pump 64 or a bypass conduit 67. When the chamber is to be filled diverter valve 66 may be set to allow water to pass through bypass conduit 67 and into the chamber. Alternatively, the valve may be switched to allow the pump 64 to increase the rate of water flow into the chamber. The water may be flowed through the conduit until the upper level of the water in the chamber is substantially equal to the upper level of the water in the upper body of water.

To lower the water level in the chamber, the diverter valve 66 may be switched to allow water to flow to pump 64. The water may be pumped from the chamber back to the upper body of water until the level of the water in the chamber and the lower body of water are substantially equal. In the case when pump 64 is used to increase flow of water to the chamber and also to pump water back to the upper body of water, pump 64 may be a reversible pump. Alternatively, two separate pumps may be used to pump water in each direction. In this manner, water may be transferred from the chamber to the upper body of water and from the upper body of water to the chamber using the same conduit. In this embodiment, the amount of water transferred from the upper body of water to the lower body of water during multiple cycles of the lock system may be negligible.

Figure 17:
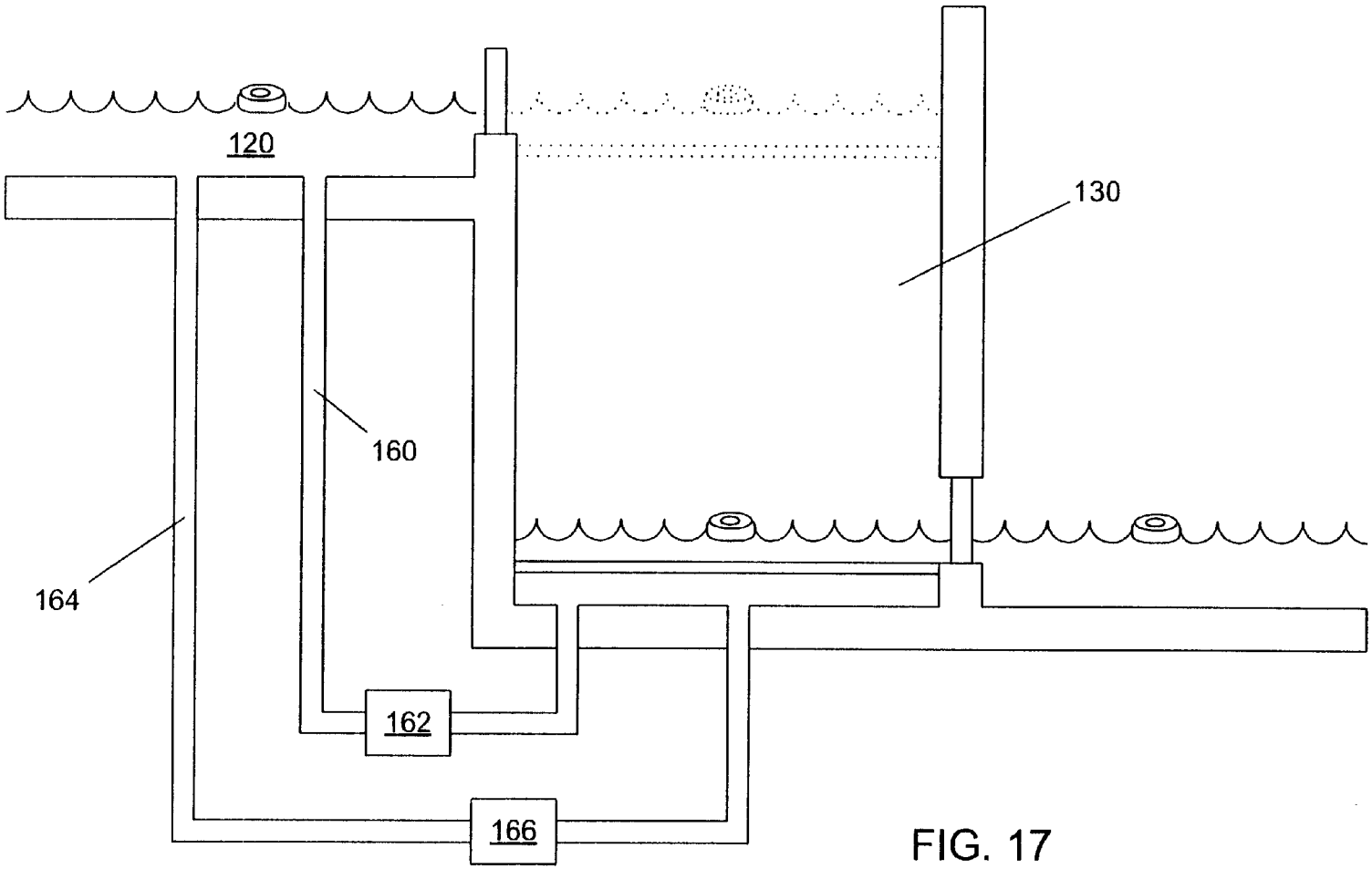
FIG. 17 depicts a cross sectional side view of a water lock system which includes one chamber and two conduits coupling an upper body of water to the chamber.

Alternatively, two conduits may be used to transfer the water to and from the chamber, as depicted in FIG. 17. A first conduit 160 may be coupled to an upper body of water 120 and a chamber 130. First conduit 160 may include a first water control system 162. The first water control system 162 may be a two-way valve. A second conduit 164 may also be coupled to upper body of water 120 and chamber 130. The second conduit may include a second water control system 166. The second water control system 166 may include a pump and a valve. To fill chamber 130 with water, the first water control system 162 may be set to allow water to flow from upper body of water 120 to chamber 130. To lower the water level in chamber 130, second water control system 166 may be opened, while closing first water control system 162, such that the pump of the second water control system pumps water from the chamber back to upper body of water 120.

These embodiments, where the water is transferred from and to the upper body of water may have an advantage when the upper and lower body of water require a preset amount of water to be maintained within the bodies of water during use. If excess water is transferred from the upper body of water to the lower body of water, the upper body of water may become depleted of water while the lower body of water may become overfilled. The transfer of the water from the upper body of water to the chamber and then back to the upper body of water from the chamber may alleviate this problem by maintaining both the upper and lower bodies of water at a substantially constant level over multiple cycles of the lock system.

Figure 18:
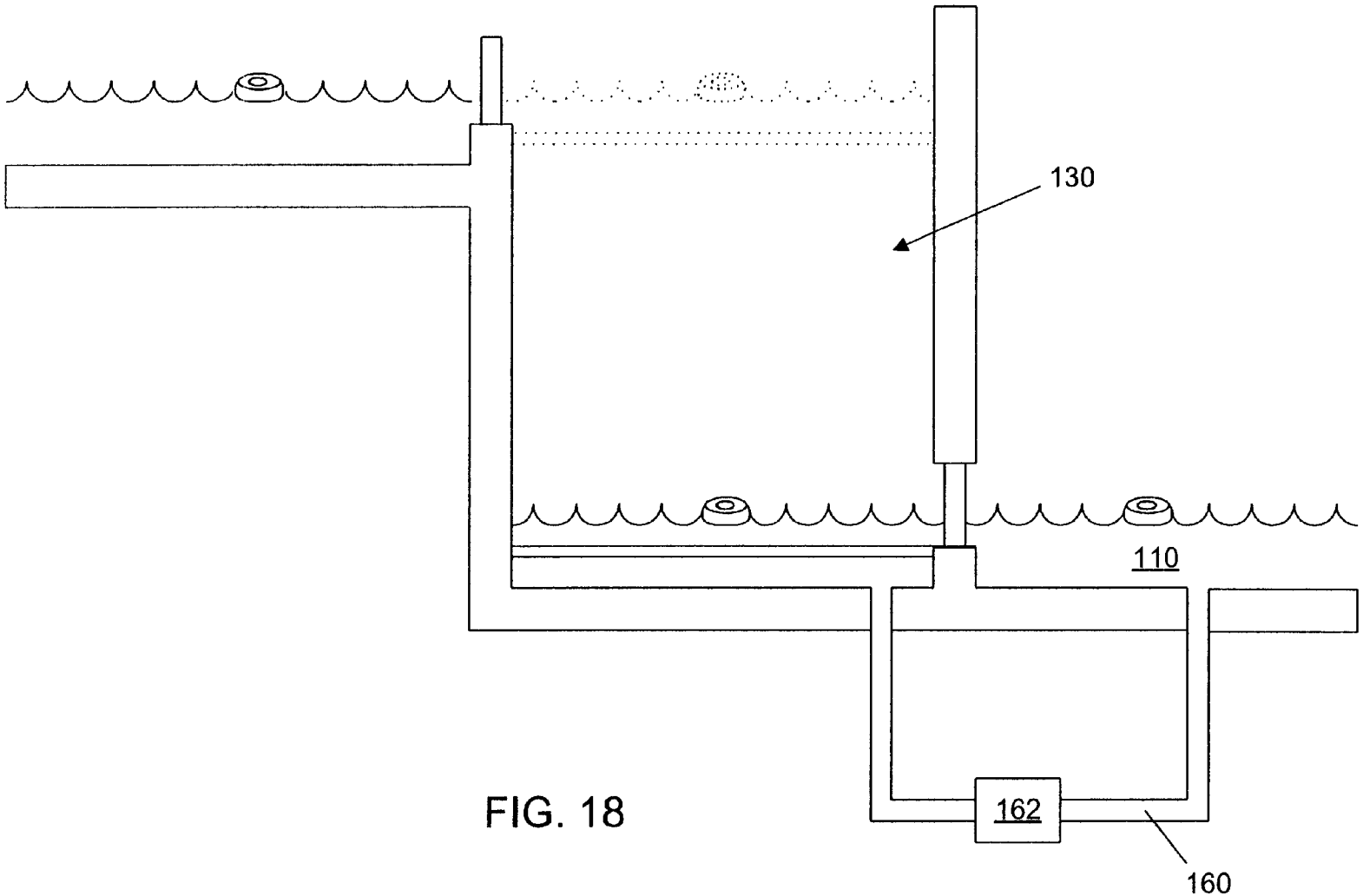
FIG. 18 depicts a cross sectional side view of a water lock system which includes one chamber and a conduit coupling a lower body of water to the chamber.

In another embodiment, depicted in FIG. 18, the lower body of water 110 may be used to supply water into the chamber. A conduit 160 may be coupled to chamber 130 such that water from lower body of water 110 may be introduced into chamber 130. A water control system 162 may be positioned along conduit 160. Water control system 162 may include a diverter valve and a pump (e.g., as depicted in FIG. 16). When chamber 130 is to be filled, the diverter valve of water control system 162 may be adjusted to allow water to be pulled through the pump and into chamber 130. The pump may fill chamber 130 with water by transferring water from lower body of water 110 to the chamber. To lower the water level in chamber 130, the diverter valve may be coupled to a bypass conduit (see FIG. 16). The water is then forced through the bypass conduit by the water pressure differential between the chamber water and the lower body of water, until the level of water in chamber 130 is substantially equal to the level of water in lower body of water 110.

Figure 19:
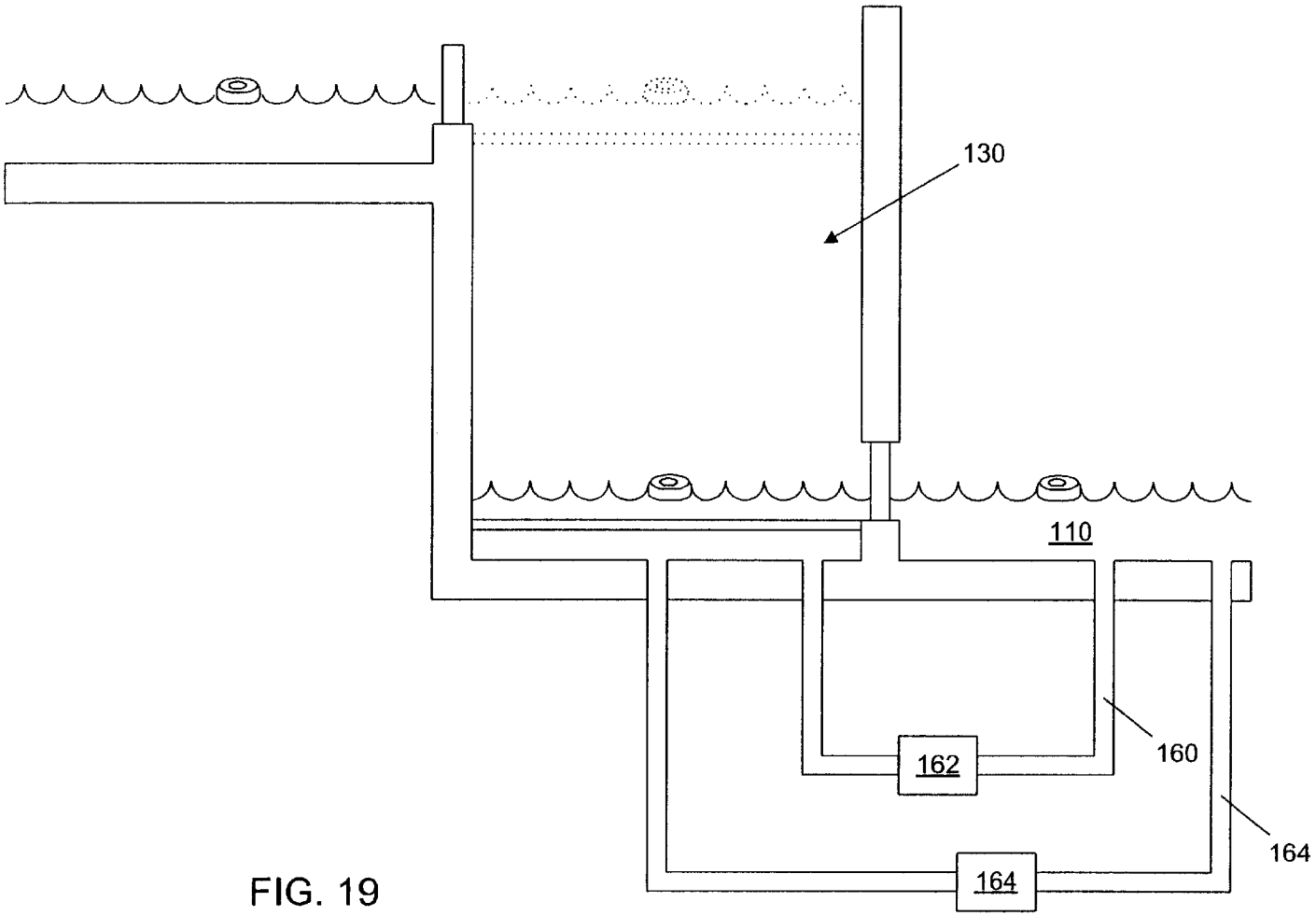
FIG. 19 depicts a cross sectional side view of a water lock system which includes one chamber and two conduits coupling a lower body of water to the chamber.

Alternatively, two conduits may be used to transfer the water between the chamber 130 and the lower body of water 110, as depicted in FIG. 19. A first conduit 160 may be coupled to lower body of water 110 and chamber 130. A first water control system 162 may be positioned along the first conduit 160. First water control system 162 may include a pump and a valve (e.g., as depicted in FIG. 16). A second conduit 164 may also be coupled to the lower body of water 110 and the chamber 130. A second water control system 166 may be positioned along the second conduit 164. Second water control system 166 may include a valve. To fill chamber 130, first water control system 162 may be adjusted to allow water to be pumped from lower body of water 110 into chamber 130, while second water control system 166 is in a closed position. To lower the water level in chamber 130, second water control system 166 may be opened, while closing first water control system 162, such that the water from chamber 130 is transferred to the lower body of water 110.

Figure 20:
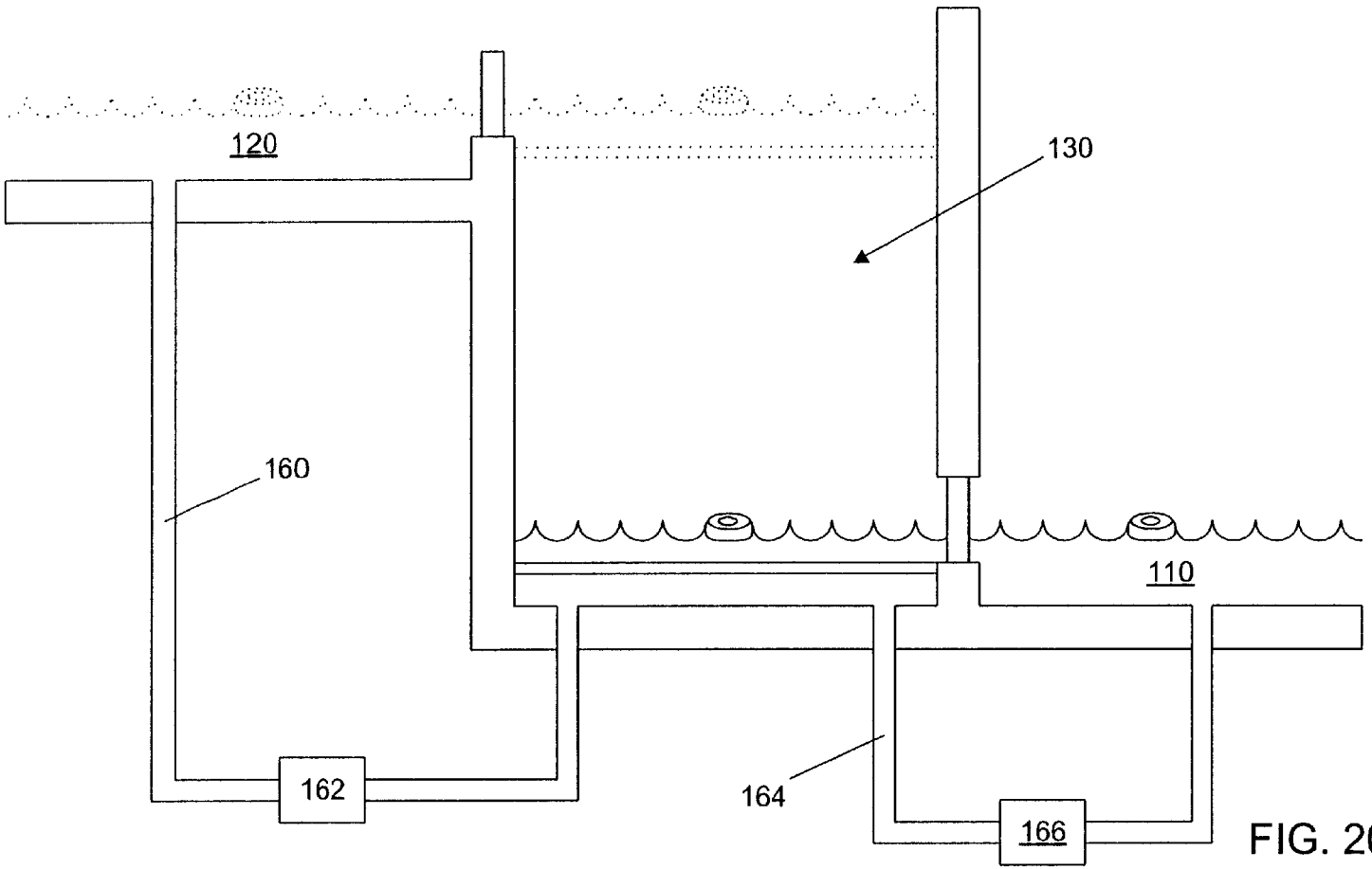
FIG. 20 depicts a cross sectional side view of a water lock system which includes a chamber, a first conduit coupling an upper body of water to the chamber, and a second conduit coupling a lower body of water to the chamber.

In another embodiment, two conduits may be used to fill and empty the chamber, as depicted in FIG. 20. A first conduit 160 may be coupled to upper body of water 120 and chamber 130. A second conduit 164 may be coupled to lower body of water 110 and chamber 130. A first water control system 162 may be positioned along first conduit 160. A second water control system 166 may be positioned along second conduit 164. First water control system 162 may be a valve or a valve/pump system (see FIG. 16). To fill chamber 130, first water control system 162 may be opened such that water flows from upper body of water 120 to chamber 130. Second water control system 166 may be adjusted such that water is inhibited from flowing from chamber 130 to lower body of water 110. In one embodiment, the water pressure differential between upper body of water 120 and the water in chamber 130 may be used to force water from the upper body of water into the chamber. When the level of the water in chamber 130 is substantially equal to the level of water in upper body of water 120, the water pressure differential will become nearly zero. Thus, the water may stop flowing into chamber 130 without having to close or adjust water control system 162. Alternatively, a pump may be incorporated into water control system 162 and water may be pumped from upper body of water 120 to chamber 130.

To empty chamber 130, first water control system 162 may be adjusted such that water flow from upper body of water 120 to the chamber is inhibited. Second water control system 166 may be adjusted so that water in chamber 130 now flows through second conduit 164 and into lower body of water 110. By relying on a water pressure differential, the water may automatically stop flowing into lower body of water 110 when the water level in chamber 130 is substantially equal to the water level in the lower body of water. Alternatively, water control system 166 may include a pump to increase the rate of water transfer from chamber 130 to lower body of water 110.

An advantage of using two conduits in this manner to transfer water to and from the chamber is that there may be no need to use water level monitoring devices. Since the flow of water will automatically stop when the water level is at the desired level, no water monitoring devices may be necessary. This may allow a much simpler system to be built. Such a system may include water control devices which are simply two way valves to allow or inhibit the flow of water thorough the conduits. Such a system may be easily run manually, semi-automatically, or automatically. Semi-automatically is defined to mean when a human operator informs the automatic control devices when to open/close the valves.

Figure 21:
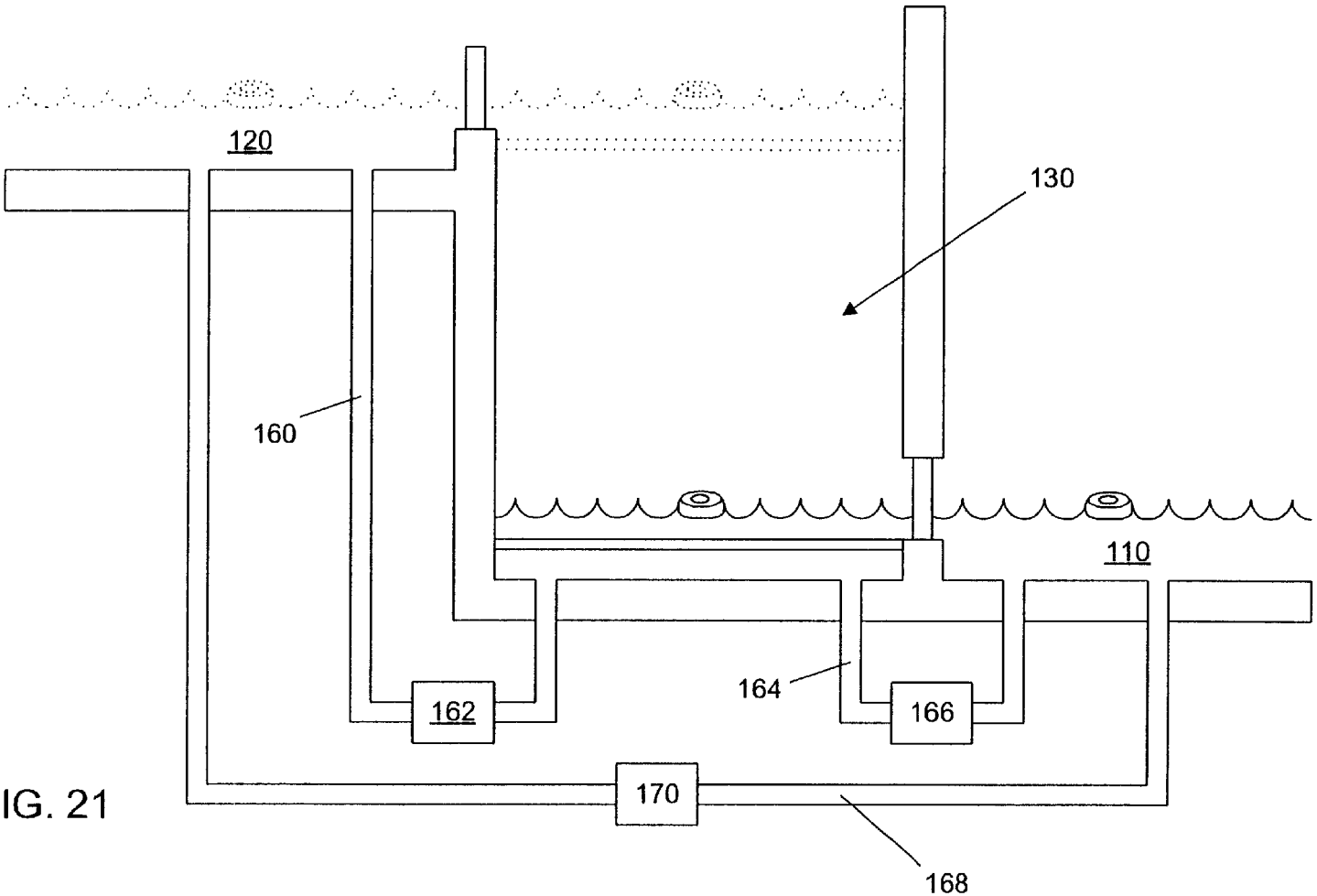
FIG. 21 depicts a cross sectional side view of a water lock system which includes a chamber, a first conduit coupling an upper body of water to the chamber, a second conduit coupling a lower body of water to the chamber, and a third conduit coupling the lower body of water to the upper body of water.

A disadvantage of this two conduit system is that water is being transferred from upper body of water 120 to lower body of water 110. After repeated cycles, the lower body of water may become overfilled with water while the upper body of water may become depleted of water. To prevent this from occurring a third conduit may be added to the system. As depicted in FIG. 21, a lock system may include a first conduit 160 for transferring water from an upper body of water 120 to a chamber 130, a second conduit 164 for transferring water from the chamber to a lower body of water 110, and a third conduit 168 for transferring water from the lower body of water to the upper body of water. The first, second and third conduits may include first, second, and third water control systems 162, 166, and 170. First and second water control systems may be similar in function to the water control systems described above. Third water control system 170 may include a pump for pumping water from lower body of water 110 to upper body of water 120. During use first conduit 160 may be used to transfer water from upper body of water 120 to chamber 130. To lower the level of the water in chamber 130, water may be transferred from chamber 130 to lower body of water 110 via second conduit 164. As described above, such a system may alter the level of water in the two bodies of water after repeated cycles. Once this situation occurs, the third conduit may be used to transfer water from lower body of water 110 to upper body of water 120. The transfer of water from the lower to the upper body of water may occur at anytime during the cycle. In one embodiment, the transfer occurs as the water from chamber 130 is being transferred to lower body of water 110. Thus, the level of water in both the upper and lower bodies of water may remain substantially constant over repeated cycles of the lock system.

The lock systems described above may be used to transfer participants from a lower body of water to an upper body of water while the participants remain in the water. The participants may be swimming in the water or may be floating upon the surface of the water with a flotation device. Examples of flotation devices include, but are not limited to inner tubes, floating boards, life jackets, life preservers, water mattresses, rafts and small boats.

Figure 22:
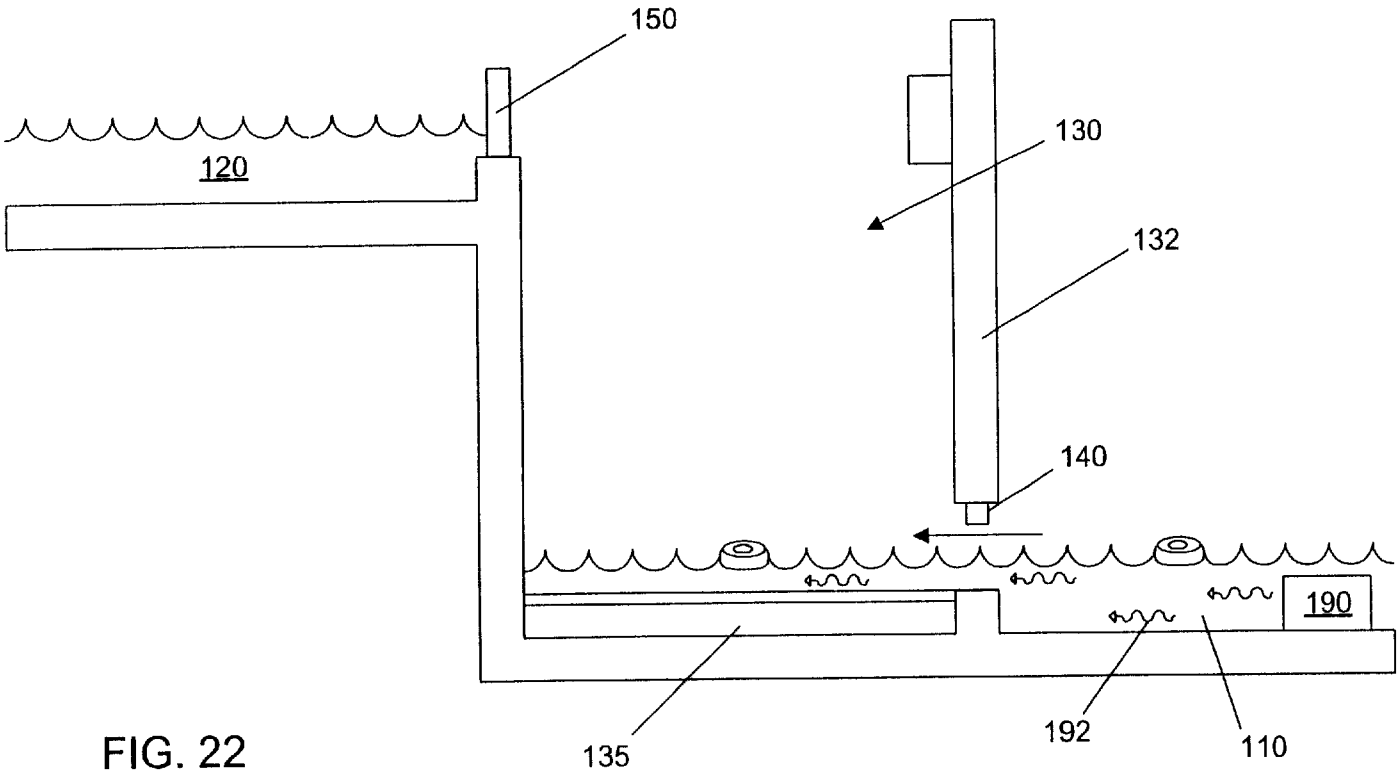
FIG. 22 depicts a cross sectional side view of a water lock system in which participants are being transferred from a lower body of water to a chamber.

As depicted in FIG. 22, a lock system, in one embodiment, includes a chamber 130 which is coupled to a lower body of water 110 and an upper body of water 120. The level of water in chamber 130 is initially set to be substantially equal to the level of water in lower body of water 110. A first movable member 140 may be positioned in outer wall 132 of chamber 130 proximate the upper surface of water in the lower body of water. First movable member 140 is initially in an open position to allow participants to move from lower body of water 110 into chamber 130. The participants may swim or propel their flotation device into chamber 130 via first movable member. In another embodiment, a water propulsion system 190 may be set up within lower body of water 110 to cause a current (denoted by the curved lines 192) to be produced. The current may propel the participants toward movable member 140 from lower body of water 110.

Figure 23:
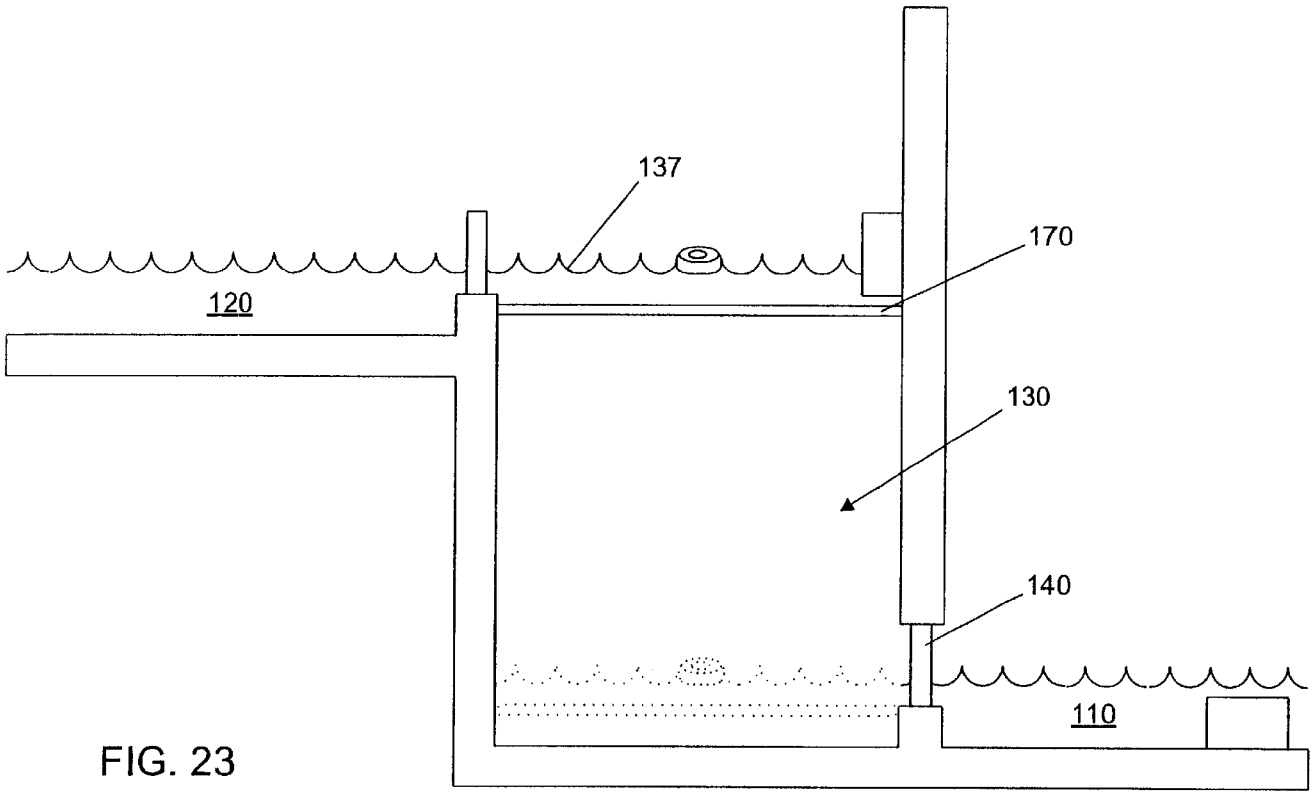
FIG. 23 depicts a cross sectional side view of a water lock system in which the chamber is filled with water.

After the participants have entered chamber 130, first movable member 140 may be closed, as depicted in FIG. 23 Water may be transferred from a water source into chamber 130 causing the water level within the chamber to rise. The water source may be lower body of water 110, upper body of water 120, and/or an alternate water supply source (e.g., a nearby water reservoir, river, lake, ocean, etc.). The water, in one embodiment, may be transferred into chamber 130 until the upper surface 137 of the water in the chamber is substantially equal to the upper surface of the water in upper body of water 120. Thus, the participants may be raised from a lower level to an upper level as water is transferred into the chamber. A bottom member 170, as described above, may also be raised as the water enters the chamber.

Figure 24:
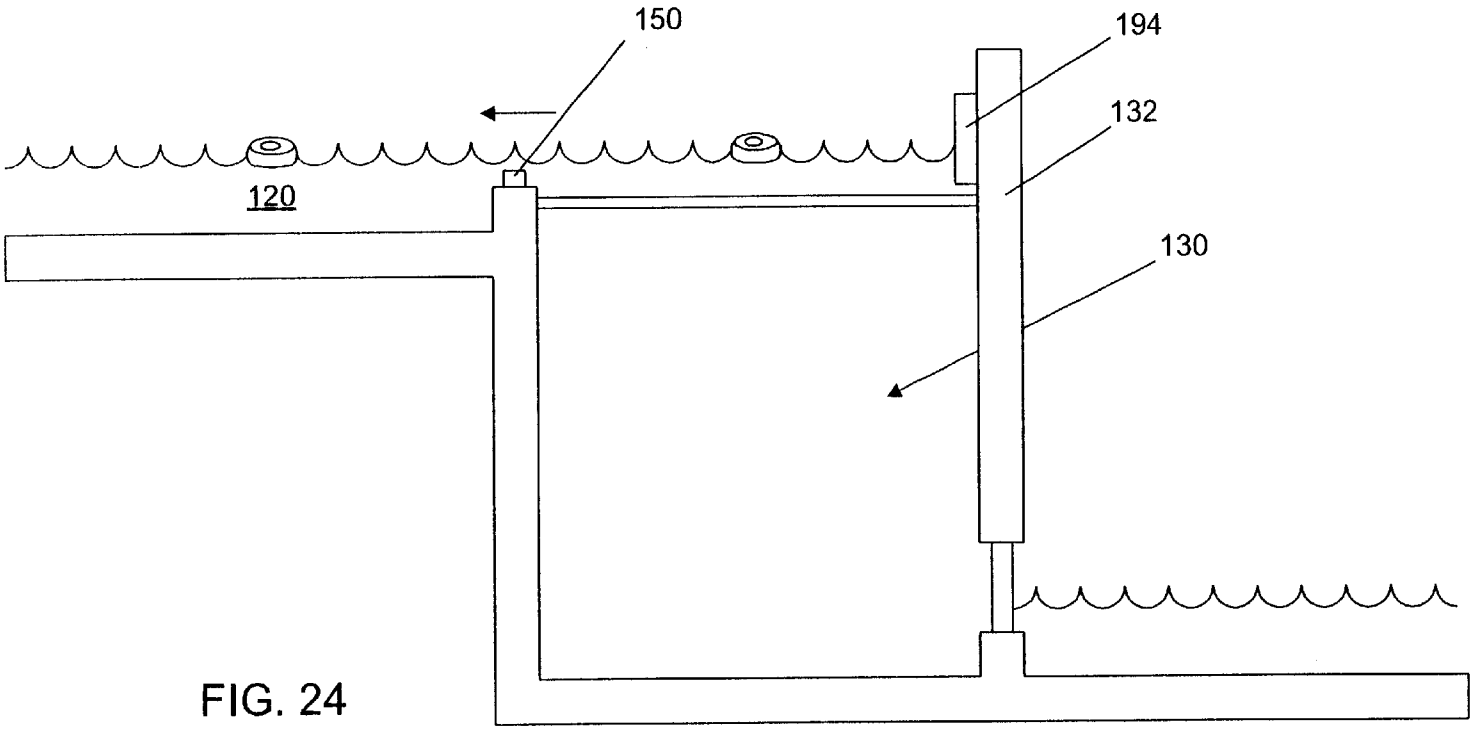
FIG. 24 depicts a cross sectional side view of a water lock system in which participants are being transferred from the chamber to an upper body of water.

After the water in the chamber has reached a level substantially equal to the level of water in upper body of water 120, the second movable member 150 may be opened as depicted in FIG. 24. Participants may then move from chamber 120 into upper body of water 130. The participants may move using their own power or be propelled by a water propulsion system 194 incorporated on outer wall 132.

In another embodiment, a current may be generated by continuing to fill chamber 130 with water after the level of water in the chamber is substantially equal to the level of water in upper body of water 120. In an embodiment, second movable member 150 is opened when the level of water between the chamber 130 and the upper body of water 120 are substantially equal. Additional water may be introduced into the chamber 130 such that the level of water in the chamber begins to rise above the level of water in the upper body of water 120. As the water is pumped into the chamber 120, the resulting increase in water volume may cause a water current to be formed flowing from the chamber to the upper body of water. The formed current may be used to propel the participants from the chamber to the upper body of water.

Overall, the participants may be moved from lower body of water 110 to upper body of water 120 while remaining in water during the entire transfer period. An advantage of this method of transfer is that the participants do not have to leave the water, thus allowing the participants to remain cool on hot days. The participants will no longer have to carry their flotation devices. Inner tubes and boards may be difficult for some younger riders to carry. By transferring people with a lock system, the need to carry flotation devices to the start of a water ride may be eliminated.

After the participants have been transferred to the upper body of water, the water level may be lowered by removing water from the chamber. The water may be removed until the water level is substantially equal to the water in the lower body of water. The first movable member may then be reopened to allow more participants to be transferred to the upper body of water. It should be understood that after a group of participants have been transferred to the upper body of water, another group may enter the lock system and be transferred to the lower body as the water within the chamber is lowered. It should also be understood that any of the previously described embodiments of the water lock system may be used to transfer participants between any number of bodies of water having different elevations.

Figure 25:
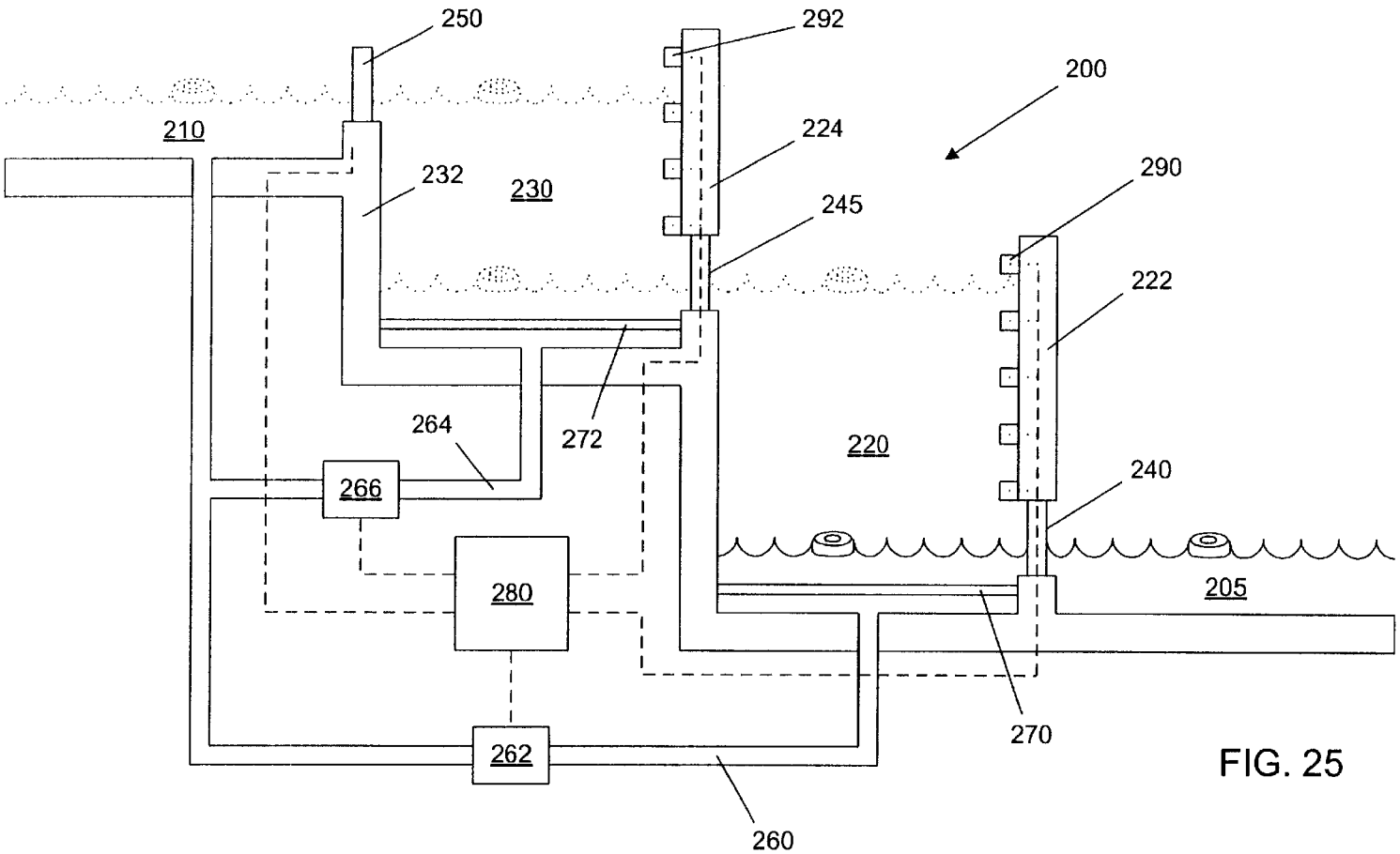
FIG. 25 depicts a cross sectional side view of a water lock system which includes two chambers, a first conduit coupling an upper body of water to the first chamber, and a second conduit coupling the upper body of water to the second chamber.

In another embodiment, multiple chambers may be linked together to transfer participants from a lower body of water to an upper body of water. FIG. 25 depicts a water lock system 200 that, in one embodiment, includes two chambers for transferring participants from a lower body of water 205 to an upper body of water 210. It should be understood that while only two chambers are depicted, additional chambers may be positioned between the bodies of water and the following description would be applicable to such systems. A first chamber 220 may be coupled to lower body of water 205. A portion of first chamber 220 may extend below the upper surface of lower body of water 205. A second chamber 230 may be coupled to first chamber 220 and upper body of water 210. A portion of outer wall 222 of first chamber 220 may also form a portion of the outer wall of second chamber 230. Bottom members 270 and 272, as previously described, may be positioned within the first and second chambers respectively.

A first movable member 240 may be formed adjacent to lower body of water 205. First movable member 240 may extend from a position below the upper surface of lower body of water 205 to a point above the upper surface of the lower body of water. First movable member 240 may extend over the entire vertical length of the outer wall 222 of first chamber 220. In one embodiment, first movable member 240 is formed in a portion of outer wall 222 that is substantially shorter than the vertical length of the outer wall. The first movable member may be a swinging movable member or a sliding movable member as previously described.

A second movable member 245 may be formed in outer wall 224 of first chamber 220 adjacent to second chamber 230. Second movable member 220 may extend from a point above the bottom member of second chamber 230 toward the top of first chamber wall 224. Second movable member 245 may be positioned to allow participants to enter second chamber 230 from first chamber 220, while the water level is elevated within the first chamber. Second movable member 245 may be a swinging movable member or a sliding movable member as previously described.

A third movable member 250 may be formed adjacent upper body of water 210. Third movable member 250 may extend from a position below the upper surface of upper body of water 210 to a point above the upper surface. Third movable member 250 may be formed in a portion of outer wall 232 which is substantially shorter then the vertical length of the wall. Third movable member 250 may be formed at a position in outer wall 232 such that participants may move from second chamber 230 to upper body of water 210 when the water within the second chamber is substantially level with the water in the upper body of water. Third movable member 250 may extend to a depth below the upper surface of upper body of water 210 to allow participants to easily enter the upper body of water without contacting the lower surface of the third movable member.

Conduits 260 and 262 may be positioned to introduce water into first chamber 220 and second chamber 230, respectively. Water control systems 262 and 266 may be positioned along conduits 260 and 264, respectively, to control flow of water through the conduits. Water control systems 262 and 266 may include a valve which is configured to control the flow of water from a pressurized water source to the chamber. Water control systems 262 and 266 may also include a pump for increasing the flow rate of water through the conduits.

An automatic controller 280 may be coupled to the lock system. The controller may be a computer, programmable logic controller, or any other known controller system. The controller may be coupled to water control systems 262 and 266 and movable members 240, 245, and 250. The operation of the movable members and the water control systems may be coordinated by the controller such that the proper timing of events occurs. Sensors 290 and 292 may be positioned on the inner surface of the first chamber 220 and the second chamber 230, respectively, to relay the level of water within the chambers back to control system 280.

In one embodiment, first conduit 260 and second conduit 264 may be coupled to upper body of water 210. The first and second conduits, 260 and 264 may be configured to allow water from upper body of water 210 to be transferred to first chamber 220 and second chamber 230 respectively. First water control system 262 may be used to control the transfer of water from upper body of water 210 to first chamber 220. Second water control system 266 may be used to control flow of water from upper body of water 210 to second chamber 230. The water control systems 262 and 266 may include a pump, a valve and a bypass conduit, as depicted in FIG. 16. The operation of this type of water control system has been previously described.

To lower the water level in either of the chambers, the water control systems 262 and 266 may include a pump for pumping water from the first chamber 220 and the second chamber 230 respectively. The water may be pumped from the chambers back to upper body of water 210 during use. In this manner, each of conduits 260 and 264 may allow the water to be transferred from upper body of water 210 to the chambers 220 and 230, respectively, and from the chambers back to the upper body of water. An advantage of these embodiments is that the water level in both the upper and lower bodies of water remains substantially constant over multiple cycles of the water lock system.

Figure 26:
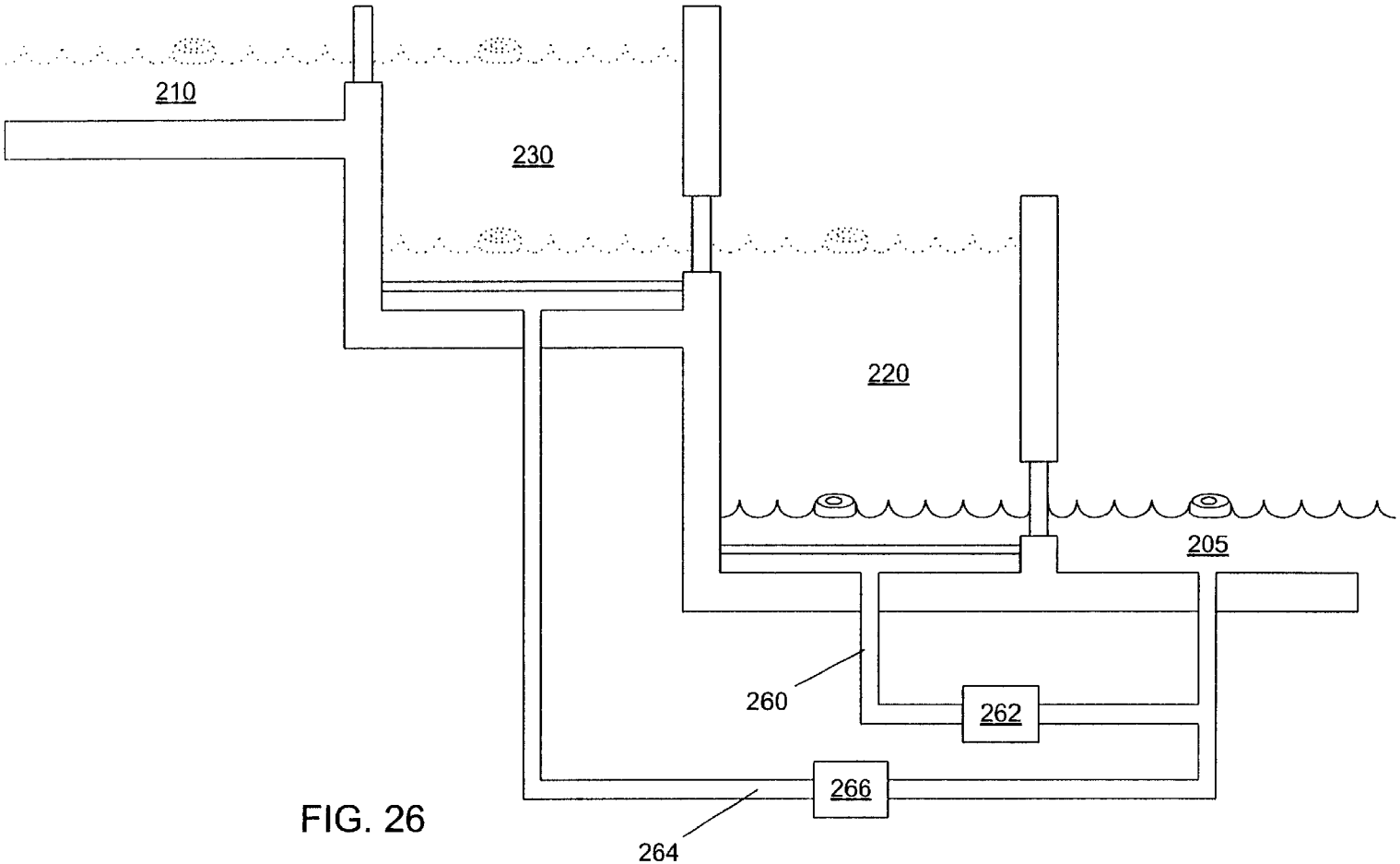
FIG. 26 depicts a cross sectional side view of a water lock system which includes two chambers, a first conduit coupling a lower body of water to the first chamber, and a second conduit coupling the lower body of water to the second chamber.

In another embodiment, depicted in FIG. 26, lower body of water 205 may be used to supply water into the first and second chambers 220 and 230. The first conduit 260 and second conduit 264 may be coupled to chambers 220 and 230 such that water from lower body of water 205 may be introduced into the chambers. Water control systems 262 and 266 (e.g., as depicted in FIG. 16), are positioned along conduits 260 and 264, respectively. Each of water control systems 262 and 266 may include a pump. When a chamber is to be filled, the appropriate water control system may direct water from lower body of water 210 to a pump. The pump may fill the chamber with water by pumping water from lower body of water 210 to the chamber. To lower the water level in a chamber, the water control system may be adjusted to allow water to flow back into the lower body of water.

Figure 27:
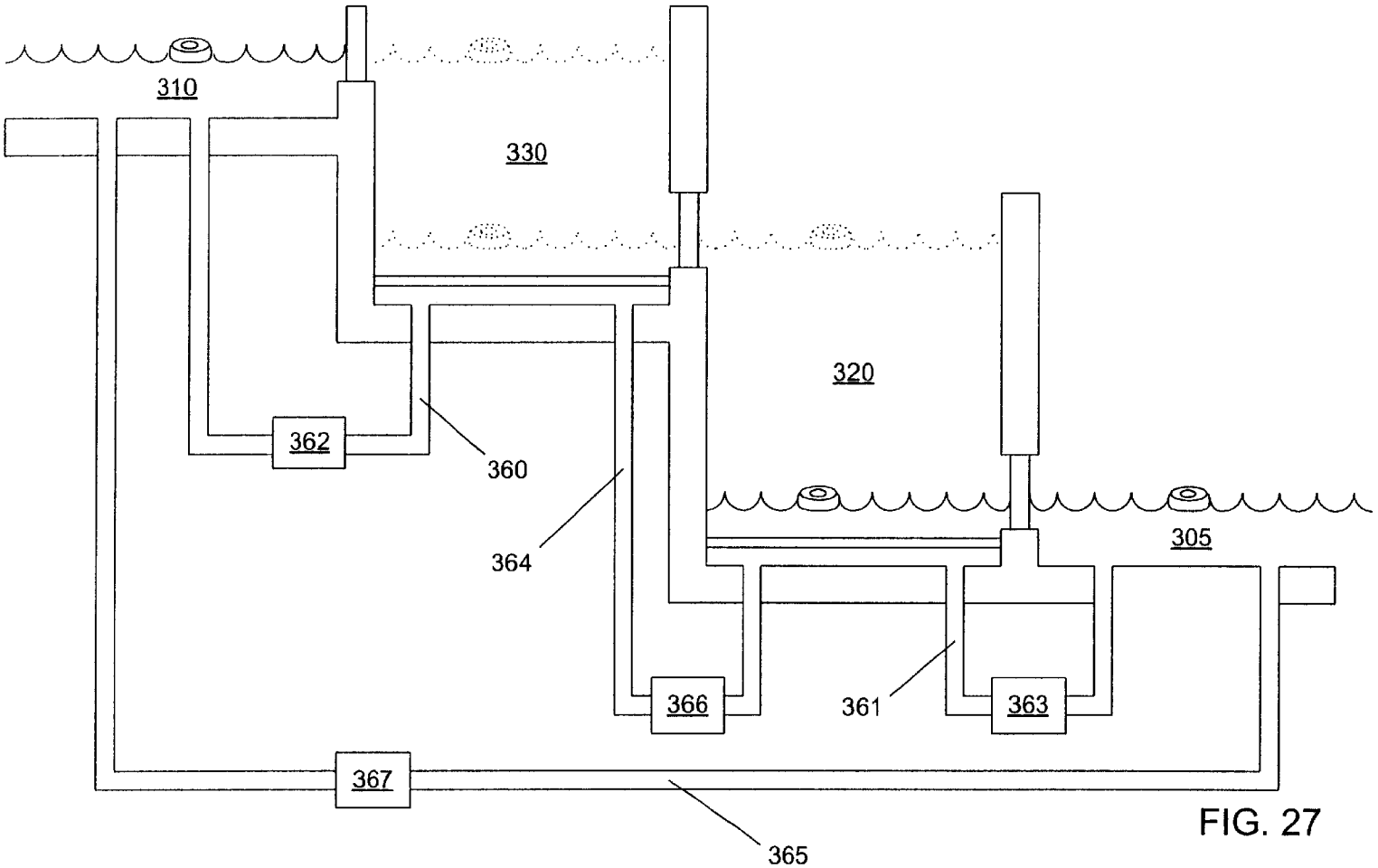
FIG. 27 depicts a cross sectional side view of a water lock system which includes two chambers, a first conduit coupling an upper body of water to the second chamber, a second conduit coupling the second chamber to the first chamber, a third conduit coupling the second chamber to a lower body of water, and a fourth conduit coupling the lower body of water to the upper body of water.

In another embodiment, three conduits may be used to transfer water between the upper body of water 310, the chambers 320 and 330, and the lower body of water 305, as depicted in FIG. 27. A first conduit 364 may be coupled to first chamber 320 and second chamber 330. A first water control system 366 may be positioned along first conduit 364. First conduit 364 may be configured to transfer water from second chamber 330 to first chamber 320. A second conduit 360 may be coupled to upper body of water 310 and second chamber 330. Second conduit 360 may include a second water control system 362. Second conduit 360 may be configured to transfer water from upper body of water 310 to second chamber 330. A third conduit 361 may be coupled to first chamber 320 and lower body of water 305. Third conduit 361 may include a third water control system 363. Third conduit 361 may be configured to transfer water from first chamber 320 to lower body of water 305. The first, second, and thirds water control systems may include a valve or a pump/valve system (e.g., the system of FIG. 16).

As noted before, a disadvantage of this type of lock system is that water is being transferred from the upper body of water to the lower body of water. After repeated cycles the lower body of water may become overfilled while the upper body of water may become depleted. In an embodiment, a fourth conduit may be added to the system to transfer water from the lower body of water back to the upper body of water. Fourth conduit 365 may include a fourth water control system 367. Fourth water control system 367 may include a pump for pumping water from lower body of water 305 to upper body of water 310. The transfer of water from lower body of water 305 to upper body of water 310 may occur at anytime during the cycle. The transfer of water from the lower body of water to the upper body of water may occur as water from first chamber 320 is being transferred to lower body of water 305. Thus, the level of water in both the upper and lower bodies of water may remain substantially constant over repeated cycles of the lock system.

Figure 28:
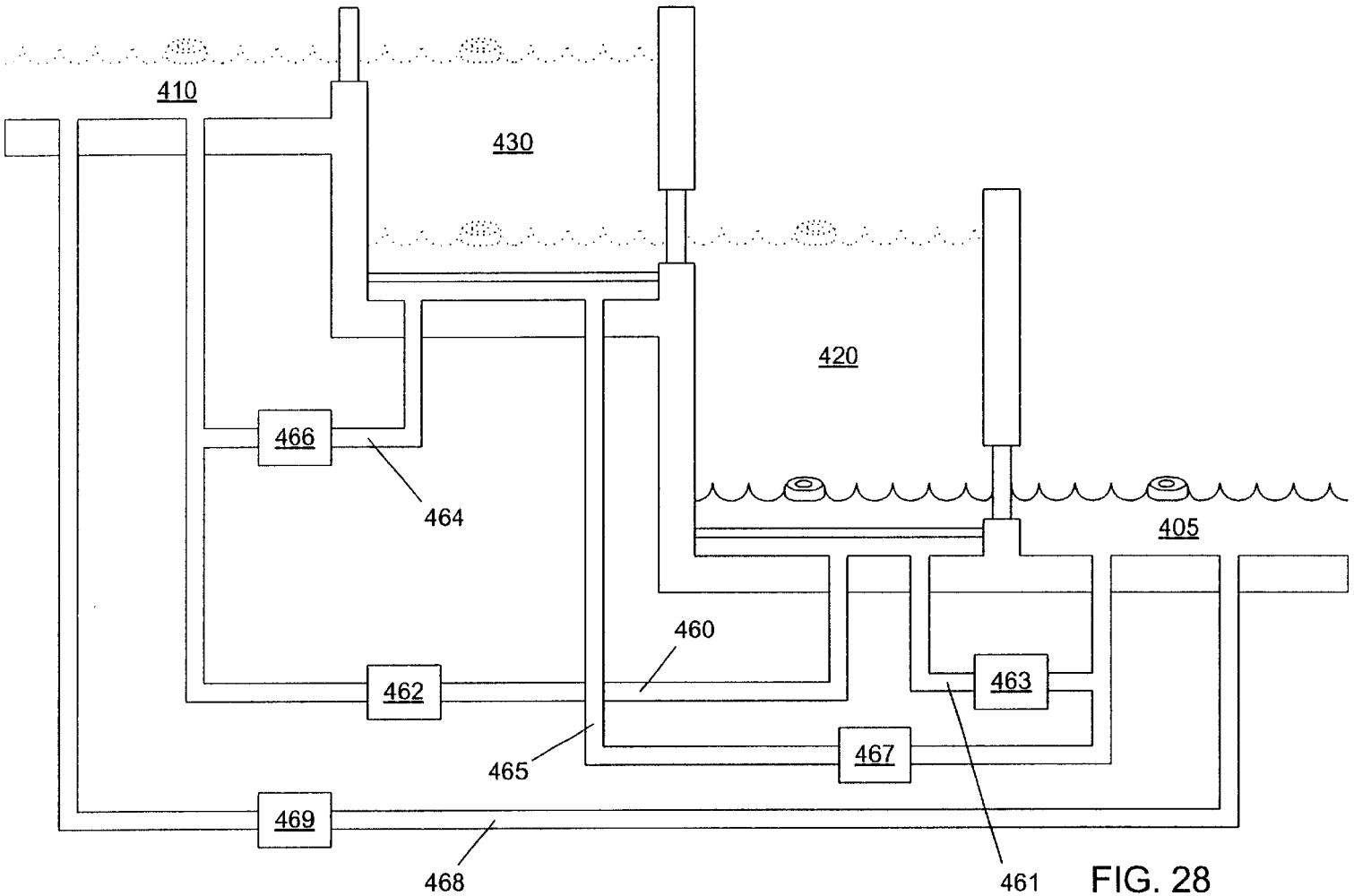
FIG. 28 depicts a cross sectional side view of a water lock system which includes two chambers, a first conduit coupling an upper body of water to the first chamber, a second conduit coupling the upper body of water to the second chamber, a third conduit coupling a lower body of water to the first chamber, a fourth conduit coupling a lower body of water to the second chamber, and a fifth conduit coupling the lower body of water to the upper body of water.

In another embodiment, four conduits may be used to fill and empty the chambers, as depicted in FIG. 28. A first conduit 460 may be coupled to upper body of water 410 and to first chamber 420. A second conduit 464 may be coupled to upper body of water 410 and second chamber 430. The first and second conduits may be configured to allow transfer of water from upper body of water 410 to the first and second chambers, respectively. First and second water control system 462 and 466 may be positioned along the first and second conduits, respectively. A third conduit 461 may be coupled to first chamber 420 and lower body of water 405. A fourth conduit 465 may be coupled to lower body of water 405 and second chamber 430. The third and fourth conduits may be configured to allow the transfer of water from the first and second chambers respectively to the lower body of water. Third and fourth water control systems 463 and 467 may be positioned along the third and fourth conduits respectively. The water control systems may include a valve or a valve/pump system (e.g., as depicted in FIG. 16). An advantage of this type of system is that the first and second chambers may be independently emptied or filled.

A fifth conduit 468 may be added to the system. Fifth conduit 468 may include a fifth water control system 469. Fifth water control system 469 may include a pump for pumping water from lower body of water 405 to upper body of water 410. The transfer of water from lower body of water 405 to upper body of water 410 may occur at anytime during the cycle. The transfer of water from the lower body of water to the upper body of water may occur as water from first chamber 420 is being transferred to lower body of water 405. Thus, the level of water in both the upper and lower bodies of water may remain substantially constant over repeated cycles of the lock system.

The multiple lock systems described above may be used to transfer participants from a lower body of water to an upper body of water in stages while the participants remain in the water. The participants may be swimming in the water or may be floating upon the surface of the water with a flotation device. Examples of flotation devices include, but are not limited to inner tubes, floating boards, life jackets, life preservers, and air mattresses and small boats. By using multiple chambers, a series of smaller chambers may be built rather than a single large chamber. For example, if an elevation change of 100 feet is required a single 100 foot chamber may be built or four coupled 25 foot chambers may be built. In some situations it may be easier to build a series of chambers rather than a single chamber. For example, use of a series of smaller chambers may better match the slope of an existing hill than a large single chamber. Additionally, the chambers may be formed independently of each other. For example, a series of chambers may be used, with a channel or canal connecting each of the chambers, rather than the chambers being integrally formed as depicted in the embodiments above.

Figure 29:
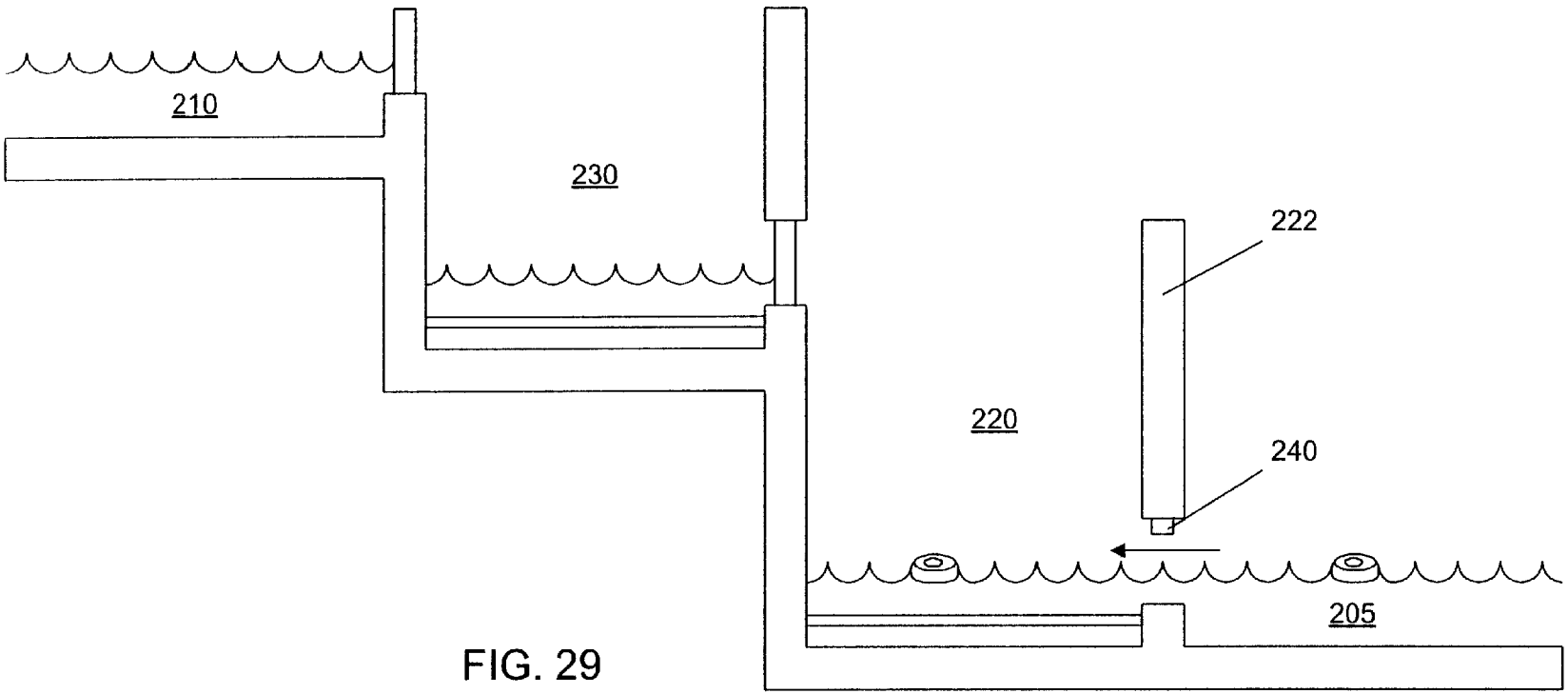
FIG. 29 depicts a cross sectional side view of a water lock system in which participants are being transferred from a lower body of water to a first chamber.

A method of using a multiple chamber system is described below. As depicted in FIG. 29, a lock system may include a first chamber 220 which is coupled to a lower body of water 205 and a second chamber 230 coupled to the first chamber and an upper body of water 210. While only two chambers are shown it should be understood that additional chambers may be positioned between the first and second chambers and that the below described method would be applicable to such multiple chamber systems. The level of water in first chamber 220 may be initially set to be substantially equal to the level of water in lower body of water 205. A first movable member 240 may be formed in outer wall 222 of first chamber 220 proximate the upper surface of lower body of water 205. First movable member 240 may, initially, be in an open position to allow participants to move from lower body of water 205 into the first chamber. The participants may swim or propel their flotation device into the chamber via the first movable member. Alternatively, a water current, as previously described, may be produced to push the participants toward the first chamber from the lower body of water.

Figure 30:
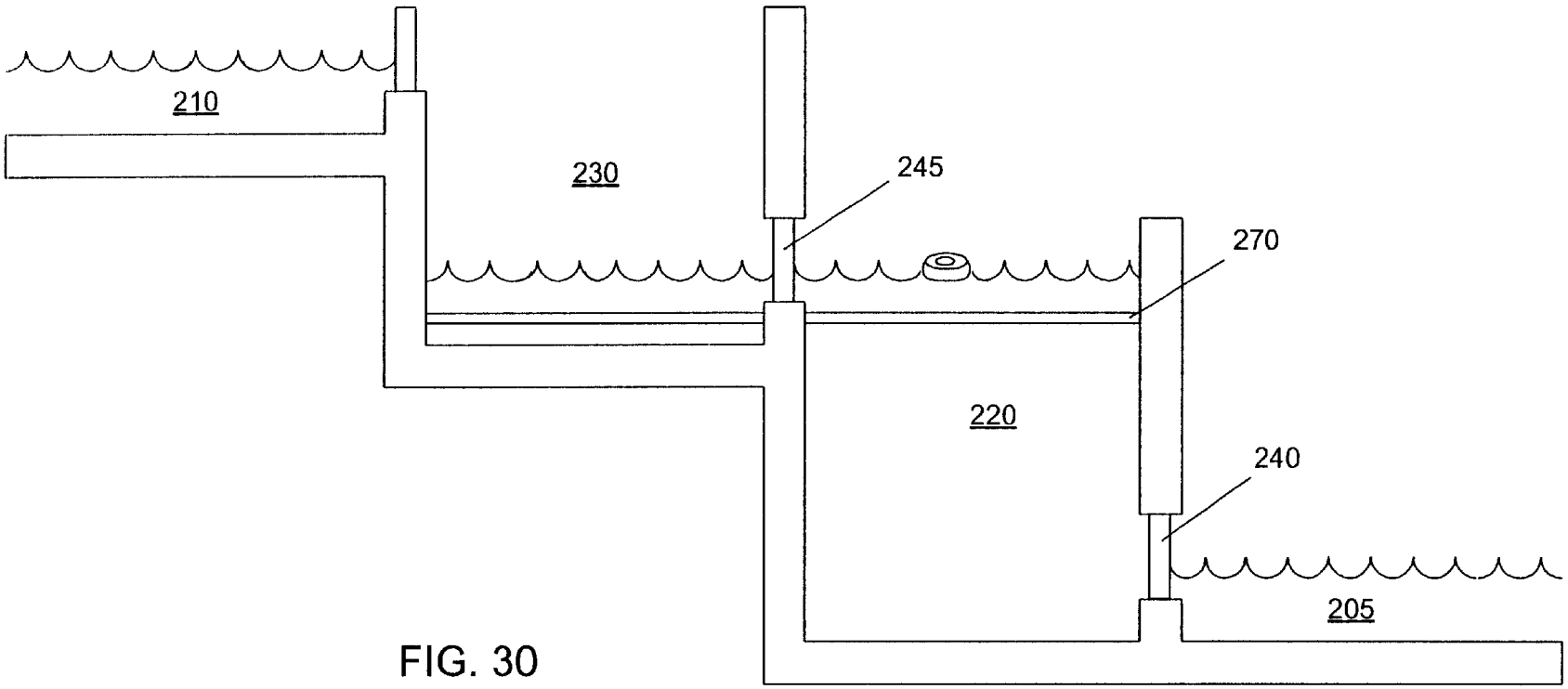
FIG. 30 depicts a cross sectional side view of a water lock system in which the first chamber is filled with water.

After the participants have entered first chamber 220, first movable member 240 may be closed, as depicted in FIG. 30. Water may be transferred from a water source into first chamber 220 causing the water level within the first chamber to rise. The water source may be the lower body of water, the upper body of water, and/or an alternate water supply source (e.g., a nearby water reservoir, river, lake, ocean, etc.). The water may be transferred into first chamber 220 until the water level in the chamber is substantially equal to the level of water in second chamber 230. Second movable member 245 may be positioned at a level above the bottom of second chamber 230. Second chamber 230 may be filled with water to a level equal to a portion of second movable member 245. Thus, the participants may be raised from lower body of water 205 to an intermediate level as water is transferred into the first chamber. A bottom member 270, as described above, may also be raised as the water enters the chamber.

Figure 31:
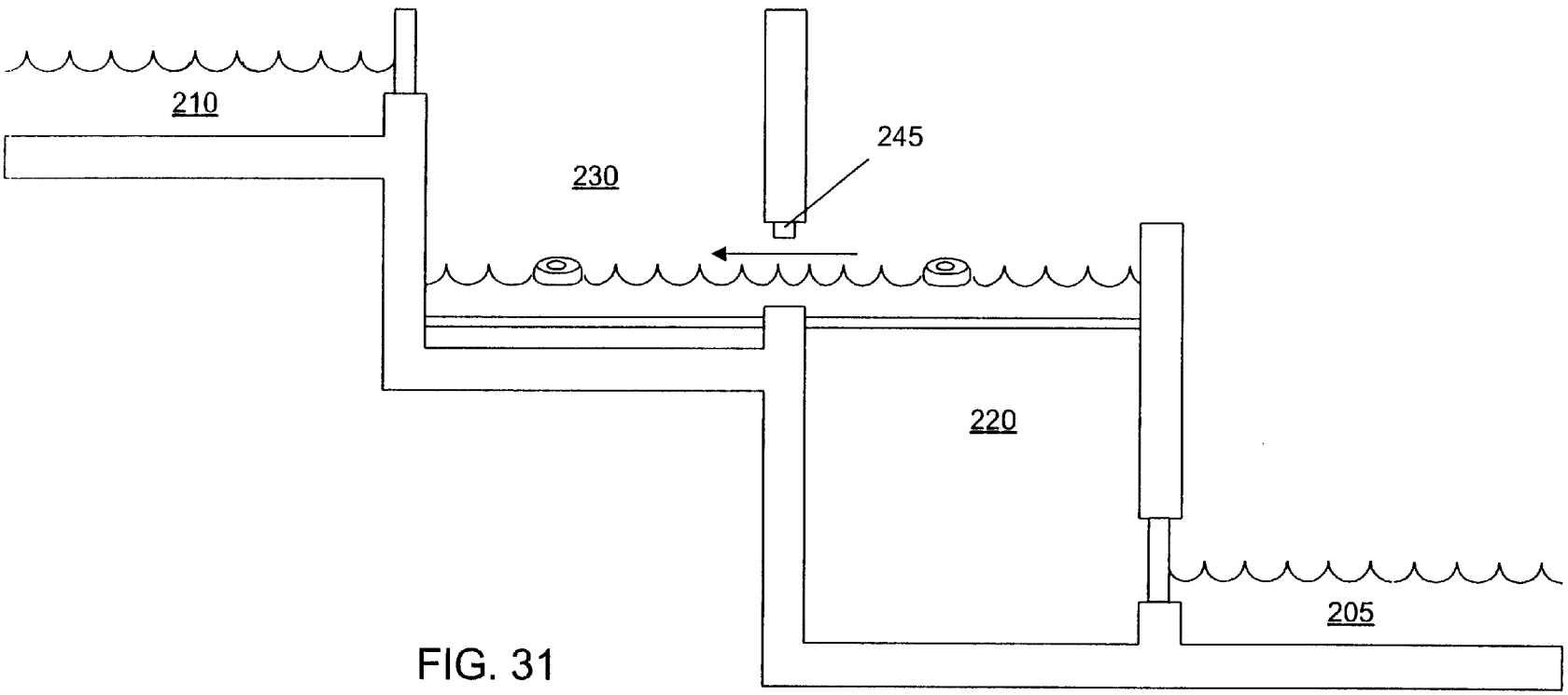
FIG. 31 depicts a cross sectional side view of a water lock system in which participants are being transferred from the first chamber to a second chamber.

After the water in first chamber 220 has reached a level substantially equal to the water in second chamber 230, second movable member 245 may be opened as depicted in FIG. 31. Participants may move from first chamber 220 into second chamber 230. The participants may move into second chamber 230 using their own power or be propelled by a water current.

Figure 32:
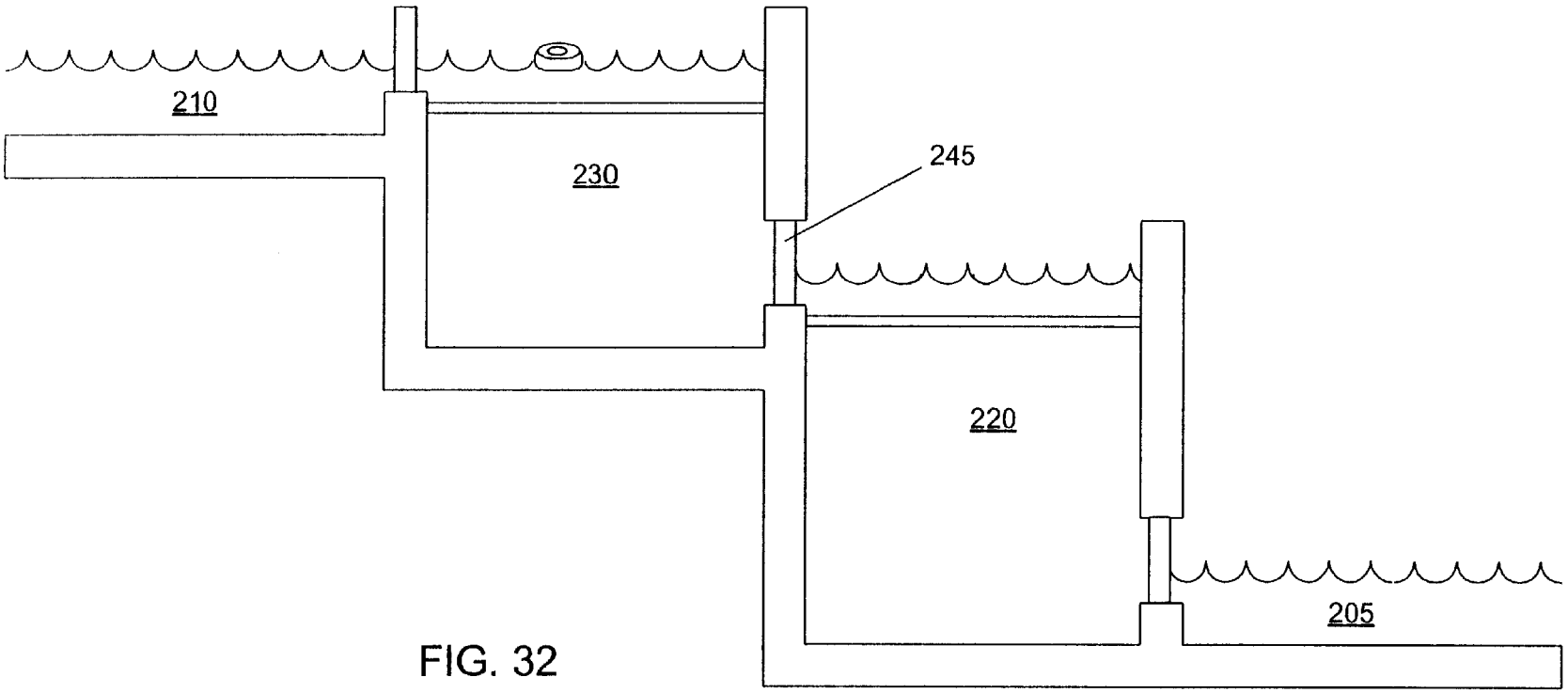
FIG. 32 depicts a cross sectional side view of a water lock system in which the second chamber is filled with water.

After the participants have entered second chamber 230, second movable member 245 may be closed, as depicted in FIG. 32. Water may be transferred from a water source into second chamber 230 causing the water level within the second chamber to rise. The water may be transferred into the chamber until the water level in second chamber 230 is substantially equal to the level of water in upper body of water 210. Thus, the participants may be further raised from an intermediate level to upper body of water 210 as water is transferred into second chamber 230. A bottom member 272, as described above, may also be raised as the water enters the second chamber.

Figure 33:
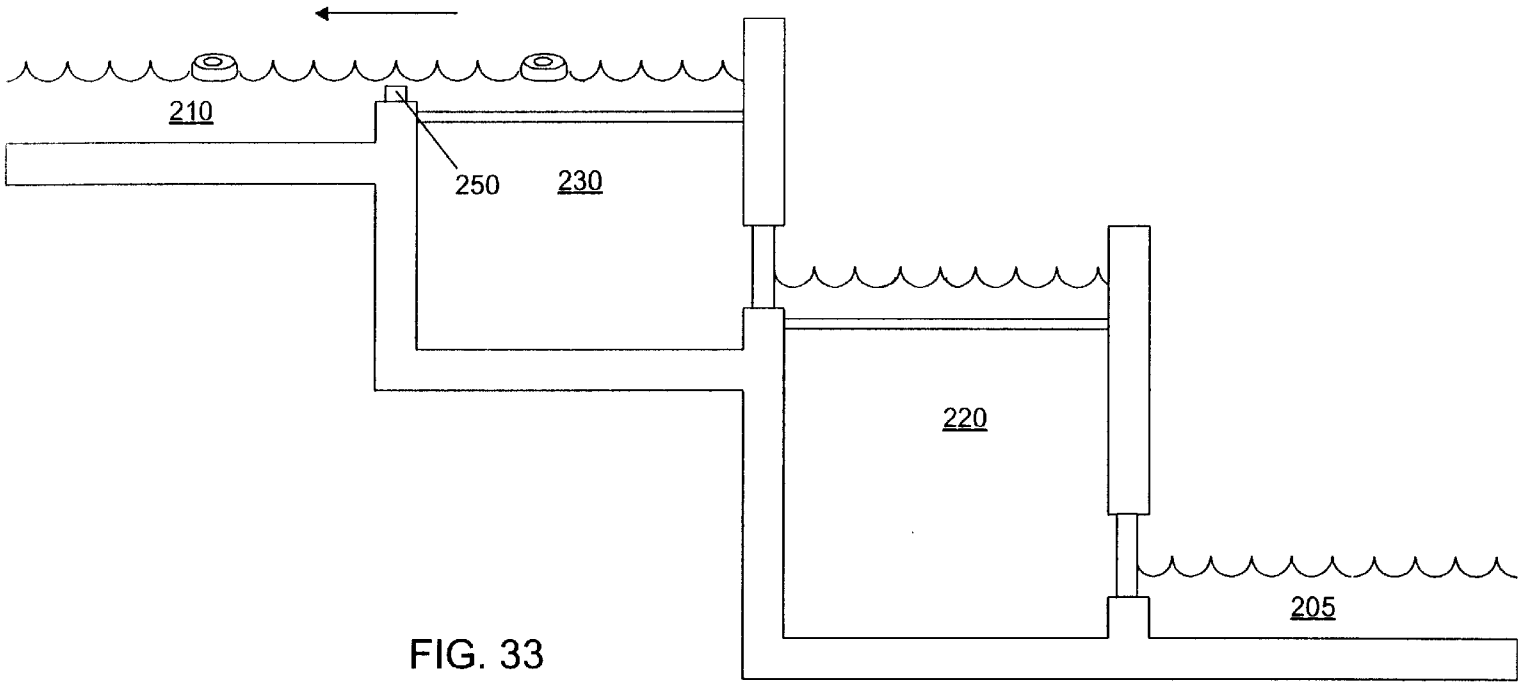
FIG. 33 depicts a cross sectional side view of a water lock system in which participants are being transferred from the second chamber to the upper body of water.

After the water in second chamber 230 has reached a level substantially equal to the water in upper body of water 210, third movable member 250 may be opened as depicted in FIG. 33. Participants may then move from second chamber 230 into upper body of water 210. The participants may move using their own power or be propelled by a water current into upper body of water 210. Overall, the participants may be moved from a lower body of water to an upper body of water while remaining in water during the entire transfer period.

After the participants are transferred to upper body of water 210, the water level in the both chambers may be lowered. In one embodiment, the water in both chambers may be lowered at the same time. This allows both chambers to be reset to the original starting water levels (e.g., as depicted in FIG. 29). The water within first chamber 220 may be set at a level about equal to lower body of water 205. The water within second chamber 230 may be set at a level proximate second movable member 245. After the water level is reduced, first movable member 240 may be reopened to allow more participants to be transferred into the lock system.

Figure 34:
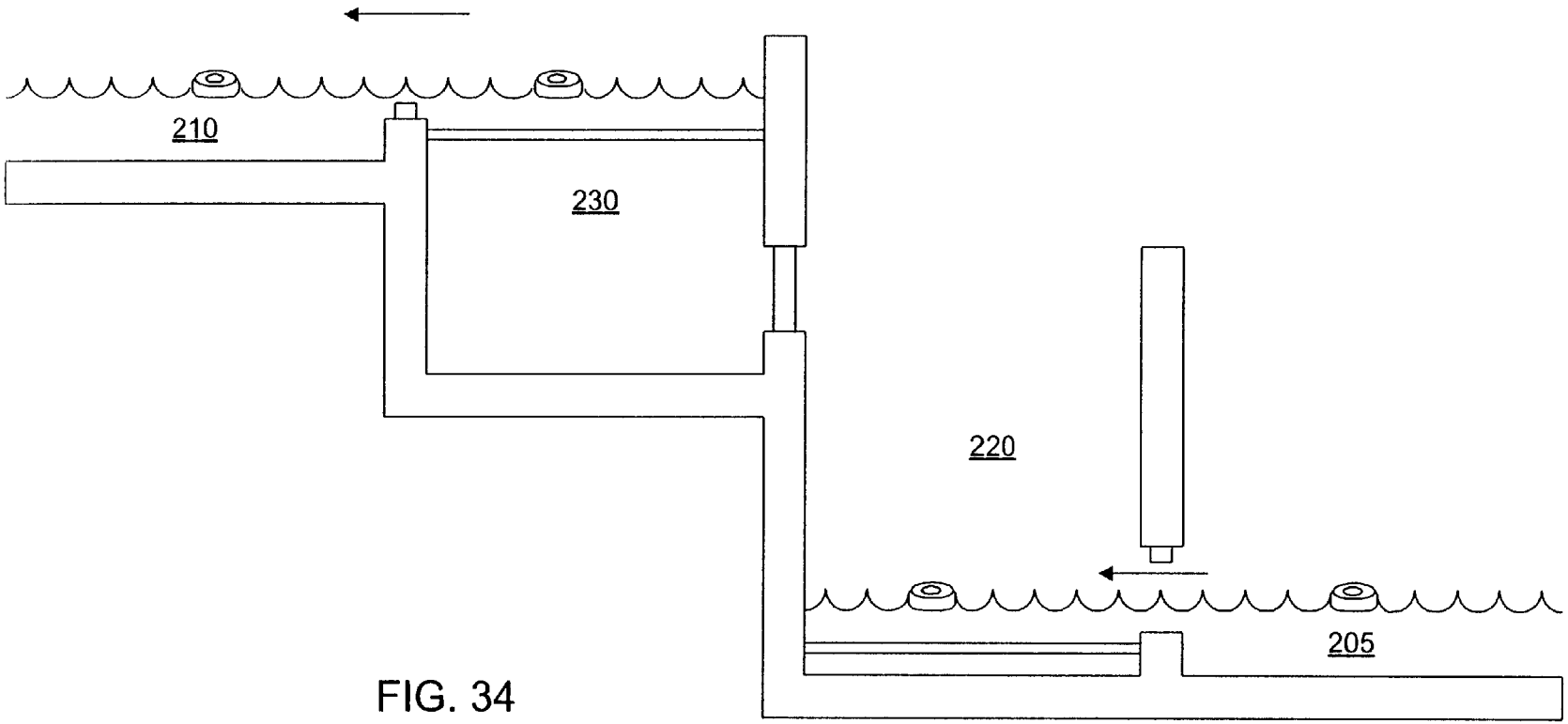
FIG. 34 depicts a cross sectional side view of a water lock system in which participants are being transferred from the second chamber to the upper body of water and from the lower body of water to the first chamber.

Alternatively, the filling and emptying of the chambers may be offset to allow a more efficient usage of a multiple chamber system. After participants have moved from first chamber 220 to second chamber 230, the first chamber may be emptied while the second chamber is filled, as depicted in FIG. 34. After second chamber 230 is filled, third movable member 250 is opened and the participants may move into upper body of water 210. While the participants are being transferred to upper body of water 210, additional participants may enter first chamber 220. Once the participants have entered first chamber 220 and left second chamber 230, the water level in the first chamber may be raised while the water in the second chamber is lowered (see FIG. 31). The system may thereafter be cycled between the states depicted in FIGS. 31 and 34 to continually transfer participants from the lower body of water to the upper body of water. It should be understood that while a method of transferring the participants from the lower body of water to the upper body of water is described, the lock system may also be used to transfer participants from an upper body to a lower body. Thus, after a group of participants have been transferred to the upper body, another group may enter the lock system and be transferred to the lower body as the water within the chambers is lowered.

Figure 3:
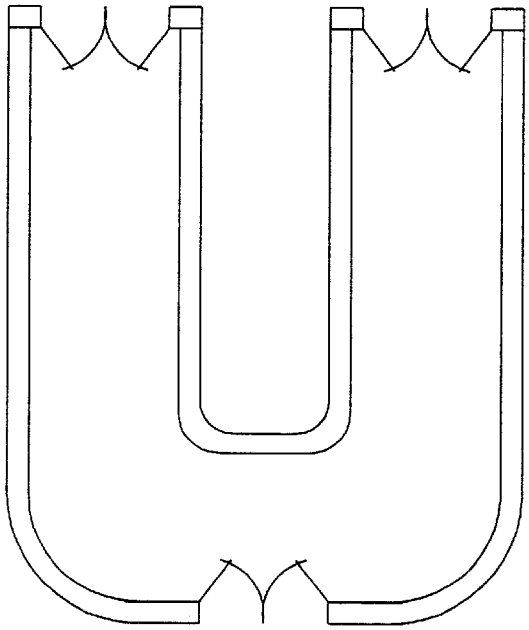
FIG. 3 depicts an overhead view of a U-shaped lock system.
Figure 5:
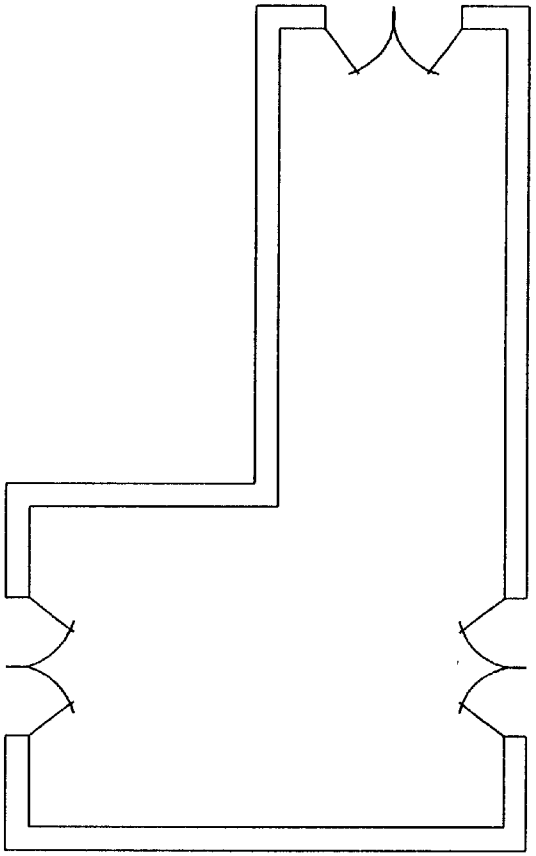
FIG. 5 depicts an overhead view of an L-shaped lock system.
Figure 4:
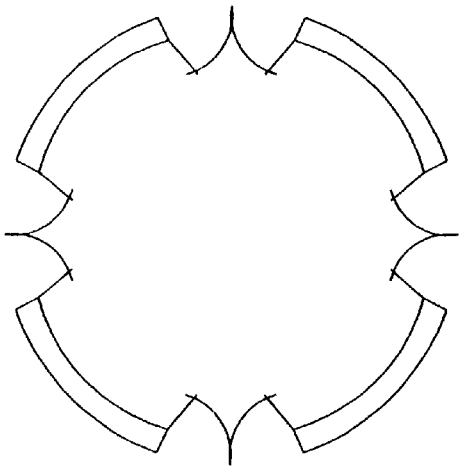
FIG. 4 depicts an overhead view of a circular lock system.

Referring back to FIGS. 3–5 it should be appreciated that multiple movable members may be formed in the chamber. FIG. 3, for example, depicts a U-shaped chamber which includes three movable members. The movable members may lead to three separate bodies of water or three locations of the same upper body of water. FIGS. 4 and 5 also depict chambers having multiple movable members. In this manner, the chamber may be used to transfer participants from a receiving pool to multiple water rides.

Figure 35:
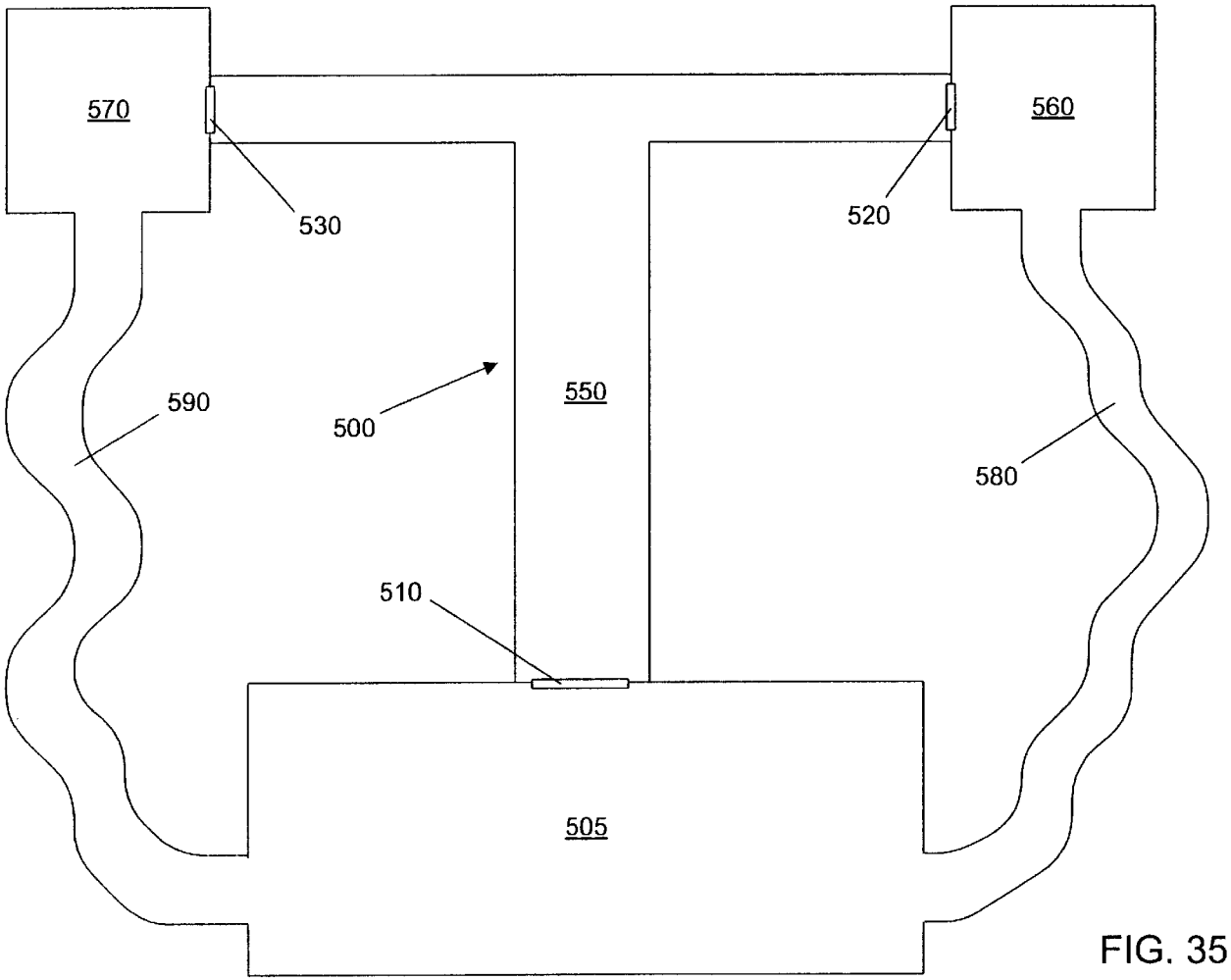
FIG. 35 depicts an overhead view of a water park system which includes a lock system.

FIG. 35 depicts an overhead view of a water park, in which two water rides are depicted which start at different locations. A first water ride 580 is configured to convey participants from a first upper body of water 570 to a receiving pool 505. A second water ride 590 is configured to convey participants from a second upper body of water 560 to receiving pool 505. Receiving pool 505 may be positioned at an elevation below the first and second upper bodies of water. A water lock system 500 preferably couples receiving pool 505 to first and second upper bodies of water 560 and 570. Participants exiting either water ride will preferably enter receiving pool 505. The participants may propel themselves, or be propelled, through the water of the receiving pool over to movable member 510. When movable member 510 is open, participants may enter chamber 550 of water lock system 500. After entering chamber 550, the chamber may be filled with water to a level which is substantially equal to the upper bodies of water. As the chamber is filled participants may propel themselves, or be propelled to either of the two upper movable members 520 and 530. After the chamber is filled, movable members 520 and 530 may be opened allowing the participants to move to the start of either water ride. Thus, a centrally disposed water lock system 500 may allow the participants to enjoy a variety of water rides without having to leave the water. Any of the previously described water lock systems may be incorporated into the water park system.

Figure 36:
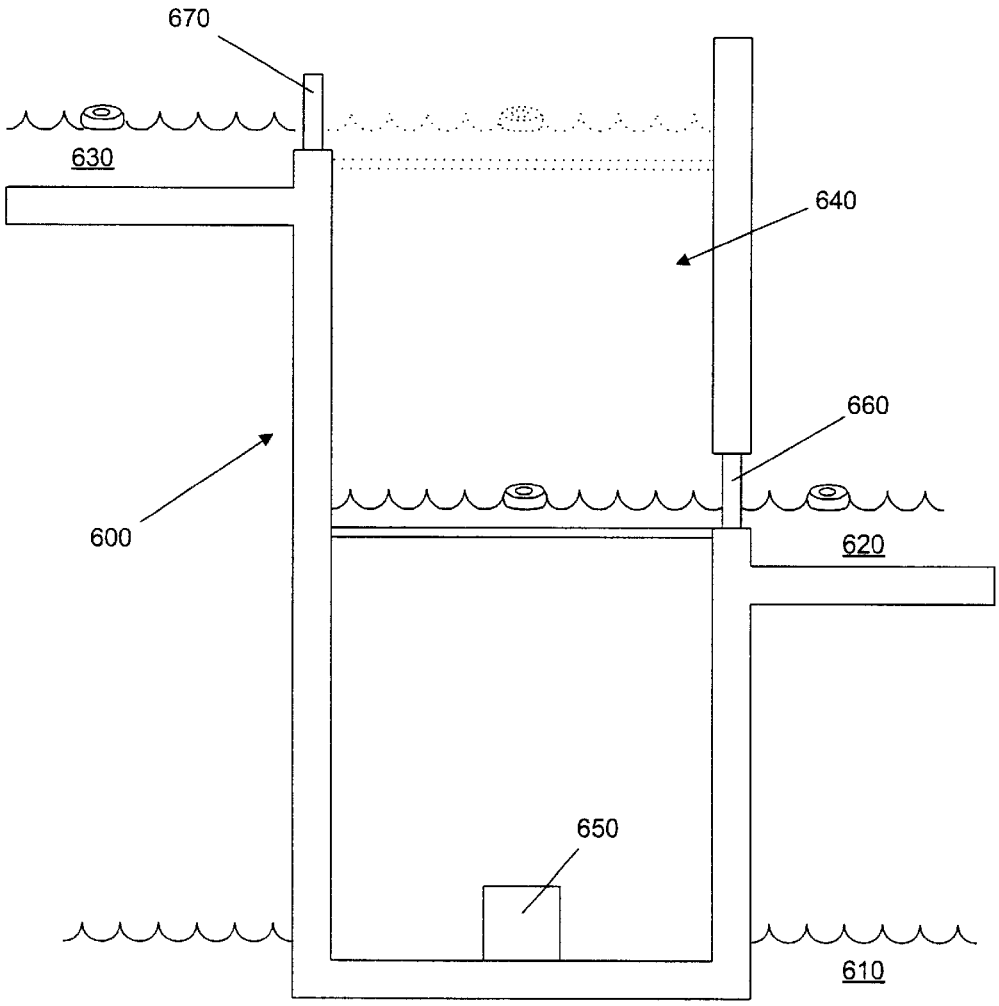
FIG. 36 depicts a cross sectional side view of a water lock system in which includes a chamber and three movable members, each movable member being at a different elevation.

It should be understood that the additional movable members do not need to be at the same vertical height along the chamber wall. As depicted in FIG. 36 some water rides may have starting points at different elevations. To accommodate these different elevations, movable members may be formed at different heights within the chamber, each elevation corresponding to a ride or series of rides which have starting points at about that elevational height. As depicted in FIG. 36, three bodies of water may be coupled by a water lock system 600. A receiving pool 610 is formed at the base of the water lock system 600. Receiving pool 610 may be positioned to receive participants exiting from various water rides. A first movable member 650 may be formed proximate receiving pool 610 to allow participants from the receiving pool to enter chamber 640. After the participants enter chamber 640, the chamber may be filled with water. The water level may be raised until the water level is at a level substantially equal to the water level of a first upper body of water 620. Participants which desire to ride water rides which are coupled to first upper body of water 620 may now leave chamber 640 via movable member 660. Other riders who wish to ride water rides coupled to a second, higher elevation body of water 630 may remain in chamber 640. After some of the participants have been transferred to first upper body of water 660, the water level of the chamber may be further raised to a level substantially equal to the water level of second upper body of water 630. The remaining participants may now enter second upper body of water 630 via movable member 670. In this way the water lock system may accommodate water rides starting at different elevational levels. While only two upper bodies of water are depicted, it should be understood that additional movable members at additional heights may be disposed in the walls of the chamber to allow additional water rides to be coupled to a centrally disposed water lock system.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A water lock system for conveying a person from a first body of water to a second body of water, the first and second bodies of water being at different elevational levels, the water lock system comprising:

a chamber for holding water, the chamber being coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber, wherein the bottom member is positionable below the upper surface of water within the chamber during use;

a first conduit coupled to the chamber for conducting water to the chamber during use; and a first water control system positioned along the first conduit, the first water control system being configured to control the flow of the water through the first conduit during use.

2. The system of claim 1, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

3. The system of claim 1, wherein the first and second movable members are configured to swing away from the chamber wall when moving from a closed position to an open position during use.

4. The system of claim 1, wherein the first and second movable members are configured to move vertically into a portion of the wall when moving from a closed position to an open position.

5. The system of claim 1, wherein the first and second movable members are configured to move horizontally along a portion of the wall when moving from a closed position to an open position.

6. The system of claim 1, wherein the bottom member is substantially water permeable such that water in the chamber moves freely through the bottom member as the bottom member is moved within the chamber during use.

7. The system of claim 1, wherein a distance between the bottom member and the upper surface of the water in the chamber is substantially constant during use.

8. The system of claim 1, wherein the bottom member comprises a wall extending from the bottom member to a position above the upper surface of the water.

9. The system of claim 1, wherein the bottom member is floating within the chamber.

10. The system of claim 9, wherein the bottom member comprises a wall and a floatation member, the bottom member wall encircling the bottom member and extending from the bottom member to a position above the upper surface of the water, the floatation member being positioned upon the bottom member wall at a location proximate the upper surface of the water.

11. The system of claim 10, further comprising a substantially vertical first ladder coupled to the bottom member wall and a substantially vertical second ladder coupled to the wall of the chamber, wherein the first and second ladders are substantially aligned.

12. The system of claim 1, wherein the bottom member comprises a wall extending from the bottom member to a position above the upper surface of the water, wherein the bottom member wall is configured to inhibit the person from moving to a position below the bottom member.

13. The system of claim 1, wherein the bottom member comprises a locking system coupling the bottom member to the inner surface of the chamber wall, wherein the locking system is configured to inhibit the bottom member from sinking when water is released from the chamber.

14. The system of claim 13, wherein the locking system is a ratcheted locking system.

15. The system of claim 1, wherein the water control system comprises a valve configured to control flow of water through the first conduit.

16. The system of claim 1, wherein the first conduit is further coupled to the second body of water, and wherein the first conduit is configured to transfer water between the second body of water and the chamber during use.

17. The system of claim 16, wherein the first water control system comprises a valve and a pump, wherein the valve is configured to control flow of water through the first conduit, and wherein the pump is configured to pump water between the chamber and the second body of water during use.

18. The system of claim 1, wherein the first conduit is further coupled to the first body of water, and wherein the first conduit is configured to transfer water between the first body of water and the chamber during use.

19. The system of claim 18, wherein the first water control system comprises a pump positioned along the first conduit for pumping water between the first body of water and the chamber during use.

20. The system of claim 1, further comprising a second conduit and a second water control system, the second conduit being coupled to the chamber for conducting water out of the chamber during use, the second water control system being positioned along the second conduit to control flow of water through the second conduit during use.

21. The system of claim 20, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use.

22. The system of claim 20, wherein the first conduit is further coupled to the second body of water, and wherein the first conduit is configured to transfer water between the second body of water and the chamber during use, and wherein the second conduit is further coupled to the second body of water, and wherein the second conduit is configured to transfer water between the chamber and the second body of water during use, and wherein the second water control system comprises a pump for pumping water between the chamber and the second body of water during use.

23. The system of claim 20, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use, and further comprising a third conduit and a third water control system, the third conduit being coupled to the second body of water and the first body of water, the third water control system being positioned along the third conduit, and wherein the third water control system comprises a pump configured to pump water between the first body of water and the second body of water during use.

24. The system of claim 1, wherein the first movable member, the second movable member, and the first water control system are coupled to a controller, and wherein the controller is configured to control operation of the first movable member, the second movable member, and the first water control system during use.

25. The system of claim 1, further comprising a flotation device for supporting the person, wherein the system is further configured to convey the person supported by the flotation device.

26. The system of claim 1, further comprising additional movable members formed in the wall, and wherein the additional movable members allow participants to enter and exit the chamber to and from additional bodies of water positioned adjacent the chamber.

27. The system of claim 26, wherein the additional movable members are formed at different vertical positions along the chamber.

28. A system for conveying a person from a first body of water to a second body of water, the first and second bodies of water being at different elevation levels, comprising:

a first chamber coupled to the first body of water;

a first movable member formed in a wall of the first chamber, the first movable member positioned to allow the person and water to move between the first body of water and the first chamber when the first movable member is open;

a second chamber coupled to the second body of water and the first chamber such that an outer surface of a portion of the first chamber wall forms a portion of the inner surface of a second chamber wall;

a second movable member formed in the portion of the first chamber wall dividing the first chamber from the second chamber, wherein the second movable member is configured to allow the person and water to move between the first chamber and the second chamber when the second movable member is open;

a third movable member formed in the wall of the second chamber, the third movable member positioned to allow the person and water to move between the second body of water and the second chamber when the third movable member is open;

a first bottom member positioned within the first chamber, wherein the first bottom member is positionable below the upper surface of water within the first chamber during use;

a second bottom member positioned within the second chamber, wherein the second bottom member is positionable below the upper surface of water within the second chamber during use;

a first conduit coupled to the first chamber for conducting water to the first chamber during use;

a first water control system positioned along the first conduit, the first water control system being configured to control the flow of water through the first conduit during use;

a second conduit coupled to the second chamber for conducting water to the second chamber during use; and a second water control system positioned along the second conduit, the second water control system being configured to control the flow of water through the second conduit during use.

29. The system of claim 28, wherein the first chamber and the second chamber have a shape that resembles a figure selected from the group consisting of a square, a rectangle, a circle, a star, a regular polyhedron, a trapezoid, an ellipse or a figure eight, when seen from an overhead view.

30. The system of claim 28, wherein the first and second chambers have different shapes.

31. The system of claim 28, wherein the first and second movable members are configured to swing away from the first chamber wall when moving from a closed position to an open position during use, and wherein the third movable member is configured to swing away from the second chamber wall when moving from a closed position to an open position during use.

32. The system of claim 28, wherein the first and second movable members are configured to move vertically into a portion of the first chamber wall when moving from a closed position to an open position, and wherein the third movable member is configured to move vertically into a portion of the second chamber wall when moving from a closed position to an open position.

33. The system of claim 28, wherein the first bottom member is substantially water permeable such that water in the first chamber moves freely through the first bottom member as the first bottom member is moved within the first chamber during use, and wherein the second bottom member is substantially water permeable such that water in the second chamber moves freely through the second bottom member as the second bottom member is moved within the second chamber during use.

34. The system of claim 28, wherein the first bottom member comprises a wall extending from the first bottom member to a position above the upper surface of the water in the first chamber, and wherein the second bottom member comprises a wall extending from the second bottom member to a position above the upper surface of the water in the second chamber.

35. The system of claim 28, wherein the first bottom member is configured to float within the chamber, and wherein the second bottom member is configured to float within the chamber.

36. The system of claim 35, wherein the first bottom member comprises a first wall and a first floatation member, the first wall extending from the first bottom member to a position above the upper surface of the water in the first chamber, the first floatation member being positioned upon the first wall at a location near the upper surface of the water in the first chamber, and wherein the second bottom member comprises a second wall and a second floatation member, the second wall extending from the second bottom member to a position above the upper surface of the water in the second chamber, the second floatation member being positioned upon the second wall at a location near the upper surface of the water in the second chamber.

37. The system of claim 28, wherein the first bottom member comprises a first wall extending from the first bottom member to a position above the upper surface of the water in the first chamber, and wherein the first wall is coupled to the first bottom member such that the first wall inhibits the person from moving to a position below the first bottom member, and wherein the second bottom member comprises a second wall extending from the second bottom member to a position above the upper surface of the water in the second chamber, and wherein the second wall is coupled to the second bottom member such that the second wall inhibits the person from moving to a position below the second bottom member.

38. The system of claim 28, wherein the first bottom member comprises a first ratcheted locking system coupling the first bottom member to the inner surface of the first chamber wall, and wherein the first ratcheted locking system is configured to inhibit the first bottom member from sinking when water is released from the first chamber, and wherein the second bottom member comprises a second ratcheted locking system coupling the second bottom member to the inner surface of the second chamber walls, and wherein the second ratcheted locking system is configured to inhibit the second bottom member from sinking when water is released from the second chamber.

39. The system of claim 28, wherein the first and second conduits are further coupled to the second body of water, and wherein the first conduit is configured to transfer water between the second body of water and the first chamber during use, and wherein the second conduit is configured to transfer water between the second body of water and the second chamber during use.

40. The system of claim 28, wherein the first and second conduits are further coupled to the first body of water, and wherein the first conduit is configured to transfer water between the first body of water and the first chamber during use, and wherein the second conduit is configured to transfer water between the first body of water and the second chamber during use.

41. The system of claim 40, wherein the first water control systems comprises a first pump, and wherein the second water control system comprises a second pump, the first pump being positioned along the first conduit for pumping water between the first body of water and the first chamber during use, the second pump being positioned along the second conduit for pumping water between the first body of water and the second chamber during use.

42. The system of claim 28, wherein the first conduit is further coupled to the second chamber, and wherein the first conduit is configured to transfer water between the second chamber and the first chamber during use, and wherein the second conduit is further coupled to the second body of water, and wherein the second conduit is configured to transfer water between the second body of water and the second chamber during use.

43. The system of claim 42, further comprising:

a third conduit coupled to the first chamber for conducting water out of the first chamber during use; and a third water control system positioned along the third conduit, the third valve being configured to control flow of water through the third conduit during use.

44. The system of claim 28, further comprising:

a third conduit coupled to the first chamber for conducting water out of the first chamber during use;

a third water control system positioned along the third conduit, the third valve being configured to control the flow of water through the third conduit during use;

a fourth conduit coupled to the second chamber for conducting water out of the second chamber during use; and a fourth water control system positioned along the fourth conduit, the fourth valve being configured to control the flow of water through the fourth conduit during use.

45. The system of claim 44, wherein the first and second conduits are further coupled to the second body of water, and wherein the first conduit is configured to transfer water between the second body of water and the first chamber during use, and wherein the second conduit is configured to transfer water between the second body of water to the second chamber during use, and wherein the third and fourth conduits are further coupled to the first body of water, and wherein the third conduit is configured to transfer water between the first chamber and the first body of water during use, and wherein the fourth conduit is configured to transfer water between the second chamber and the first body of water during use.

46. The system of claim 28, further comprising a third conduit and a third water control system, the third conduit being coupled to the second body of water and the first body of water, the third water control system being positioned along the third conduit, wherein the third water control system comprises a pump configured to pump water between the first body of water and the second body of water during use.

47. The system of claim 28, wherein the first movable member, the second movable member, the third movable member, the first water control system, and the second water control system are coupled to a controller, and wherein the controller is configured to operate the first, second, and third movable members during use, and wherein the controller is configured to operate the first and second water control systems during use.

48. A method for transferring a person from a first body of water to a second body of water, the first and second bodies of water being at different elevational levels, comprising:

transferring the person from the first body of water into a water lock system, the water lock system comprising:

a chamber for holding water coupled to the first body of water and the second body of water;

a first movable member formed in the wall of the chamber, the first movable member being positioned to allow the person and water to move between the first body of water and the first chamber when the first movable member is open during use;

a second movable member formed in the wall of the chamber, the second movable member being positioned to allow the person and water to move between the second body of water and the chamber when the second movable member is open during use;

a bottom member positioned within the chamber, wherein the bottom member is positionable below the upper surface of water within the chamber during use;

a first conduit coupled to the chamber for conducting water to the chamber during use; and a first water control system positioned along the first conduit, the first water control system being configured to control the flow of water through the first conduit during use;

wherein transferring the person to the water lock system comprises moving the person from the first body of water into the chamber through the first movable member;

closing the first movable member;

altering the level of water within the chamber with water such that the upper surface of the water in the chamber is substantially equal to the upper surface of the water in the second body of water;

opening the second movable member; and transferring the person from the chamber to the second body of water through the second movable member.

49. The method of claim 48, further comprises altering the level of the water within the chamber such that an upper surface of the water in the chamber is substantially equal to the upper surface of the water in the first body of water prior to transferring the person from the first body of water to the lock system.

50. The method of claim 48, further comprising placing the person on a flotation device prior to transferring the person to the chamber.

51. The method of claim 48, wherein transferring the person to the water lock system comprises generating a current of water flowing from the first body of water toward the water lock system and positioning the person within the current of water, and wherein the current of water carries the person into the chamber of the water lock system.

52. The method of claim 48, wherein transferring the person from the chamber to the second body of water comprises generating a current of water flowing from the chamber toward the second body of water and positioning the person within the current of water, and wherein the current of water carries the person into the second body of water.

53. The method of claim 52, wherein generating a current comprises filling the chamber with water while the second movable member is open.

54. The method of claim 48, wherein the first movable member is configured to swing away from the chamber wall, wherein the second movable member is configured to swing away from the chamber wall during use, wherein closing the first movable member comprises swinging the first movable member toward the chamber wall, and wherein opening the second movable member comprises swinging the second movable member away from the chamber wall.

55. The method of claim 48, wherein the first movable member is configured to move vertically into a portion of the chamber wall, wherein the second movable member is configured to move vertically into a portion of the chamber wall during use, wherein closing the first movable member comprises moving the first movable member out of the chamber wall, and wherein opening the second movable member comprises moving the second movable member into the chamber wall.

56. The method of claim 48, wherein the first conduit is further coupled to the second body of water, and wherein altering the level of the water in the chamber comprises transferring water between the second body of water and the chamber through the first conduit.

57. The method of claim 48, wherein the first conduit is further coupled to the first body of water, and wherein altering the level of the water in the chamber comprises transferring water between the first body of water and the chamber through the conduit.

58. The method of claim 48, further comprises altering the level of the water in the chamber until the upper surface of the water in the chamber is substantially equal to the upper surface of the water in the first body of water subsequent to transferring the person the second body of water.

59. The method of claim 48, wherein the water lock system further comprises a second conduit and a second water control system, the second conduit being coupled to the chamber for conducting water out of the chamber during use.

60. The method of claim 59 further comprising a second water control system positioned along the second conduit, the second water control system comprising a pump for pumping water along the second conduit.

61. The method of claim 59, wherein the water lock system further comprises a third conduit and a third water control system, the third conduit being coupled to the second body of water and the first body of water, the third water control system comprising a pump positioned along the third conduit, and wherein the pump is configured to pump water between the first body of water and the second body of water, the method further comprising transferring water between the first body of water and the second body of water.

62. A method for transferring a person from a first body of water to a second body of water, the first and second bodies of water being at different elevational heights, comprising:

transferring the person from the first body of water into a water lock system, the water lock system comprising:

a first chamber coupled to the first body of water;

a first movable member formed in a wall of the first chamber, the first movable member positioned to allow the person and water to move between the first body of water and the first chamber when the first movable member is open;

a second chamber coupled to the second body of water and the first chamber, wherein an outer surface of a portion of the first chamber wall forms a portion of the inner surface of a second chamber wall;

a second movable member formed in the portion of the first chamber wall dividing the first chamber from the second chamber, wherein the second movable member is configured to allow the person and water to move between the first chamber and the second chamber when the second movable member is open;

a third movable member formed in the wall of the second chamber, the third movable member positioned to allow the person and water to move between the second chamber and the second body of water when the third movable member is open;

a first bottom member positioned within the first chamber, wherein the first bottom member is positionable below the upper surface of water within the first chamber during use;

a second bottom member positioned within the second chamber, wherein the second bottom member is positionable below the upper surface of water within the second chamber during use;

a first conduit coupled to the first chamber for conducting water to the first chamber during use;

a first water control system positioned along the first conduit, the first water control system being configured to control the flow of water through the first conduit during use;

a second conduit coupled to the second chamber for conducting water to the second chamber during use; and a second water control system positioned along the second conduit, the second water control system being configured to control the flow of water through the second conduit during use;

wherein transferring the person to the water lock system comprises moving the person from the first body of water into the first chamber through the first movable member;

closing the first movable member;

altering the level of water in the first chamber such that the upper surface of the water in the first chamber is substantially equal to a portion of the second movable member;

altering the level of water in the second chamber such that the upper surface of the water in the second chamber is substantially equal to a portion of the second movable member;

opening the second movable member;

transferring the person from the first chamber to the second chamber through the second movable member;

closing the second movable member;

altering the level of water in the second chamber with water such that the upper surface of the water in the second chamber is substantially equal to the upper surface of the water of the second body of water;

opening the third movable member; and transferring the person from the second chamber to the second body of water.

63. The method of claim 62, further comprises altering the level of the water in the first chamber such that an upper surface of the water in the first chamber is substantially equal to the upper surface of the water in the first body of water prior to transferring the person from the first body of water to the lock system.

64. The method of claim 62, further comprising placing the person on a floatation device prior to transferring the person to the first chamber.

65. The method of claim 62, wherein the first conduit is further coupled to the second chamber, wherein altering the level of the water in the first chamber comprises transferring water between the second chamber and the first chamber through the first conduit, and wherein altering the level of the water in the second chamber comprises transferring water between the first chamber and the second chamber through the conduit.

66. The method of claim 62, further comprising altering the level of the water in the first chamber while altering the level of the water in the second chamber.

67. The method of claim 62, further comprising altering the level of the water in the first chamber until the upper surface of the water in the first chamber is substantially equal to the upper surface of the water in the first body of water subsequent to transferring the person to the second chamber.

68. The method of claim 62, further comprising altering the level of the water in the second chamber until the upper surface of the water in the second chamber is substantially equal to a portion of the second movable member subsequent to transferring the person to the second body of water.

69. The method of claim 62, further comprising altering the level of the water in the first chamber until the upper surface of the water in the first chamber is substantially equal to the upper surface of the water in the first body of water subsequent to transferring the person to the second chamber, and further comprising altering the level of the water in the second chamber until the upper surface of the water in the second chamber is substantially equal to a portion of the second movable member subsequent to transferring the person to the second body of water.

70. The method of claim 62, wherein the water lock system further comprises:

a third conduit coupled to the first chamber for conducting water out of the first chamber during use;

a third water control system positioned along the third conduit, the third water control system being configured to control the flow of water through the third conduit during use;

a fourth conduit coupled to the second chamber for conducting water out of the second chamber during use; and a fourth water control system positioned along the fourth conduit, the fourth water control system being configured to control the flow of the water through the fourth conduit during use.

71. The method of claim 62, wherein transferring the person from the first chamber to the second chamber comprises generating a current of water flowing from the first chamber toward the second chamber and positioning the person within the current of water, and wherein the current of water carries the person into the second chamber.

72. The method of claim 62, wherein generating a current comprises filling the first chamber with water while the second movable member is open.

73. The method of claim 62, wherein transferring the person from the second chamber to the second body of water comprises generating a current of water flowing from the second chamber toward the second body of water and positioning the person within the current of water, and wherein the current of water carries the person into the second body of water.

74. The method of claim 73, wherein generating a current comprises filling the second chamber with water while the third movable member is open.

75. An amusement park system, comprising:

a water ride configured to convey a person from an upper body of water to a lower body of water; and a water lock system, the water lock system comprising:

a chamber for holding water, the chamber being coupled to the lower body of water and the upper body of water;

a first movable member formed in the wall of the chamber, the first movable member being positioned to allow the person and water from the first body of water to enter the first chamber when the first movable member is open during use;

a second movable member formed in the wall of the chamber, the second movable member being positioned to allow the person and water from the chamber to enter the second body of water when the second movable member is open during use;

a bottom member positioned within the chamber, wherein the bottom member is positionable below the upper surface of water within the chamber during use;

a first conduit coupled to the chamber for conducting water to the chamber during use; and a first water control system positioned along the first conduit, the first water control system being configured to control the flow of water through the first conduit during use.

76. The system of claim 75, wherein the chamber has a shape that resembles a figure selected from the following group consisting of a square, a rectangle, a circle, a star, a regular polyhedron, a trapezoid, an ellipse, a U-shape, a T-shape, an L-shape, a Y-shape, or a figure eight, when seen from an overhead view.

77. The system of claim 75, wherein the second movable member is formed in the wall at an elevation substantially higher than the first movable member.

78. The system of claim 75, wherein the first and the second movable members are configured to swing away from the chamber wall when moving from a closed position to an open position during use.

79. The system of claim 75, wherein the first and second movable members are configured to move vertically into a portion of the wall when moving from a closed position to an open position.

80. The system of claim 75, wherein the first and the second movable members are configured to move horizontally along a portion of the wall when moving from a closed position to an open position.

81. The system of claim 75, wherein the bottom member is substantially water permeable such that water in the chamber moves freely through the bottom member as the bottom member is moved within the chamber during use.

82. The system of claim 75, wherein the distance between the bottom member and the upper surface of the water in the chamber is substantially constant during use.

83. The system of claim 75, wherein the bottom member comprises a wall extending from the bottom member to a position above the upper surface of the water.

84. The system of claim 83, further comprising a substantially vertical first ladder coupled to the bottom member wall and a substantially vertical second ladder coupled to the chamber wall, wherein the first and second ladder are substantially aligned.

85. The system of claim 75, wherein the bottom member is floating within the chamber during use.

86. The system of claim 85, wherein the bottom member comprises a wall and a floatation member, the bottom member wall encircling the bottom member and extending from the bottom member to apposition above the upper surface of the water, the floatation member being positioned upon the bottom member wall at a location proximate the upper surface of the water.

87. The system of claim 75, wherein the bottom member comprises a ratcheted locking system coupling the bottom member to the inner surface of the chamber wall, wherein the ratcheted locking system is configured to inhibit the bottom member from sinking when the water is released from the chamber.

88. The system of claim 75, wherein the water control system comprises a valve and a pump, wherein the valve is configured to control the flow of the water through the conduit, and wherein the pump is configured too pump water through the conduit during use.

89. The system of claim 75, wherein the first movable members, the second movable member, and the first water control system are coupled to a controller, and wherein the controller is configured to control operation of the first movable member, the second movable member, and the first water control system during use.

90. The system of claim 75, wherein the person is riding a flotation device.

91. The system of claim 75, further comprising additional movable members formed in the wall, wherein the additional movable members allow participants to enter and exit the chamber from additional bodies of water positioned adjacent the chamber.

92. The system of claim 91, wherein the additional movable members are formed at different elevational levels.

93. The system of claim 75, further comprising additional movable members and additional water rides, wherein the additional movable members are positioned adjacent to additional bodies of water, wherein the additional bodies of water are coupled to the additional rides, and wherein the movable members allow the person to move from the chamber to the additional bodies of water.

94. The system of claim 93, wherein the additional bodies of water are at different elevational levels.

95. A water lock system for conveying a person from a first body of water to a second body of water, the first and second bodies of water being at different elevational levels, comprising:

a chamber for holding water, the chamber coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber, wherein the bottom member is positionable below the upper surface of water within the chamber during use, and wherein the bottom member is substantially water permeable such that water in the chamber moves freely through the bottom member as the bottom member is moved within the chamber during use;

a first conduit coupled to the chamber for conducting water to the chamber during use; and a first water control system positioned along the first conduit, the first water control system being configured to control the flow of the water through the first conduit during use.

96. The system of claim 95, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

97. The system of claim 95, wherein the first and second movable members are configured to swing away from the chamber wall when moving from a closed position to an open position during use.

98. The system of claim 95, wherein the first and second movable members are configured to move vertically into a portion of the wall when moving from a closed position to an open position.

99. The system of claim 95, wherein the first and second movable members are configured to move horizontally along a portion of the wall when moving from a closed position to an open position.

100. The system of claim 95, wherein a distance between the bottom member and the upper surface of the water in the chamber is substantially constant during use.

101. The system of claim 95, wherein the bottom member comprises a wall extending from the bottom member to a position above the upper surface of the water.

102. The system of claim 95, wherein the bottom member is floating within the chamber.

103. The system of claim 102, wherein the bottom member comprises a wall and a floatation member, the bottom member wall encircling the bottom member and extending from the bottom member to a position above the upper surface of the water, the floatation member being positioned upon the bottom member wall at a location proximate the upper surface of the water.

104. The system of claim 103, further comprising a substantially vertical first ladder coupled to the bottom member wall and a substantially vertical second ladder coupled to the wall of the chamber, wherein the first and second ladders are substantially aligned.

105. The system of claim 95, wherein the bottom member comprises a wall extending from the bottom member to a position above the upper surface of the water, wherein the bottom member wall is configured to inhibit the person from moving to a position below the bottom member.

106. The system of claim 95, wherein the bottom member comprises a locking system coupling the bottom member to the inner surface of the chamber wall, wherein the locking system is configured to inhibit the bottom member from sinking when water is released from the chamber.

107. The system of claim 100, wherein the locking system is a ratcheted locking system.

108. The system of claim 95, wherein the water control system comprises a valve configured to control flow of water through the first conduit.

109. The system of claim 95, wherein the first conduit is further coupled to the second body of water, and wherein the first conduit is configured to transfer water between the second body of water and the chamber during use.

110. The system of claim 109, wherein the first water control system comprises a valve and a pump, wherein the valve is configured to control flow of water through the first conduit, and wherein the pump is configured to pump water between the chamber and the second body of water during use.

111. The system of claim 95, wherein the first conduit is further coupled to the first body of water, and wherein the first conduit is configured to transfer water between the first body of water and the chamber during use.

112. The system of claim 111, wherein the first water control system comprises a pump positioned along the first conduit for pumping water between the first body of water and the chamber during use.

113. The system of claim 95, further comprising a second conduit and a second water control system, the second conduit being coupled to the chamber for conducting water out of the chamber during use, the second water control system being positioned along the second conduit to control flow of water through the second conduit during use.

114. The system of claim 113, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use.

115. The system of claim 113, wherein the first conduit is further coupled to the second body of water, and wherein the first conduit is configured to transfer water between the second body of water and the chamber during use, and wherein the second conduit is further coupled to the second body of water, and wherein the second conduit is configured to transfer water between the chamber and the second body of water during use, and wherein the second water control system comprises a pump for pumping water between the chamber and the second body of water during use.

116. The system of claim 113, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use, and further comprising a third conduit and a third water control system, the third conduit being coupled to the second body of water and the first body of water, the third water control system being positioned along the third conduit, and wherein the third water control system comprises a pump configured to pump water between the first body of water and the second body of water during use.

117. The system of claim 95, wherein the first movable member, the second movable member, and the first water control system are coupled to a controller, and wherein the controller is configured to control operation of the first movable member, the second movable member, and the first water control system during use.

118. The system of claim 95, further comprising a flotation device for supporting the person, wherein the system is further configured to convey the flotation device without the person dismounting from the flotation device.

119. The system of claim 95, further comprising additional movable members formed in the wall, and wherein the additional movable members allow participants to enter and exit the chamber to and from additional bodies of water positioned adjacent the chamber.

120. The system of claim 119, wherein the additional movable members are formed at different vertical positions along the chamber.

121. A water lock system for conveying a person from a first body of water to a second body of water, the first and second bodies of water being at different elevational levels, comprising:

a chamber for holding water, the chamber coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber, the bottom member comprising a wall extending from the bottom member, wherein the bottom member is positionable below the upper surface of water within the chamber during use, and wherein the bottom member wall extends to a position above the upper surface of the water;

a first conduit coupled to the chamber for conducting water to the chamber during use; and a first water control system positioned along the first conduit, the first water control system being configured to control the flow of the water through the first conduit during use.

122. The system of claim 121, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

123. The system of claim 121, wherein the first and second movable members are configured to swing away from the chamber wall when moving from a closed position to an open position during use.

124. The system of claim 121, wherein the first and second movable members are configured to move vertically into a portion of the wall when moving from a closed position to an open position.

125. The system of claim 121, wherein the first and second movable members are configured to move horizontally along a portion of the wall when moving from a closed position to an open position.

126. The system of claim 121, wherein the bottom member is substantially water permeable such that water in the chamber moves freely through the bottom member as the bottom member is moved within the chamber during use.

127. The system of claim 121, wherein a distance between the bottom member and the upper surface of the water in the chamber is substantially constant during use.

128. The system of claim 121, wherein the bottom member is floating within the chamber.

129. The system of claim 120, wherein the bottom member comprises a floatation member, the floatation member being positioned upon the bottom member wall at a location proximate the upper surface of the water.

130. The system of claim 129, further comprising a substantially vertical first ladder coupled to the bottom member wall and a substantially vertical second ladder coupled to the wall of the chamber, wherein the first and second ladders are substantially aligned.

131. The system of claim 121, wherein the bottom member wall is configured to inhibit the person from moving to a position below the bottom member.

132. The system of claim 121, wherein the bottom member comprises a locking system coupling the bottom member to the inner surface of the chamber wall, wherein the locking system is configured to inhibit the bottom member from sinking when water is released from the chamber.

133. The system of claim 132, wherein the locking system is a ratcheted locking system.

134. The system of claim 121, wherein the water control system comprises a valve configured to control flow of water through the first conduit.

135. The system of claim 121, wherein the first conduit is further coupled to the second body of water, and wherein the first conduit is configured to transfer water between the second body of water and the chamber during use.

136. The system of claim 135, wherein the first water control system comprises a valve and a pump, wherein the valve is configured to control flow of water through the first conduit, and wherein the pump is configured to pump water between the chamber and the second body of water during use.

137. The system of claim 121, wherein the first conduit is further coupled to the first body of water, and wherein the first conduit is configured to transfer water between the first body of water and the chamber during use.

138. The system of claim 137, wherein the first water control system comprises a pump positioned along the first conduit for pumping water between the first body of water and the chamber during use.

139. The system of claim 121, further comprising a second conduit and a second water control system, the second conduit being coupled to the chamber for conducting water out of the chamber during use, the second water control system being positioned along the second conduit to control flow of water through the second conduit during use.

140. The system of claim 139, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use.

141. The system of claim 139, wherein the first conduit is further coupled to the second body of water, and wherein the first conduit is configured to transfer water between the second body of water and the chamber during use, and wherein the second conduit is further coupled to the second body of water, and wherein the second conduit is configured to transfer water between the chamber and the second body of water during use, and wherein the second water control system comprises a pump for pumping water between the chamber and the second body of water during use.

142. The system of claim 139, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use, and further comprising a third conduit and a third water control system, the third conduit being coupled to the second body of water and the first body of water, the third water control system being positioned along the third conduit, and wherein the third water control system comprises a pump configured to pump water between the first body of water and the second body of water during use.

143. The system of claim 121, wherein the first movable member, the second movable member, and the first water control system are coupled to a controller, and wherein the controller is configured to control operation of the first movable member, the second movable member, and the first water control system during use.

144. The system of claim 121, wherein the person is riding a flotation device, and wherein the system is configured to convey the person and the flotation device without the person dismounting from the flotation device.

145. The system of claim 121, further comprising additional movable members formed in the wall, and wherein the additional movable members allow participants to enter and exit the chamber to and from additional bodies of water positioned adjacent the chamber.

146. The system of claim 145, wherein the additional movable members are formed at different vertical positions along the chamber.

147. A water lock system for conveying a person from a first body of water to a second body of water, the first and second bodies of water being at different elevational levels, comprising:

a chamber for holding water, the chamber coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber, wherein the bottom member is configured to be floating within the chamber and positionable below the upper surface of water within the chamber during use;

a first conduit coupled to the chamber for conducting water to the chamber during use; and a first water control system positioned along the first conduit, the first water control system being configured to control the flow of the water through the first conduit during use.

148. The system of claim 147, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

149. The system of claim 147, wherein the first and second movable members are configured to swing away from the chamber wall when moving from a closed position to an open position during use.

150. The system of claim 147, wherein the first and second movable members are configured to move vertically into a portion of the wall when moving from a closed position to an open position.

151. The system of claim 147, wherein the first and second movable members are configured to move horizontally along a portion of the wall when moving from a closed position to an open position.

152. The system of claim 147, wherein a distance between the bottom member and the upper surface of the water in the chamber is substantially constant during use.

153. The system of claim 147, wherein the bottom member comprises a wall extending from the bottom member to a position above the upper surface of the water.

154. The system of claim 147, wherein the bottom member comprises a wall and a floatation member, the bottom member wall encircling the bottom member and extending from the bottom member to a position above the upper surface of the water, the floatation member being positioned upon the bottom member wall at a location proximate the upper surface of the water.

155. The system of claim 154, further comprising a substantially vertical first ladder coupled to the bottom member wall and a substantially vertical second ladder coupled to the wall of the chamber, wherein the first and second ladders are substantially aligned.

156. The system of claim 147, wherein the bottom member comprises a wall extending from the bottom member to a position above the upper surface of the water, wherein the bottom member wall is configured to inhibit the person from moving to a position below the bottom member.

157. The system of claim 147, wherein the bottom member comprises a locking system coupling the bottom member to the inner surface of the chamber wall, wherein the locking system is configured to inhibit the bottom member from sinking when water is released from the chamber.

158. The system of claim 157, wherein the locking system is a ratcheted locking system.

159. The system of claim 147, wherein the water control system comprises a valve configured to control flow of water through the first conduit.

160. The system of claim 147, wherein the first conduit is further coupled to the second body of water, and wherein the first conduit is configured to transfer water between the second body of water and the chamber during use.

161. The system of claim 160, wherein the first water control system comprises a valve and a pump, wherein the valve is configured to control flow of water through the first conduit, and wherein the pump is configured to pump water between the chamber and the second body of water during use.

162. The system of claim 147, wherein the first conduit is further coupled to the first body of water, and wherein the first conduit is configured to transfer water between the first body of water and the chamber during use.

163. The system of claim 162, wherein the first water control system comprises a pump positioned along the first conduit for pumping water between the first body of water and the chamber during use.

164. The system of claim 147, further comprising a second conduit and a second water control system, the second conduit being coupled to the chamber for conducting water out of the chamber during use, the second water control system being positioned along the second conduit to control flow of water through the second conduit during use.

165. The system of claim 164, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use.

166. The system of claim 164, wherein the first conduit is further coupled to the second body of water, and wherein the first conduit is configured to transfer water between the second body of water and the chamber during use, and wherein the second conduit is further coupled to the second body of water, and wherein the second conduit is configured to transfer water between the chamber and the second body of water during use, and wherein the second water control system comprises a pump for pumping water between the chamber and the second body of water during use.

167. The system of claim 164, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use, and further comprising a third conduit and a third water control system, the third conduit being coupled to the second body of water and the first body of water, the third water control system being positioned along the third conduit, and wherein the third water control system comprises a pump configured to pump water between the first body of water and the second body of water during use.

168. The system of claim 147, wherein the first movable member, the second movable member, and the first water control system are coupled to a controller, and wherein the controller is configured to control operation of the first movable member, the second movable member, and the first water control system during use.

169. The system of claim 147, further comprising a flotation device for supporting the person, wherein the system is further configured to convey the flotation device without the person dismounting from the flotation device.

170. The system of claim 147, further comprising additional movable members formed in the wall, and wherein the additional movable members allow participants to enter and exit the chamber to and from additional bodies of water positioned adjacent the chamber.

171. The system of claim 170, wherein the additional movable members are formed at different vertical positions along the chamber.

172. A water lock system for conveying a person from a first body of water to a second body of water, the first and second bodies of water being at different elevational levels, comprising:

a chamber for holding water, the chamber coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber and positionable below the upper surface of water within the chamber during use, the bottom member comprising a wall extending from the bottom member to a position above the upper surface of the water, wherein the bottom member wall is configured to inhibit the person from moving to a position below the bottom member;

a first conduit coupled to the chamber for conducting water to the chamber during use; and a first water control system positioned along the first conduit, the first water control system being configured to control the flow of the water through the first conduit during use.

173. The system of claim 172, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

174. The system of claim 172, wherein the first and second movable members are configured to swing away from the chamber wall when moving from a closed position to an open position during use.

175. The system of claim 172, wherein the first and second movable members are configured to move vertically into a portion of the wall when moving from a closed position to an open position.

176. The system of claim 172, wherein the first and second movable members are configured to move horizontally along a portion of the wall when moving from a closed position to an open position.

177. The system of claim 172, wherein a distance between the bottom member and the upper surface of the water in the chamber is substantially constant during use.

178. The system of claim 172, wherein the bottom member is floating within the chamber.

179. The system of claim 178, wherein the bottom member comprises a floatation member, the floatation member being positioned upon the bottom member wall at a location proximate the upper surface of the water.

180. The system of claim 179, further comprising a substantially vertical first ladder coupled to the bottom member wall and a substantially vertical second ladder coupled to the wall of the chamber, wherein the first and second ladders are substantially aligned.

181. The system of claim 172, wherein the bottom member comprises a locking system coupling the bottom member to the inner surface of the chamber wall, wherein the locking system is configured to inhibit the bottom member from sinking when water is released from the chamber.

182. The system of claim 181, wherein the locking system is a ratcheted locking system.

183. The system of claim 172, wherein the water control system comprises a valve configured to control flow of water through the first conduit.

184. The system of claim 172, wherein the first conduit is further coupled to the second body of water, and wherein the first conduit is configured to transfer water between the second body of water and the chamber during use.

185. The system of claim 184, wherein the first water control system comprises a valve and a pump, wherein the valve is configured to control flow of water through the first conduit, and wherein the pump is configured to pump water between the chamber and the second body of water during use.

186. The system of claim 172, wherein the first conduit is further coupled to the first body of water, and wherein the first conduit is configured to transfer water between the first body of water and the chamber during use.

187. The system of claim 186, wherein the first water control system comprises a pump positioned along the first conduit for pumping water between the first body of water and the chamber during use.

188. The system of claim 172, further comprising a second conduit and a second water control system, the second conduit being coupled to the chamber for conducting water out of the chamber during use, the second water control system being positioned along the second conduit to control flow of water through the second conduit during use.

189. The system of claim 188, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use.

190. The system of claim 188, wherein the first conduit is further coupled to the second body of water, and wherein the first conduit is configured to transfer water between the second body of water and the chamber during use, and wherein the second conduit is further coupled to the second body of water, and wherein the second conduit is configured to transfer water between the chamber and the second body of water during use, and wherein the second water control system comprises a pump for pumping water between the chamber and the second body of water during use.

191. The system of claim 188, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use, and further comprising a third conduit and a third water control system, the third conduit being coupled to the second body of water and the first body of water, the third water control system being positioned along the third conduit, and wherein the third water control system comprises a pump configured to pump water between the first body of water and the second body of water during use.

192. The system of claim 172, wherein the first movable member, the second movable member, and the first water control system are coupled to a controller, and wherein the controller is configured to control operation of the first movable member, the second movable member, and the first water control system during use.

193. The system of claim 172, wherein the person is riding a flotation device, and wherein the system is configured to convey the person and the flotation device without the person dismounting from the flotation device.

194. The system of claim 172, further comprising additional movable members formed in the wall, and wherein the additional movable members allow participants to enter and exit the chamber to and from additional bodies of water positioned adjacent the chamber.

195. The system of claim 194, wherein the additional movable members are formed at different vertical positions along the chamber.

196. A water lock system for conveying a person from a first body of water to a second body of water, the first and second bodies of water being at different elevational levels, comprising:

a chamber for holding water, the chamber coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber and positionable below the upper surface of water within the chamber during use, the bottom member comprising a locking system coupling the bottom member to the inner surface of the chamber wall, wherein the locking system is configured to inhibit the bottom member from sinking when water is released from the chamber;

a first conduit coupled to the chamber for conducting water to the chamber during use; and a first water control system positioned along the first conduit, the first water control system being configured to control the flow of the water through the first conduit during use.

197. The system of claim 196, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

198. The system of claim 196, wherein the first and second movable members are configured to swing away from the chamber wall when moving from a closed position to an open position during use.

199. The system of claim 196, wherein the first and second movable members are configured to move vertically into a portion of the wall when moving from a closed position to an open position.

200. The system of claim 196, wherein the first and second movable members are configured to move horizontally along a portion of the wall when moving from a closed position to an open position.

201. The system of claim 196, wherein a distance between the bottom member and the upper surface of the water in the chamber is substantially constant during use.

202. The system of claim 196, wherein the bottom member comprises a wall extending from the bottom member to a position above the upper surface of the water.

203. The system of claim 196, wherein the bottom member is floating within the chamber.

204. The system of claim 203, wherein the bottom member comprises a wall and a floatation member, the bottom member wall encircling the bottom member and extending from the bottom member to a position above the upper surface of the water, the floatation member being positioned upon the bottom member wall at a location proximate the upper surface of the water.

205. The system of claim 204, further comprising a substantially vertical first ladder coupled to the bottom member wall and a substantially vertical second ladder coupled to the wall of the chamber, wherein the first and second ladders are substantially aligned.

206. The system of claim 196, wherein the bottom member comprises a wall extending from the bottom member to a position above the upper surface of the water, wherein the bottom member wall is configured to inhibit the person from moving to a position below the bottom member.

207. The system of claim 196, wherein the locking system is a ratcheted locking system.

208. The system of claim 196, wherein the water control system comprises a valve configured to control flow of water through the first conduit.

209. The system of claim 196, wherein the first conduit is further coupled to the second body of water, and wherein the first conduit is configured to transfer water between the second body of water and the chamber during use.

210. The system of claim 209, wherein the first water control system comprises a valve and a pump, wherein the valve is configured to control flow of water through the first conduit, and wherein the pump is configured to pump water between the chamber and the second body of water during use.

211. The system of claim 196, wherein the first conduit is further coupled to the first body of water, and wherein the first conduit is configured to transfer water between the first body of water and the chamber during use.

212. The system of claim 211, wherein the first water control system comprises a pump positioned along the first conduit for pumping water between the first body of water and the chamber during use.

213. The system of claim 196, further comprising a second conduit and a second water control system, the second conduit being coupled to the chamber for conducting water out of the chamber during use, the second water control system being positioned along the second conduit to control flow of water through the second conduit during use.

214. The system of claim 213, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use.

215. The system of claim 213, wherein the first conduit is further coupled to the second body of water, and wherein the first conduit is configured to transfer water between the second body of water and the chamber during use, and wherein the second conduit is further coupled to the second body of water, and wherein the second conduit is configured to transfer water between the chamber and the second body of water during use, and wherein the second water control system comprises a pump for pumping water between the chamber and the second body of water during use.

216. The system of claim 213, wherein the first conduit is further coupled to the second body of water, and wherein the first conduit is configured to transfer water between the second body of water and the chamber during use, and wherein the second conduit is further coupled to the first body of water, and wherein the second conduit is configured to transfer water between the chamber and the first body of water during use, and further comprising a third conduit and a third water control system, the third conduit being coupled to the second body of water and the first body of water, the third water control system being positioned along the third conduit, and wherein the third water control system comprises a pump configured to pump water between the first body of water and the second body of water during use.

217. The system of claim 196, wherein the first movable member, the second movable member, and the first water control system are coupled to a controller, and wherein the controller is configured to control operation of the first movable member, the second movable member, and the first water control system during use.

218. The system of claim 196, wherein the person is riding a flotation device, and wherein the system is configured to convey the person and the flotation device without the person dismounting from the flotation device.

219. The system of claim 196, further comprising additional movable members formed in the wall, and wherein the additional movable members allow participants to enter and exit the chamber to and from additional bodies of water positioned adjacent the chamber.

220. The system of claim 219, wherein the additional movable members are formed at different vertical positions along the chamber.

221. A water lock system for conveying a person from a first body of water to a second body of water, the first and second bodies of water being at different elevational levels, comprising:

a chamber for holding water, the chamber coupled to the first body of water and the second body of water;

a first movable member formed in a wall of the chamber, the first movable member being positioned to allow the person and water to move between the first body of water and the chamber when the first movable member is open during use;

a second movable member formed in the wall of the chamber, the second movable member being positioned to allow the person and water to move between the second body of water and the chamber when the second movable member is open during use;

a bottom member positioned within the chamber, wherein the bottom member is positionable below the upper surface of water within the chamber during use;

a first conduit coupled to the chamber and the second body of water, wherein the first conduit is configured to transfer water between the second body of water and the chamber during use;

a first water control system positioned along the first conduit, the first water control system being configured to control the flow of the water through the first conduit during use;

a second conduit being coupled to the chamber and the first body of water, wherein the second conduit is configured to transfer water between the chamber and the first body of water during use;

a second water control system positioned along the second conduit to control flow of water through the second conduit during use;

a third conduit being coupled to the second body of water and the first body of water, wherein the third conduit is configured to transfer water between the first body of water and the second body of water during use; and a third water control system being positioned along the third conduit, and wherein the third water control system comprises a pump configured to pump water between the first body of water and the second body of water during use.

222. The system of claim 221, wherein the chamber has a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

223. The system of claim 221, wherein the first and second movable members are configured to swing away from the chamber wall when moving from a closed position to an open position during use.

224. The system of claim 221, wherein the first and second movable members are configured to move vertically into a portion of the wall when moving from a closed position to an open position.

225. The system of claim 221, wherein the first and second movable members are configured to move horizontally along a portion of the wall when moving from a closed position to an open position.

226. The system of claim 221, wherein a distance between the bottom member and the upper surface of the water in the chamber is substantially constant during use.

227. The system of claim 221, wherein the bottom member comprises a wall extending from the bottom member to a position above the upper surface of the water.

228. The system of claim 221, wherein the bottom member is floating within the chamber.

229. The system of claim 228, wherein the bottom member comprises a wall and a floatation member, the bottom member wall encircling the bottom member and extending from the bottom member to a position above the upper surface of the water, the floatation member being positioned upon the bottom member wall at a location proximate the upper surface of the water.

230. The system of claim 229, further comprising a substantially vertical first ladder coupled to the bottom member wall and a substantially vertical second ladder coupled to the wall of the chamber, wherein the first and second ladders are substantially aligned.

231. The system of claim 221, wherein the bottom member comprises a wall extending from the bottom member to a position above the upper surface of the water, wherein the bottom member wall is configured to inhibit the person from moving to a position below the bottom member.

232. The system of claim 221, wherein the bottom member comprises a locking system coupling the bottom member to the inner surface of the chamber wall, wherein the locking system is configured to inhibit the bottom member from sinking when water is released from the chamber.

233. The system of claim 232, wherein the locking system is a ratcheted locking system.

234. The system of claim 221, wherein the first water control system comprises a valve configured to control flow of water through the first conduit.

235. The system of claim 221, wherein the second water control system comprises a valve configured to control flow of water through the second conduit.

236. The system of claim 221, wherein the third water control system comprises a valve configured to control flow of water through the third conduit.

237. The system of claim 221, wherein the first water control system comprises a valve and a pump, wherein the valve is configured to control flow of water through the first conduit, and wherein the pump is configured to pump water between the chamber and the second body of water during use.

238. The system of claim 221, wherein the second water control system comprises a valve and a pump, wherein the valve is configured to control flow of water through the second conduit, and wherein the pump is configured to pump water between the chamber and the first body of water during use.

239. The system of claim 221, wherein the third water control system comprises a valve and a pump, wherein the valve is configured to control flow of water through the third conduit, and wherein the pump is configured to pump water between the first body of water and the second body of water during use.

240. The system of claim 221, wherein the first movable member, the second movable member, and the first water control system are coupled to a controller, and wherein the controller is configured to control operation of the first movable member, the second movable member, and the first water control system during use.

241. The system of claim 221, wherein the person is riding a flotation device, and wherein the system is configured to convey the person and the flotation device without the person dismounting from the flotation device.

242. The system of claim 221, further comprising additional movable members formed in the wall, and wherein the additional movable members allow participants to enter and exit the chamber to and from additional bodies of water positioned adjacent the chamber.

243. The system of claim 242, wherein the additional movable members are formed at different vertical positions along the chamber.

* * * * *

UNITED STATES PATENT AND TRADEMARK OFFICE

CERTIFICATE OF CORRECTION

PATENT NO. : 6,475,095 B1
APPLICATION NO. : 09/369754
DATED : November 5, 2002
INVENTOR(S) : Jeffery W. Henry It is certified that error appears in the above-identified patent and that said Letters Patent is hereby corrected as shown below:

Claim 107, col. 35, line 28, please delete “100” and substitute therefor --“106”--.

Claim 129, col. 37, line 28, please delete “120” and substitute therefor --“128”--.

Signed and Sealed this

Seventh Day of October, 2008

JON W. DUDAS
*Director of the United States Patent and Trademark Office*